US008192270B2

(12) United States Patent
Slomiany et al.

(10) Patent No.: US 8,192,270 B2
(45) Date of Patent: Jun. 5, 2012

(54) BINGO GAME, METHOD, AND ELIMINATION TOURNAMENT

(75) Inventors: Scott D. Slomiany, Rolling Meadows, IL (US); Duncan F. Brown, Grayslake, IL (US); Lawrence E. DeMar, Winnetka, IL (US); Mark W. Molitor, Chicago, IL (US)

(73) Assignee: Case Venture Management, LLC, Northbrook, IL (US)

( * ) Notice: Subject to any disclaimer, the term of this patent is extended or adjusted under 35 U.S.C. 154(b) by 1087 days.

(21) Appl. No.: 12/102,693

(22) Filed: Apr. 14, 2008

(65) Prior Publication Data

US 2008/0254854 A1 Oct. 16, 2008

Related U.S. Application Data

(60) Provisional application No. 60/911,927, filed on Apr. 16, 2007.

(51) Int. Cl.
*A63F 9/00* (2006.01)

(52) U.S. Cl. ..... 463/19; 463/16; 463/17; 463/18; 463/40; 463/41; 463/42

(58) Field of Classification Search ..... 463/16–19, 463/40–42
See application file for complete search history.

(56) References Cited

U.S. PATENT DOCUMENTS 4,768,151 A 8/1988 Birenbaum et al.
5,683,295 A 11/1997 Frain
5,711,715 A 1/1998 Ringo et al.
5,779,549 A 7/1998 Walker et al.
5,863,041 A 1/1999 Boylan et al.
6,309,299 B1 * 10/2001 Weiss ..... 463/20
6,585,590 B2 7/2003 Malone
6,599,188 B2 * 7/2003 Hirsch et al. ..... 463/19
6,609,973 B1 8/2003 Weiss
6,612,927 B1 9/2003 Slomiany et al.
6,656,045 B2 * 12/2003 Wei et al. ..... 463/19
6,793,575 B2 9/2004 Brown et al.
6,805,629 B1 10/2004 Weiss
6,840,858 B2 1/2005 Adams (Continued)

OTHER PUBLICATIONS

Coleman, Penny. Re: Sierra Design Group "Mystery Bingo" Game Classification Opinion [online], Sep. 26, 2003. Retrieved from the Internet:< URL:http://www.nigc.gov/nigc/documents/opinions/mysterybingoopinion.jsp>.*

*Primary Examiner* — Dmitry Suhol
*Assistant Examiner* — David Duffy
(74) *Attorney, Agent, or Firm* — McDonnell Boehnen Hulbert & Berghoff LLP

(57) ABSTRACT

A Bingo game, method, and elimination tournament is provided. In one embodiment, the present invention may take the form of a Bingo elimination tournament played by players wagering on respective networked gaming machines in a casino environment. The Bingo elimination tournament may include a plurality of successive Bingo games (rounds) carried out according to standard Bingo methodology, including randomly-drawn numbers being called out, and players' respective Bingo cards being updated (e.g. marked) accordingly, perhaps along with one or more computer-player cards. After each tournament round, among the cards that have not achieved a Bingo during that round, the card or cards having the fewest number of matched numbers are preferably eliminated. Successive rounds are played, often resulting in a single winner of the tournament. Various wagering options are provided for added excitement and enjoyment.

16 Claims, 47 Drawing Sheets

U.S. PATENT DOCUMENTS

| | | | | |
|---|---|---|---|---|
| 6,908,390 | B2 | 6/2005 | Nguyen et al. | |
| 7,481,707 | B1 * | 1/2009 | Luciano et al. | 463/19 |
| 7,614,948 | B2 * | 11/2009 | Saffari et al. | 463/19 |
| 7,717,785 | B2 * | 5/2010 | Odom | 463/19 |
| 2005/0043094 | A1 * | 2/2005 | Nguyen et al. | 463/42 |
| 2005/0071024 | A1 * | 3/2005 | Henshaw | 700/91 |
| 2005/0202864 | A1 * | 9/2005 | Duhamel et al. | 463/16 |
| 2006/0052154 | A1 * | 3/2006 | Boerner | 463/19 |
| 2006/0121971 | A1 | 6/2006 | Slomiany et al. | |
| 2006/0160624 | A1 | 7/2006 | Slomiany et al. | |
| 2007/0135205 | A1 * | 6/2007 | Houle et al. | 463/19 |
| 2007/0257430 | A1 * | 11/2007 | Hardy et al. | 273/139 |
| 2008/0096645 | A1 * | 4/2008 | Frerking et al. | 463/25 |
| 2009/0247259 | A1 * | 10/2009 | Napolitano | 463/18 |
| 2009/0305762 | A1 * | 12/2009 | Hsu | 463/19 |
| 2010/0120489 | A1 * | 5/2010 | Meyer | 463/19 |
| 2010/0137052 | A1 * | 6/2010 | Bennett | 463/16 |

* cited by examiner

BINGO GAME, METHOD, AND ELIMINATION TOURNAMENT

CROSS-REFERENCE TO RELATED APPLICATIONS

This application claims the benefit of U.S. provisional application No. 60/911,927, filed Apr. 16, 2007, entitled "Bingo Game, Method, and Elimination Tournament."

BACKGROUND

1. Technical Field

This invention relates to games of chance. In a preferred form, it is operated in a wagering environment. It may be played by a single player, but provides a much more exciting experience when played by a group of players. In one embodiment, the game takes the form of an elimination Bingo Tournament, and, while the game can be called and marked in the traditional "Bingo Hall" fashion, it is more favorably played on a gaming machine or a network of gaming machines. The game features a variety of different possible bets, some of which get more valuable as the player gets further in the tournament without being eliminated. The variety of possible bets adds the excitement of different combinations of wins as each part of the game plays out, providing the kind of excitement of a traditional Craps table, for example.

2. Description of Related Art

Traditional Bingo games are played in a Bingo hall and involve players marking off letter-number combinations (e.g. B-14, I-28, etc.) that are randomly drawn and then called out by the operator of the game. Typically, the first player or players that are able to mark a particular pattern of letter-number combinations calls out "Bingo" and wins a prize. There have been various electronic systems devised to help players record the called numbers, such as U.S. Pat. No. 4,768,151, or to automatically select the numbers and monitor the game, such as U.S. Pat. No. 5,683,295. There have been automated tournament systems such as the system of U.S. Pat. No. 6,908,390, which operates a bingo game on a linked group of slot machines.

There have been slot machines that have a bonus game allowing the player to play Bingo, such as those found in U.S. Pat. Nos. 6,609,973 and 6,840,858. There have been systems that provide players awards for accomplishments in a Bingo game on the way toward completing the desired pattern, such as the system of U.S. Pat. No. 6,805,629. While all of these previous Bingo games provide ways to distinguish the player doing the best at the game, until now there has not been a facility to measure the poorest performance of the Bingo players, nor has there been a need for such a measurement.

There have been gambling tournaments involving slot-machine or video-poker games, played on machines in casinos or on networked computers such as on the Internet. Elimination tournaments are common in Texas Hold 'em Poker, both at live tables or using electronic connections such as the Internet. Elimination Blackjack tournaments were introduced on the CBS TV show called "Ultimate Blackjack Tour".

There have been multiple-player slot-machine attractions, such as the games disclosed in U.S. patent application Ser. No. 11/296,840 by Slomiany et al. (published as U.S. Patent Application Publication No. US 2006/0121971 A1) and U.S. patent application Ser. No. 11/333,831 (published as U.S. Patent Application Publication No. US 2006/0160624 A1), as well as games like International Gaming Technology (IGT)'s "Super Spin Wheel of Fortune" and WMS Gaming's "Monopoly Big Event."

In traditional Bingo games, it is possible to win prizes that are many times the entry fee. However, large prize pools are created by adding more players to the game, which has the direct result of less action for each player. Until now, there has not been a way to provide the action that comes with a small number of players while still allowing the winning of sizable awards.

SUMMARY

It is believed that players would enjoy the excitement of playing elimination Bingo tournaments. It would be a great benefit to have a Bingo game with a limited number of players, thereby providing more action to the participating players. It would be attractive to provide a Bingo game with various side bets, to further increase the action of the game.

One embodiment of the present invention presents an elimination Bingo tournament played on a network of gaming machines, where the last-remaining player or players receive prizes. Another embodiment implements the same game in a live gaming environment such as a casino table or Bingo hall.

This invention defines a performance criterion wherein the player or players with the lowest performance are eliminated from the tournament at the end of each round.

Another embodiment provides an elimination Bingo tournament using a Multi-Strike type of betting system such as that disclosed in U.S. Pat. No. 6,612,927 to Slomiany et al. and U.S. Pat. No. 6,793,575 to Brown et al. In this embodiment, a bet is made on a series of games in the tournament, and players have an opportunity to win in each round until their elimination. Thus, players will not always play in subsequent rounds, but will have greater opportunity in later rounds when they do play. Another embodiment provides various side bets that may be made by the player. With the addition of multiple side bets, there can be many winners in a social group, in contrast to traditional Bingo, where there is only one or, on occasion, a small number of winners.

In a preferred form, the present invention allows multiple players to participate in an elimination Bingo tournament. Such a tournament may be implemented in a traditional Bingo Hall using traditional calling and marking methods, which are well known in the art. It may be implemented in a traditional Bingo hall using electronic methods of automation which are also well known in the art. It may be implemented as a casino game played at a table, perhaps administered by a live dealer, or alternatively administered by or assisted by an electronic system. It may be implemented on networked computers, perhaps over the Internet, or among mobile gaming devices, just to name a few possibilities.

In its broadest sense, it is not important to the invention which method is used to allow multiple players to participate in the tournament. The system shown in various examples herein refers to a network of gaming machines. However, it is well known in the art how to adapt such a game for a live-table or linked-computer implementation. The present invention may also be implemented on a single gaming machine adapted for a single player or for multiple players, as is well known in the art.

In an embodiment using a networked group of gaming machines, the games could use any networking technology to allow each game to communicate to a game server, including but not limited to serial, parallel, modem, Ethernet, or fiber-optic, to name a few.

These as well as other aspects and advantages will become apparent to those of ordinary skill in the art by reading the following detailed description, with reference where appropriate to the accompanying drawings.

BRIEF DESCRIPTION OF THE DRAWINGS

Various examples of embodiments are described herein with reference to the following drawings, wherein like numerals denote like entities.

DETAILED DESCRIPTION OF THE DRAWINGS

Figure 1:
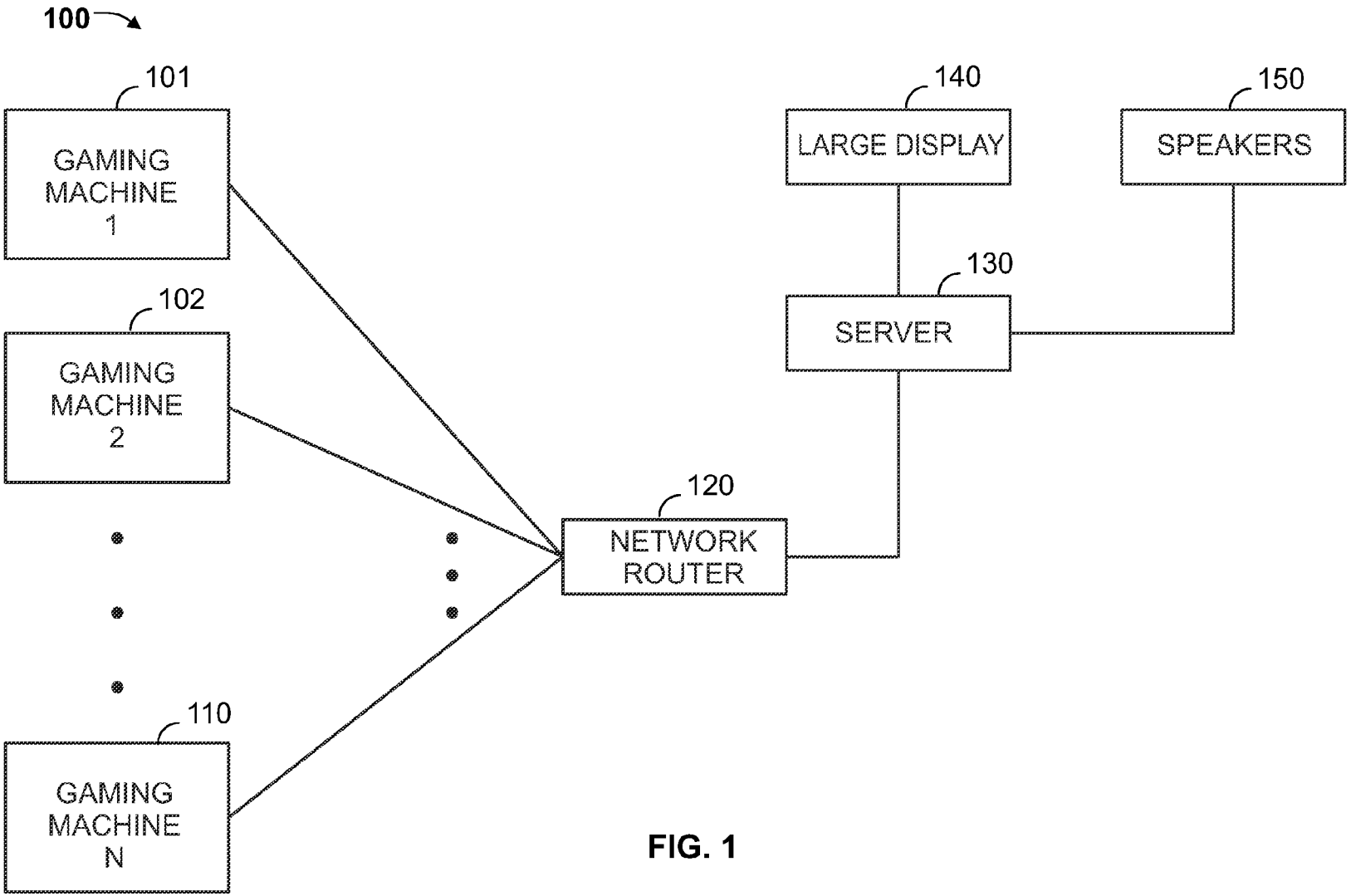
FIGS. 1 and 2 are simplified block diagrams of communication systems, in accordance with exemplary embodiments.

FIG. 1 shows a block diagram of one possible network configuration 100. It should be understood that this and other arrangements described herein are set forth only as examples. Those skilled in the art will appreciate that other arrangements and elements (e.g., machines, interfaces, functions, orders, and groupings of functions, etc.) can be used instead, and that some elements may be omitted altogether. Further, many of the elements described herein are functional entities that may be implemented as discrete or distributed components or in conjunction with other components, and in any suitable combination and location. Various functions described herein as being performed by one or more entities may be carried out by hardware, firmware, and/or software. Various functions may be carried out by a processor executing instructions stored in memory.

As shown in FIG. 1, an arbitrary number (n) of gaming machines 101, 102 through 110 are connected to a network router 120, which in turn is connected to a server 130 having a display device ("Large Display") 140 as well as some number of audio speakers 150. The display device 140 can be a large display that is viewable from each involved gaming machine 1 through n (101 through 110), and would typically comprise a plasma or liquid crystal display (LCD), although any type of display could be used without departing from the invention.

Each gaming machine 101-110 in the network 100 may have one or more of the typical gaming machine elements, such as (1) one or more video displays, (2) one or more input devices, perhaps including buttons and a touch-screen on the video display(s), (3) means to put money at stake, such as coin/bill/ticket acceptors, credit-card readers, a module for accepting electronic funds transfers, etc., (4) means to pay out wins and balances, such as a coin hopper, a ticket printer, a module for sending electronic funds transfers, etc. In general, there are many different combinations of gaming-machine elements that are well known in the art, and each station may be constructed of these or other components without departing from the invention.

The gaming machines 101-110 on the network 100 do not have to be of similar configuration, as long as each machine 101-110 has the capability to connect to the game server 130. Mobile gaming devices could be used instead of or on the same network as traditional stationary, cable-linked gaming machines. In the same manner, players connected through a computer network such as the Internet could be networked with other players in the system. While a game server is preferable for operating the game, the server 130 could be part of the electronic system of one of the gaming machines 101-110 without departing from the invention.

Figure 2:
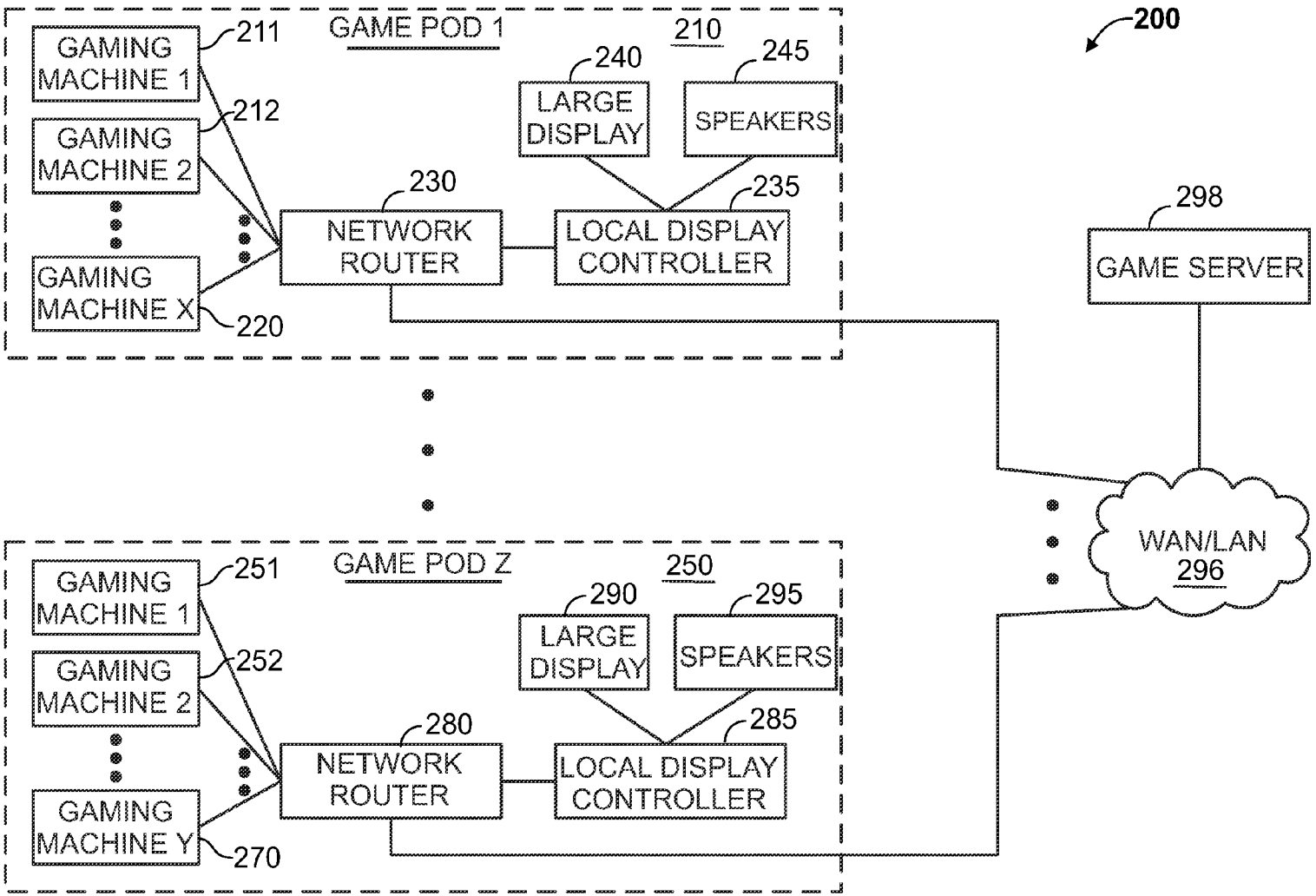

FIG. 2 shows a wide area network (WAN) configuration 200 of a similar network with gaming machines 211-220 through 251-270 at multiple locations 210-250 (or in separate areas of one location). In this configuration, there would preferably be a common display (i.e. Large Display) 240-290 and speakers 245-295 with each game or group of games. Each game pod 210-250 has a local display controller 235-285 and network router 230-280, all of which communicate via a network (WAN/LAN) 296 with a game server 298.

One central feature to an aspect of the games of this invention is the concept of elimination of the lowest player or players based on performance criteria. The system pits a player against other players, one or more non-player bingo cards, or both (collectively called "contestant cards"). Each game (or "round") in the tournament ends when any one contestant card shows (or any group of contestant cards show) a desired pattern of marked spots. At the end of each round, the contestant card(s) with the lowest performance criteria is/are eliminated from the tournament, and another round progresses with the remaining contestant cards. This procedure is repeated until there are no contestant cards left, or one remaining contestant card, which is then designated the winner of the tournament.

The preferred performance criterion for elimination in this invention is the player or non-player card—among those not having a winning Bingo combination—with the lowest number of marked spots. If all remaining player and non-player cards have a winning Bingo combination, then the performance criterion for elimination may be the player or non-player card with the lowest number of marked spots. If more than one player or non-player card meet the performance criterion for elimination, then each of these players and non-player cards are eliminated. This step of eliminating multiple players and cards on certain rounds results in many of the tournaments ending before the maximum number of rounds (which is one less than the number of contestant cards in play at the start of the tournament). This allows bets which cover the later rounds of the tournament to give a greater return, since, in many of the tournaments, these rounds will not be played.

There may be other performance criteria used for elimination without departing from the invention. Another example could be the elimination of the last card to cover its first (non-free) spot, perhaps with simultaneous elimination of each player or card that was last to cover on the same number.

While it is preferred to have some games which play in fewer rounds in order to allow higher payouts on the later rounds, the tournaments may be constructed so that the elimination pattern is a constant number of players/cards each round, without departing from the invention.

When each tournament begins, there is preferably a fixed number of players and non-player cards (collectively contestants) in the tournament. The number of contestants could vary from tournament to tournament without departing from the invention, and one of ordinary skill in the art would make appropriate adjustments to the payouts to reflect the fact that changing the contestant count will make the awards in the game more profitable or less profitable for each win.

In the present example, there are ten contestant cards in play at the start of each tournament. Each tournament could use a greater number or a lesser number of contestants without departing from the invention. Reference will now be made to FIGS. 3-21, which depict various exemplary screenshots in accordance with exemplary embodiments of the invention.

Figure 3:
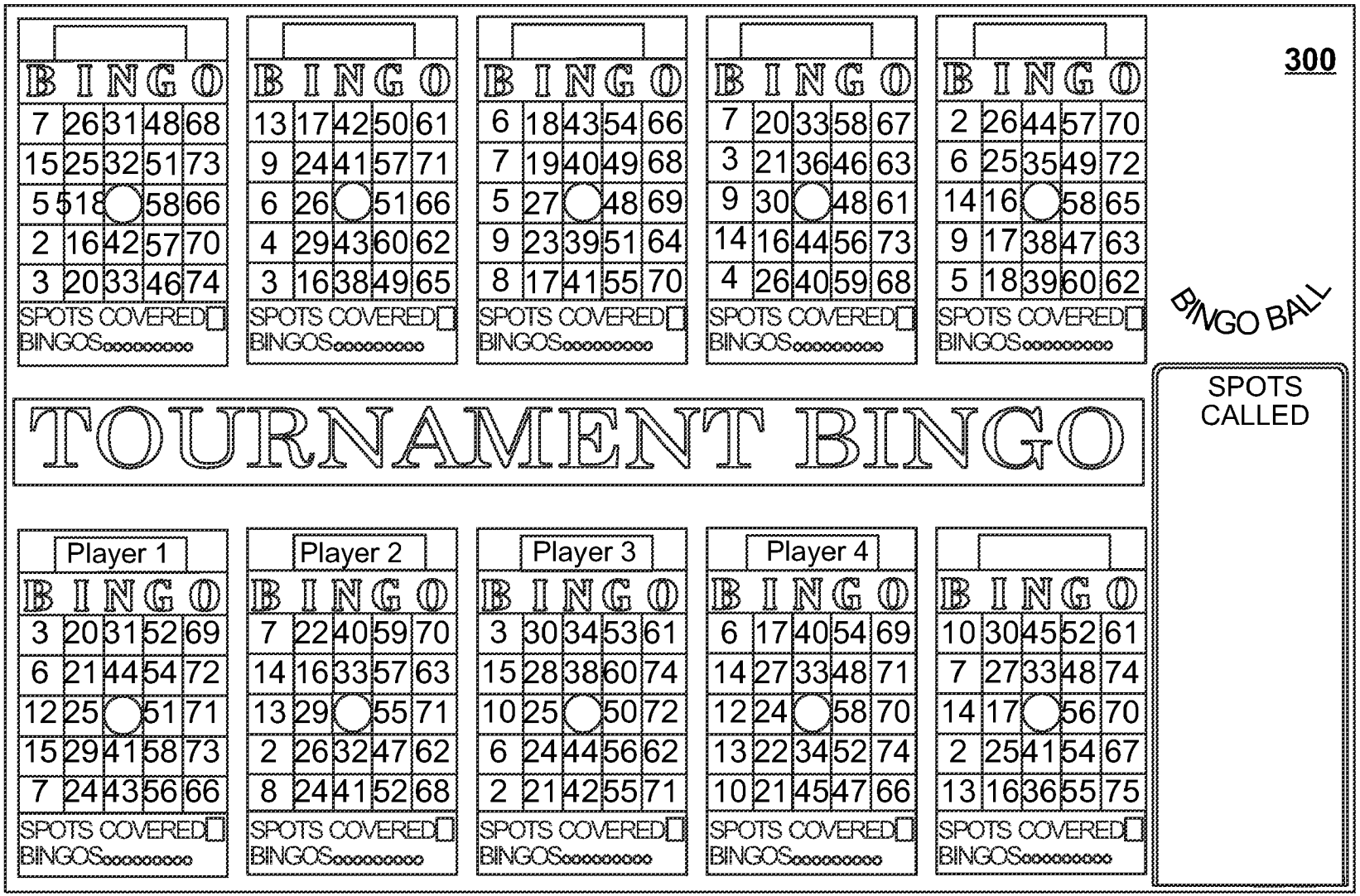
FIGS. 3 through 21 depict various screenshots, in accordance with exemplary embodiments.

FIG. 3 shows a screenshot 300 of the Large Display that is in view of all of the players at the start of an example game. The ten contestant cards are in two rows of five cards each.

Any number of the ten contestant cards (including all ten) could be cards for players at the gaming machines on the network of FIG. 1, with the balance of the ten cards played by a central server/CPU as non-player cards. As a result of the free substitution of player and non-player opponents, the odds, payouts, and hold percentage remain the same regardless of the number of actual human players participating at any time. This free substitution of player and non-player cards also allows the game to run continuously, without needing to wait for players to finalize their bets before proceeding. When the tournament start timer hits zero, the tournament starts with all players that are ready, substituting all other positions with non-player cards. Furthermore, this invention has the advantage of allowing the game to operate with as few as one human player, not requiring other human player opponents to have a game.

In FIG. 3, the leftmost four cards on the lower row represent players—at gaming machines—that have set up their bets and entered the tournament (note "Player 1," "Player 2," etc.). Note further that, though this example plays ten cards at a time, it does not mean that it is limited to ten gaming machines on the network of FIG. 1. With more than ten gaming machines on the network, the first ten that set up their bets and enter the tournament would be included, while other players could be able to enter a subsequent tournament. For larger groups of games, additional displays and servers could be added to the network, allowing the first ten players that enter to participate in a tournament on the first display, with subsequently-entering players able to participate in tournaments on a second, third, etc. display. The present invention is clearly scalable. In the networked-computer model, which supports mobile gaming and/or play over the Internet, there could be a large plurality of tournaments with various groups of players distributed among these tournaments by choice, or other sequencing methods, as is common in online Texas Hold 'em Poker rooms, for instance.

Referring back to FIG. 3, each of the ten contestant cards is shown including the "Free Spot" in the center and the twenty-four other numbers in the B, I, N, G, and O columns. This example shows the player's station number for the live players at the top of each card; however, the player could enter a name (or handle to be known by), or this information could be read from a player-tracking card, as is well known by those skilled in the art. In addition, each contestant card shows a count of the total number of spots covered (including the Free Space in the center). Each card also shows the number of Bingo combinations achieved by the card during the tournament. On the lower-right side of FIG. 3, the numbers called in the bingo game will be displayed. Among other advantages, this will reassure players that the system has not failed to mark an already-called number on their Bingo card. In the upper right, each ball that is pulled, including the final ball (which will give at least one player a Bingo combination), will be shown.

Figure 4:
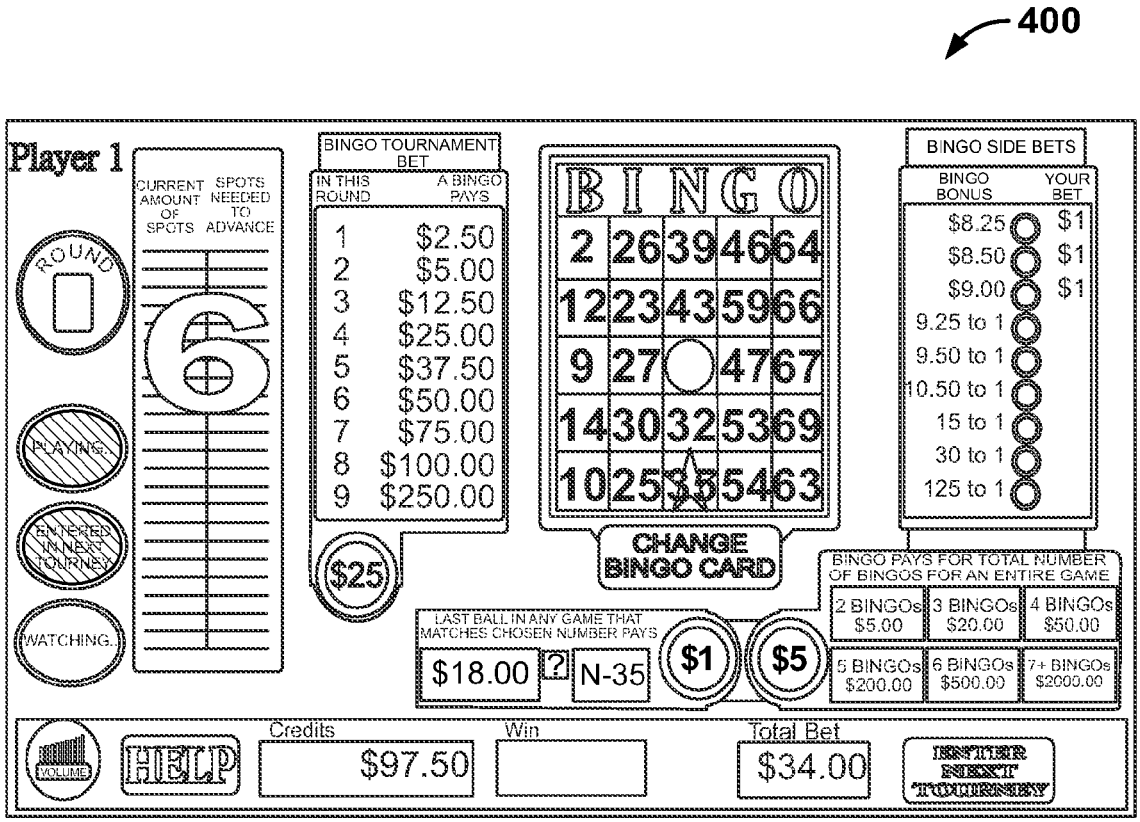

FIG. 4 shows a screenshot 400 of one embodiment of the display on the gaming machine of Player 1 during the betting phase of the game. In this embodiment, the display on the gaming machines includes a touch-screen video display; however, any display may be used. In the case of a smaller display, such as the display on a cell phone or mobile gaming device, as examples, some of the information on the screen may need to "pop up" when accessed. These techniques are well known in the art.

Looking to the left of the Bingo card (in FIG. 4) is the Bingo Tournament Bet area. This is a single bet that the player can make, which will pay for every Bingo combination the player receives in the tournament. In this tournament, Player 1 has placed a $25 Bingo Tournament Bet, which could be thought of as 25⁄9 of a dollar on each of the possible nine rounds. The player placed this bet by touching the gaming chip at the bottom of this area until the desired bet (from $1, $2, $5, $10, $25) appeared. Of course, any choice of denomination and bet size may be allowed, as is well known by those skilled in the art. This bet works the same way as the bet on the laps of the racing game of U.S. Pat. No. 6,793,575 to Brown et al. In this embodiment, the player is not allowed to wager on less than nine rounds of the tournament; however, such a bet may be accommodated without departing from the invention.

The right column of this Bingo Tournament Bet area shows the exact return of each possible Bingo, scaled by the player's bet. A Bingo in Round 1 of the tournament pays 10% of the player's bet, while a Bingo in round 9 pays 1000% of the player's bet (i.e., $250.00 on the $25.00 bet). For each bingo in the tournament, the player receives the amount for that Bingo in addition to any amounts won on previous Bingos, as will be seen in the example below. In this example, a Bingo is any five marked spots in any horizontal, vertical, or diagonal row. Yet it is unimportant which combinations are considered to be Bingo, and other patterns may be used to signify a Bingo without departing from the invention.

The reader will note that side bets are common in table games such as Craps, Baccarat, and Blackjack, to name a few. They add action and excitement to a game by giving a player different ways to win, and provide games where many different types of wins occur, as well as varied types of wins in different games. Side bets also raise the hit frequency, which, generally stated, is a ratio of (1) the number of plays of a game during which a player wins something (even if that something is only a fraction of the player's bet) to (2) the total number of plays of the game in which the player partakes; in general, a higher hit frequency makes a game of chance more exciting. The addition of various side bets to the current invention adds this type of increased hit frequency and excitement. There are four side bets which have been designed into this example, but there are many other side bets which could enhance the game. There is no limit to the number of side bets, though, preferably, any provided side bets will be presented in a manner that is clear to the average player. Note that, consistent with the present invention, a game without side bets could certainly be implemented.

To the right of the Bingo card is the Bingo Bonus side bet. There is a separate bet possible for each round of the game. If the player achieves a Bingo combination in a particular round, this bet pays the odds shown for that round. It can be seen that the payoffs start at 8.25-for-1 in the first round of the tournament (which is played by all players, as no player/card has yet been eliminated), and increases to 125-for-1 in the ninth round of the tournament (which often is not played at all, and, most of the time that it is played, the particular player making such a side bet has likely already been eliminated).

Note in general that a payout listed as "x-for-1" will pay x units for each 1 unit bet. So, a 125-for-1 payout would result in a player being paid 125 credits for a winning bet of 1 credit. This is as opposed to characterizing a payout as "x-to-1", which would pay (x+1) units for each 1 unit wagered. As an example, an even-money bet could be phrased as paying 2-for-1 or 1-to-1; either way, a player who bets one credit and wins would end up with 2 credits. Note further that the screenshots of exemplary embodiments show payouts in terms of "x-to-1"; however, in preferred embodiments, these same payouts would be replaced with payouts of the form "x-for-1," while using the same values for x. Note that either the x-to-1 or the x-for-1 slate of payouts could be used without departing from the present invention, in that these varying payouts would just change the average percentage of wagers that are returned to players versus being retained by the house, and are generally within the discretion of a particular implementer.

Returning to the present invention, these Bingo Bonus bets (as with all of the side bets in this example) are only made before the tournament begins. There could be other side bets that are made as the tournament progresses in the same manner that bets are placed prior to each dice roll of a craps game. A side bet may be placed on a given round by the player touching the gaming chip for that round in the same manner as was done for the Bingo Tournament Bet.

At the lower-right corner of FIG. 4 is the "Total Number of Bingos" side bet. This is a single bet that pays if the wagering player gets two or more Bingo combinations in a single tournament. With the second and each successive Bingo combination by the same player in a tournament, that player gets paid the amount shown in addition to any previous amount paid. Table 1 below shows the total pay (in this embodiment) for two or more Bingos for each $5 bet placed on this "Total Number of Bingos" side bet.

In addition to the amounts paid for Bingo combinations by the betting player, there may be an "Envy Bonus" (not shown) associated with this side bet. In a similar fashion as disclosed in U.S. Pat. No. 5,863,041, this "Envy Bonus" is awarded to any player making a minimum wager (such as $5) on this side bet. If another player gets five or more Bingo Combinations in a tournament, the winning player could win $275 or much more on a $5 bet. Any player that wagers a minimum wager (such as $5) on the "Total Number of Bingos" side bet may qualify for the "Envy Bonus," and would receive a fixed consolation award shown in table 1 any time any of the other players in the game had such a run. Anyone hitting the seven "Bingos" may also be required to buy drinks for all other participants, if so desired (i.e., the consolation award need not be monetary and may or may not be required to be paid by the winning player).

TABLE 1

| Bingos | Pay for this Bingo | Total Paid | Envy Bonus (fixed) |
|---|---|---|---|
| 2 | 5 | 5 | 0 |
| 3 | 20 | 25 | 0 |
| 4 | 50 | 75 | 0 |
| 5 | 200 | 275 | 5 |
| 6 | 500 | 775 | 20 |
| 7 | 2000 | 2775 | 100 |
| 8 | 2000 | 4775 | 250 |
| 9 | 2000 | 6775 | 500 |

In the lower-center area of the screen shown in FIG. 4 is the "Last Ball" side bet. This allows the player to make a wager on which number (B-1 through O-75) will be the final number called to complete a Bingo Combination during the tournament. After touching the gaming chip to set the amount of this side bet, the player touches the small question mark, which may pop up a selection screen as seen in screenshot 700 of FIG. 7 (see the overlay grid in the center entitled "Select Your Lucky Number"). The player may then touch the number to wager on as the final number.

Figure 5:
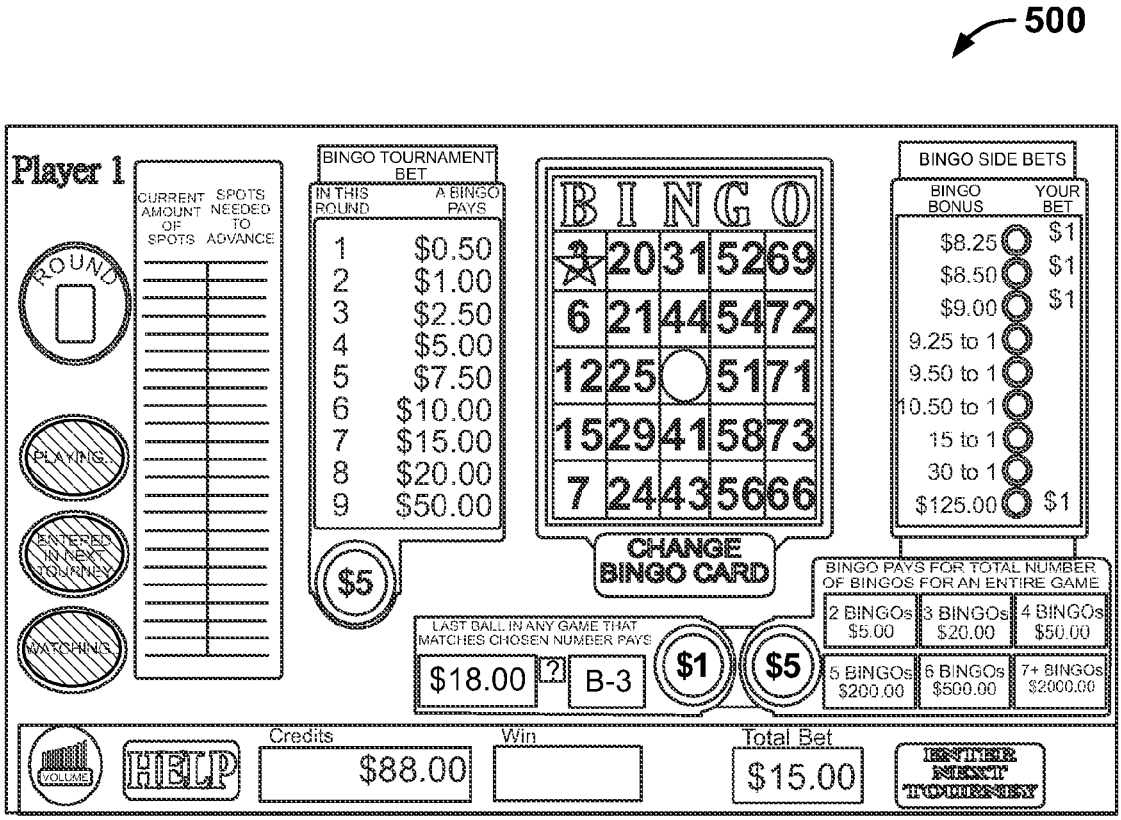

With reference to the screenshot 500 shown in FIG. 5, the selected number (B-3) is shown in this betting area, and if the number appears on the player's card, then a star may appear in the background behind that number. The player is allowed to wager on any number (whether shown on the player's card or not), but many players may consider it to be more exciting to select a number that is on their card, as this can lead to multiple wins and exciting near-misses. In this embodiment, this bet pays $18 for each dollar bet if the chosen number is the final number called in any game during the tournament, as long as the player has not yet been eliminated. If, during the tournament, the number selected for this side bet matches the number that completes a Bingo for any player still in the tournament, then this side bet is a winner, regardless of which player gets the Bingo. Thus, this side bet may be implemented such that the number you select for the side bet does not need to complete a Bingo on your card—you may win if the number you select completes a Bingo on any card that is still in the tournament.

Of course, any of the bets in this invention could pay off at different rates without departing from the invention, and it is well known in the art that such changes are the method most commonly used to modify the payout percentage of a game. The side bets in this example have been computed such that they only pay until the player is eliminated from the tournament. Once eliminated, the player's bets are all settled (which allows the player to modify the Bingo card or the various bets while the other players finish out the tournament). In another embodiment, the Last Ball bet could pay until the tournament ended, but doing this would require the payout odds to be adjusted in a manner that is well known in the art.

The final side bet in this example is not shown on the screen. This bet wins if the player "wins" the tournament. In most tournaments, one of the ten contestants wins by being the last-remaining card after the other contestants are eliminated. (There is a case where a tournament has no winner, when all remaining contestants get a Bingo combination on the last ball, with the same number of spots marked on each remaining card.) In this example, a player that places a wager that they will win the tournament is paid off at a rate of $9.50 for every $1.00 bet.

Leaving the subject of side bets and returning to the game in general, the player that is in the betting phase (prior to the start of a given tournament) can press the "Change Bingo Card" button in the center of the screen to display a different random Bingo Card. The player may press this button for a card change as often as desired during the betting phase, up to the point where the tournament begins. In another embodiment, the player has a button requesting a particular Bingo card to be saved, which allows the player to recall a "lucky" card at a later time, using their player tracking card, a PIN, a password, or some other identifying object, identifier, or other information, as such are known in the art.

Each time a new tournament is about to begin, a timer may be shown boldly on the shared Large Display, and shown on the left side of each player's gaming machine, as seen in FIG. 4. (The large "6" indicates that the next tournament will begin in 6 seconds.) Once the player has established the desired bets and has their card choice, the player presses the "Enter Next Tourney" button (on the lower right). The client program in the gaming machine sends the betting information to the server, using a network protocol well known in the art, and dims out the gaming-chip touch areas used to modify the bets. That is, these are no longer active areas. The gaming-machine client program dims the "Watching" moniker on the left side (of FIG. 4) and illuminates the "Entered in Next Tourney" emblem (shown in FIG. 6). Until the tournament begins, the "Change Bingo Card" button remains lit up and active, allowing last-minute card changes until the tournament starts.

Figure 6:
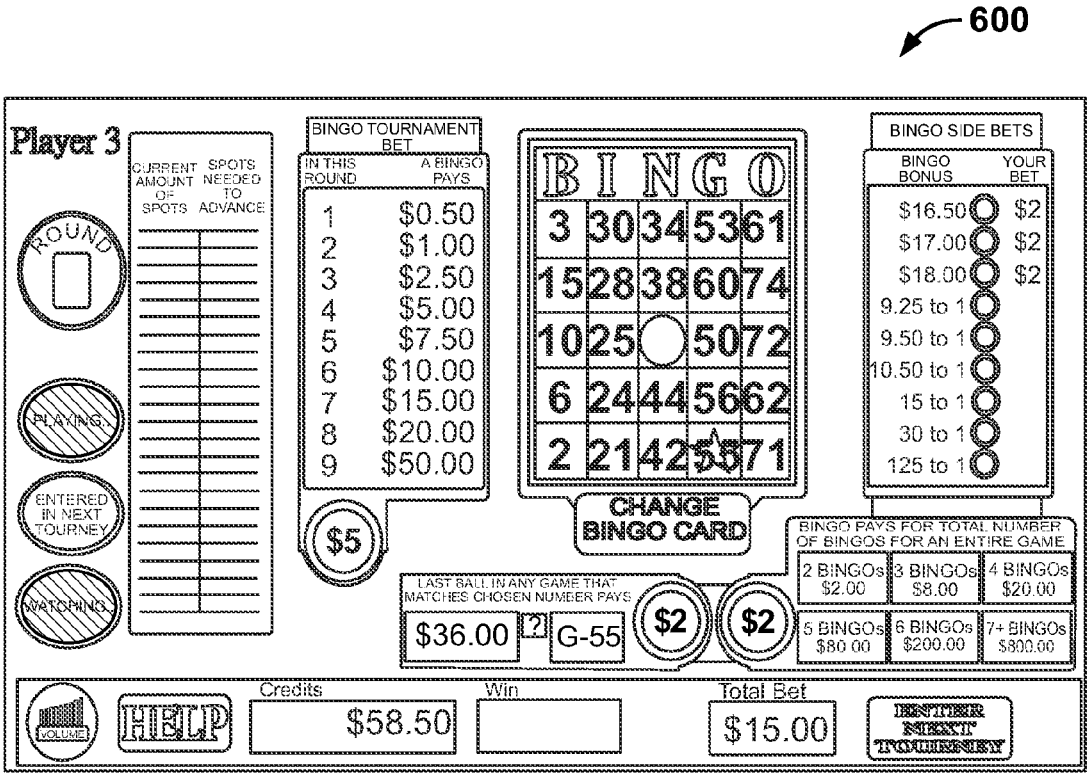
Figure 7:
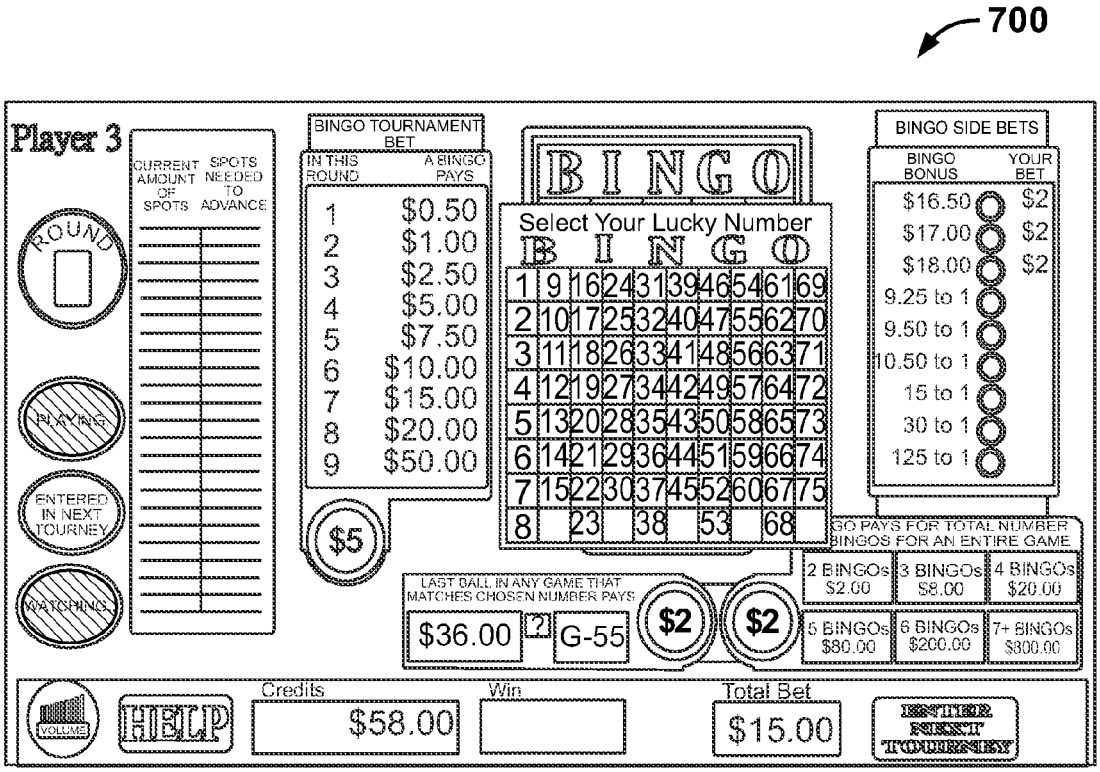

FIGS. 5 and 6 (i.e. screenshot 600) show the display for Player 1 and Player 3, respectively, for an example tournament that is about to begin. Each player has wagered $5 for the Bingo Tournament Bet. Player 1 has bet $1 on the Bingo Bonus side bet for rounds 1, 2, 3 and 9. Player 3 has made a $2 Bingo Bonus side bet on each of the first 3 rounds. Player 1 has bet $5 on the "Total Number of Bingos" side bet, which will qualify for the Envy Bonus should another player get five or more Bingos during the tournament. Player 3 has only wagered $2 on this bet and does not qualify for the Envy Bonus in this embodiment. Player 1 has wagered $1 for B-3 as the final number drawn, while Player 3 has wagered $2 on G-55. (Note the final number showing on the Bingo cards with a star in the background.) There are two other players (Player 2 and Player 4) playing, in this example, at nearby gaming machines.

The server (i.e. central CPU) begins the game. Messages are sent by the server to the client program in each gaming machine using a network protocol that is well known in the art. Each client machine that has entered the tournament updates its local display to begin the game. This includes changing the left side indicator to illuminate "Playing" while dimming out the "Change Bingo Card" button (which is now deactivated). Messages from any betting or previous games are removed by the gaming-machine client program, as well as marked spots from any previous game.

Bingo balls are randomly selected by the server program from a pool of balls numbered 1 through 75. The use of the numbers 1 through 75 is based on the widely known Bingo game which assigns 15 balls to each column B, I, N, G, and O, respectively. There could be a different pool of numbers with different means for assigning them to game cards without departing from the invention. The server uses a Random Number Generator (RNG) program as is well known in the art to generate a random number between 1 and 75 inclusive, throwing out numbers corresponding to balls which have already been drawn. There are other methods of simulating the random draw of Bingo balls which are well known in the art and may be used without departing from the invention.

Figure 8:
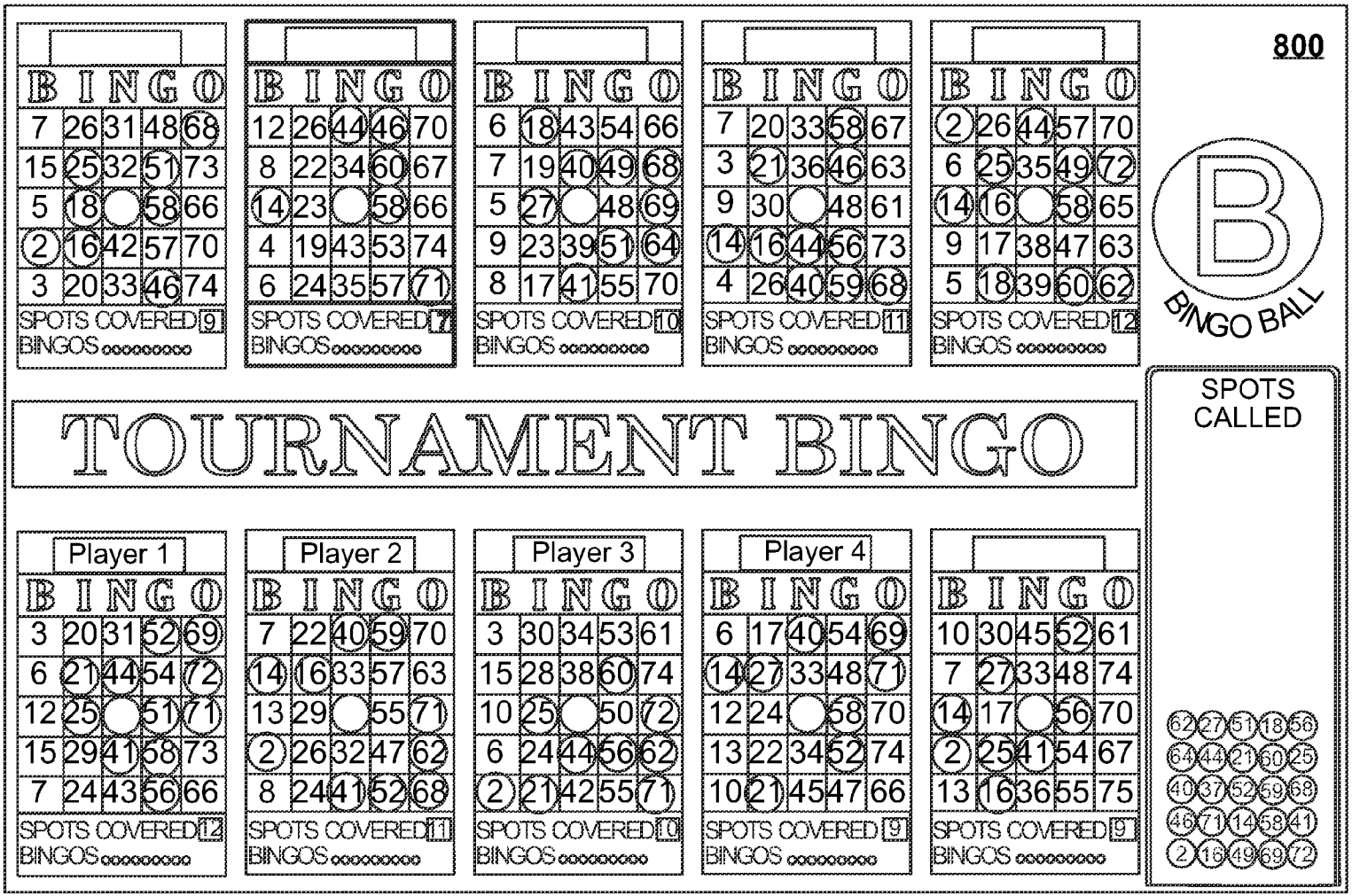

With each ball drawn, the server updates the Large Display as shown in screenshot 800 of FIG. 8. The new ball is shown in the lower-right area. For each of the ten Bingo cards shown on the Large Display, the card is marked with a red circle if the drawn number appears on the card. The "Spots Covered" number on each card (see the bottom of the card) on the Large Display is updated each time a spot is marked on the card.

Though not visible in the black-and-white image of FIG. 8, another possible feature is to make the background color of the card or cards with the lowest number of marked spots different (e.g., red instead of blue) to clearly show the card that would be eliminated if it does not match more numbers or achieve a Bingo combination. This elimination aspect will be discussed more hereinafter. The background colors of the cards may be updated with each ball drawn and, in most games, the red background moves about different cards during the play of the game. In the case of FIG. 8, the red background is on the second card of the top row, which only has seven spots covered. The server sends messages over the network to each gaming machine indicating the Bingo ball number that was drawn. The client program running on the gaming machine updates the local display, which, for Player 1, can be seen in FIG. 10.

The client software on the local gaming machine is sent information from the server as each Bingo ball is drawn. Referring to screenshot 1000 of FIG. 10, an arrow just to the left of the Bingo card points at the Round-1 payout value of the Bingo Tournament Bet. Likewise, to the right of the card, an arrow points at the payout value of the Bingo Bonus bet that Player 1 made for round 1 of this tournament. The Bingo Bonus bet arrow only appears during rounds where the Bingo Bonus was placed, although it could appear in all rounds in another embodiment.

With each ball drawn, the server further sends information to the client program in the gaming machine including the number of the ball drawn and the "Spots Needed To Advance" for that gaming machine. Also, when one or more contestants have a Bingo combination, the server sends information about the end of the game, the final ball, and which contestants have been eliminated. It will be understood that, while client and server applications are referred to in these embodiments, the programming software need not be so situated or decentralized.

Figure 10:
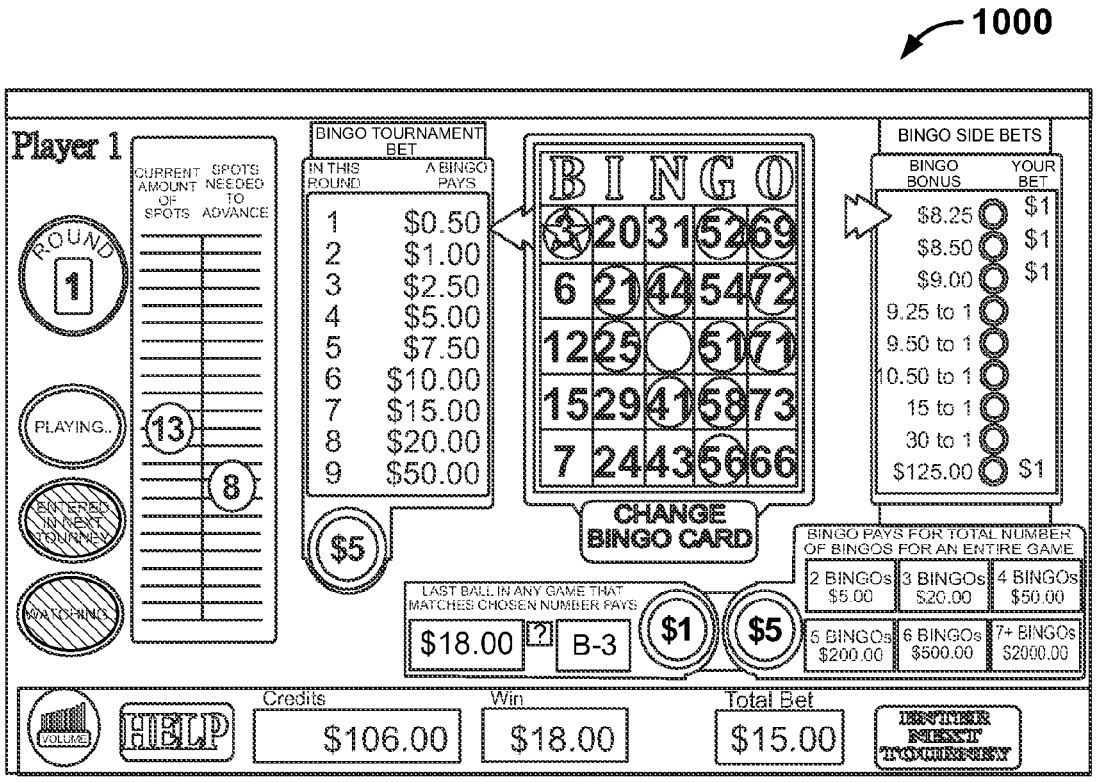

Referring again to FIG. 10, the client program places a red circle around each number that matches a ball selected by the server on the local display of the gaming machine. Further, each time a number is marked with a red circle, the client program checks the twelve possible Bingo patterns (five horizontal, five vertical and two diagonal) to see if any patterns have four of the five markers needed). In each case where four of the five necessary numbers are present, the remaining number is changed in color (here, from black to blue) to help the player focus on the numbers that may yield a Bingo pattern. In FIG. 10, the numbers B-12, G-54 and O-66 would be changed from black to blue.

On the left side of the display, the client program updates the Current Amount of Spots marked on the player's card and the Spots Needed to Advance reported by the server. This provides a graphical indicator of whether or not the player at this gaming machine is in danger of elimination. The Current Amount of Spots is simply the quantity of marked numbers on the player's Bingo Card, and shows "13" in FIG. 10. The Spots Needed to Advance is reported by the server for each gaming machine. If the gaming machine does not contain the lowest number of marked spots, then this number is set as one more than the number of spots marked by the contestant with the lowest number of marked spots.

At this time, in the current example, the second contestant card on the top row has only seven spots marked (as seen in screenshot 900 of FIG. 9) and is the lowest-ranking card, so the threshold for Player 1 (for instance) to advance is eight or more spots. However, the threshold is computed differently for the contestant that has the fewest spots marked. Referring to FIG. 8, which depicts the situation just before the final ball of this first tournament game is drawn, the next-lowest number of marked spots is nine (on three different contestant cards). If the second card on the top row were a player contestant, then even if the second card increased to 8 or 9 spots marked, it would still be eliminated; so, at the time of the display of FIG. 8, if the second card on the top row were a player contestant, its gaming machine would show "10" Spots Needed to Advance (i.e. one more than the nine-spot cards) next to a Current Spot Count of "7." Because these two indicators are updated with each ball drawn, each player can visually see how safe (or unsafe) they are—with respect to elimination—as the game progresses.

As an additional visual indicator, the Current Amount of Spots may be shown with a green background if it is equal to or higher than the Spots Needed to Advance, while being shown with a red background if it has a lower value (corresponding to a danger of being eliminated). Like the red background on the Large Display, this background color may change many times during the course of a game, as a player's relative standing changes during play.

The process of calling the selected numbers could be operated in standard Bingo Hall fashion, where each number is announced on the Large Display (and optionally on each gaming machine display). The matching spots could then be marked by the gaming machine as described above, or the system could allow the player to mark (or daub) their own numbers as they are called. However, one of the goals of this invention is to provide a Bingo experience with more action than the slow-paced Bingo hall, so in this embodiment the numbers are rapidly drawn and marked automatically until the server detects that the drawn number gives one of the contestants a Bingo combination.

At this point (i.e. when the server detects at least one Bingo (that is not yet known to the player(s))), an audio tone sounds, and a (computer-generated) voice announces "The final ball for this round is". The server then displays the column letter as seen in FIG. 8, where "B" is displayed as the Bingo Ball in the upper-right corner. "B" is then announced. The players now know that the Bingo ball is in column "B," and are able to look at their gaming machine (or the Large Display) to see if they have a chance of being the winner. Looking at the cards in FIG. 8, we can see that Player 1 needed a B-12 for a Bingo combination. Upon hearing the "B" announcement, Player 1 can inspect the B column on the gaming machine to see that B-12 will give a Bingo combination and that B-3 is the player's "Last Ball" selection.

Figure 9:
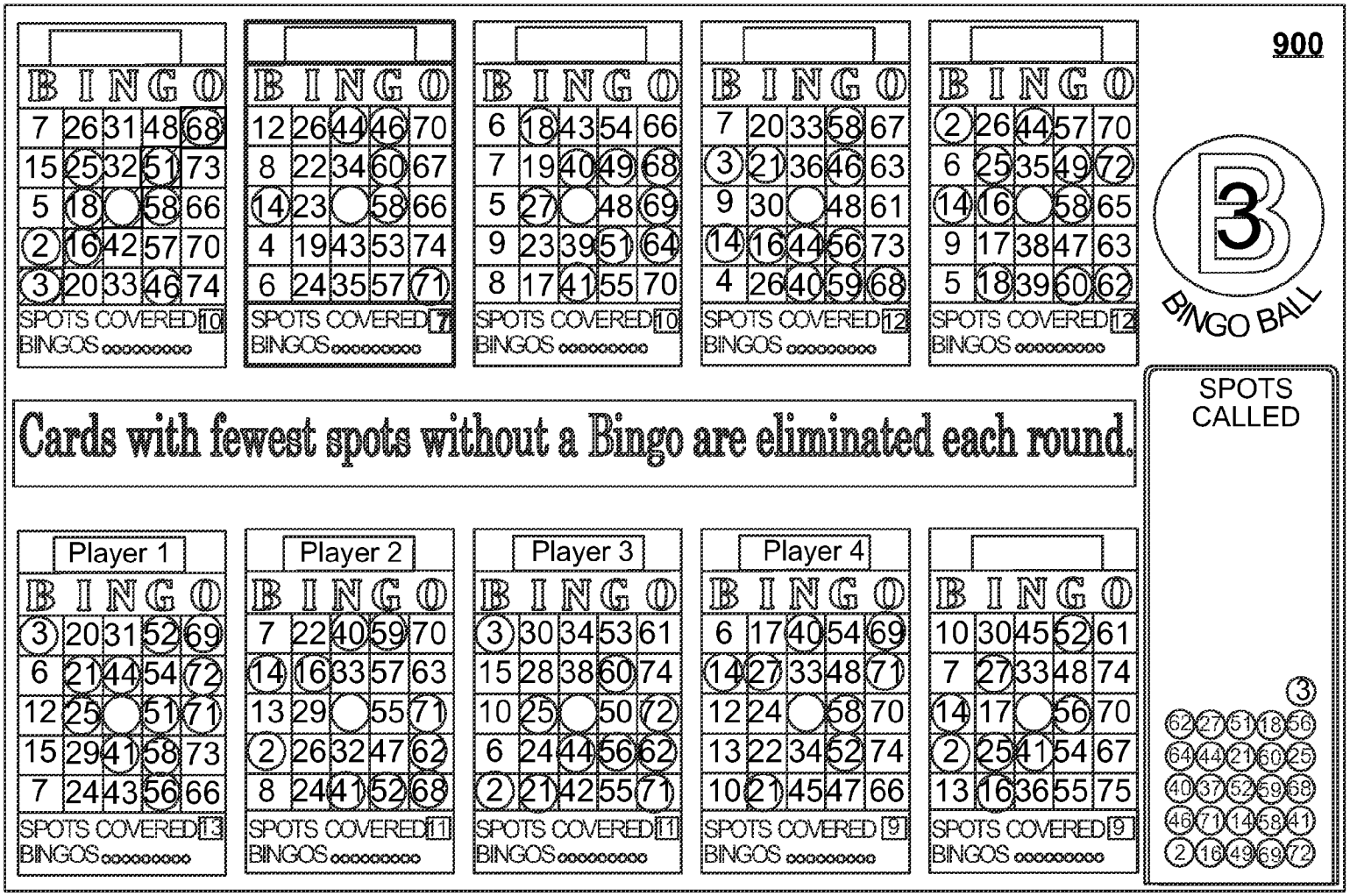

Referring to FIG. 9, the server displays the final ball as B-3, and announces "three" (e.g., again using the computer-generated voice). This entire sequence thus announced was "The final ball for this round is . . . B . . . 3" where the Large Display shows FIG. 8 when the "B" is announced and the Large Display shows FIG. 9 when the "3" is announced.

FIG. 9 shows that the leftmost contestant card on the top row has a bingo combination (the diagonal line from the upper right). The server illuminates a "Bingos" light (at the bottom of the upper-left Bingo card) and emphasizes that the second contestant card in the top row is eliminated from the tournament with only seven spots marked. Looking at FIG. 10 again, we see that the last ball of B-3 matched the Last Ball selected by Player 1, resulting in $18 added to the credit and win meters for this player.

As described above, once the last ball has been announced, the server sends messages to each gaming machine to indicate that the round is complete, to identify the last ball, and to provide elimination information. The client program of each gaming machine takes care of necessary updates, including display of Bingo and the award of amounts won by any of the possible bets. Any gaming machine eliminated from the tournament reverts to "Watching" mode, and bets and cards may be adjusted on this machine. The client program on gaming machines that have not been eliminated clear off the marked spots, move the Round arrows downward to the next round, and reset the slider indicators ("Current Amount of Spots" and "Spots Needed to Advance") on the left side.

Figure 11:
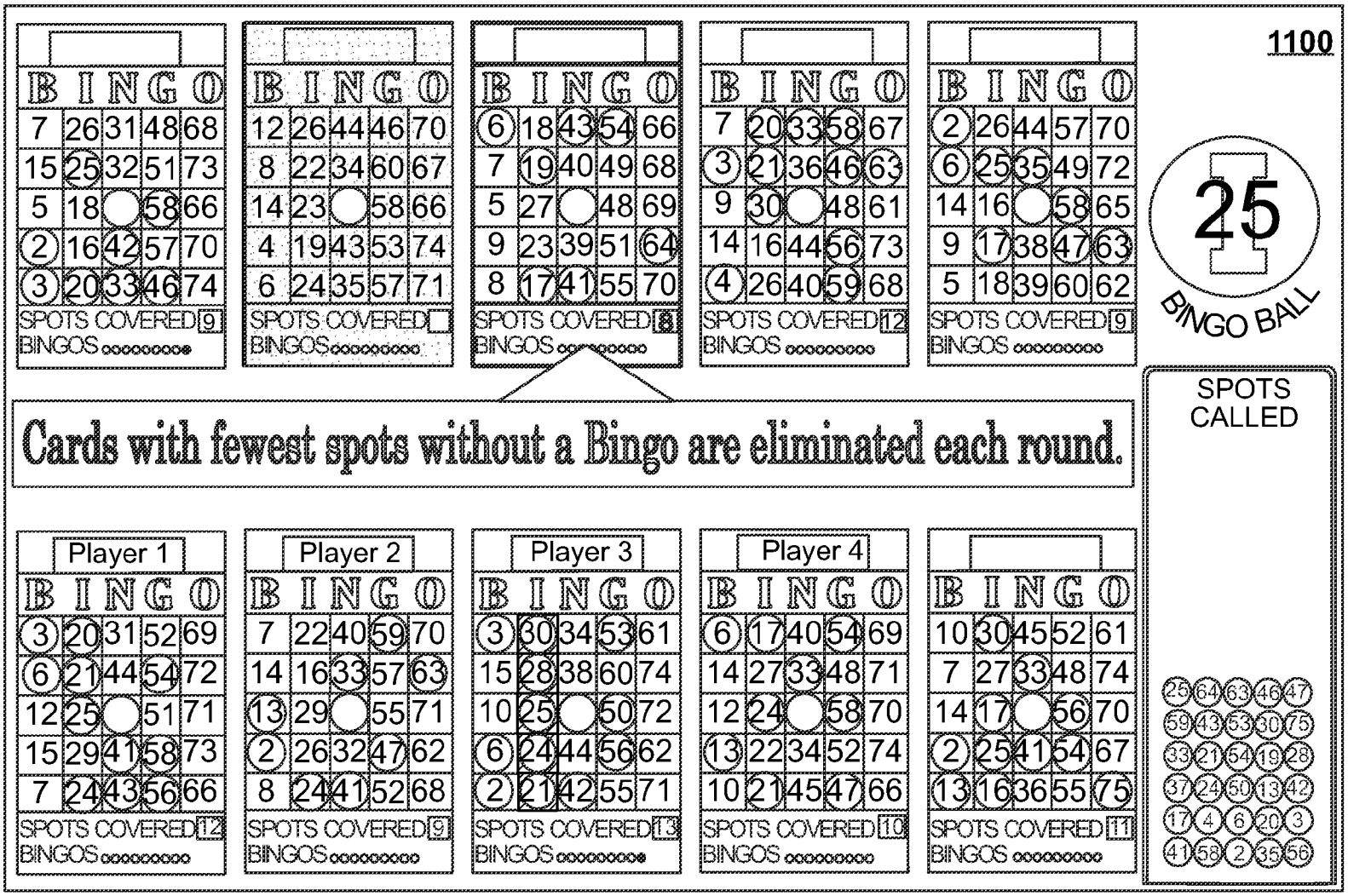

The next round of the tournament commences and ends with the call of I-25, as shown in screenshot 1100 of FIG. 11. Player 3 has a Bingo combination, which is highlighted on the Player 3 card in FIG. 11. The middle card on the top row is eliminated with a total of only eight spots marked.

Figure 12:
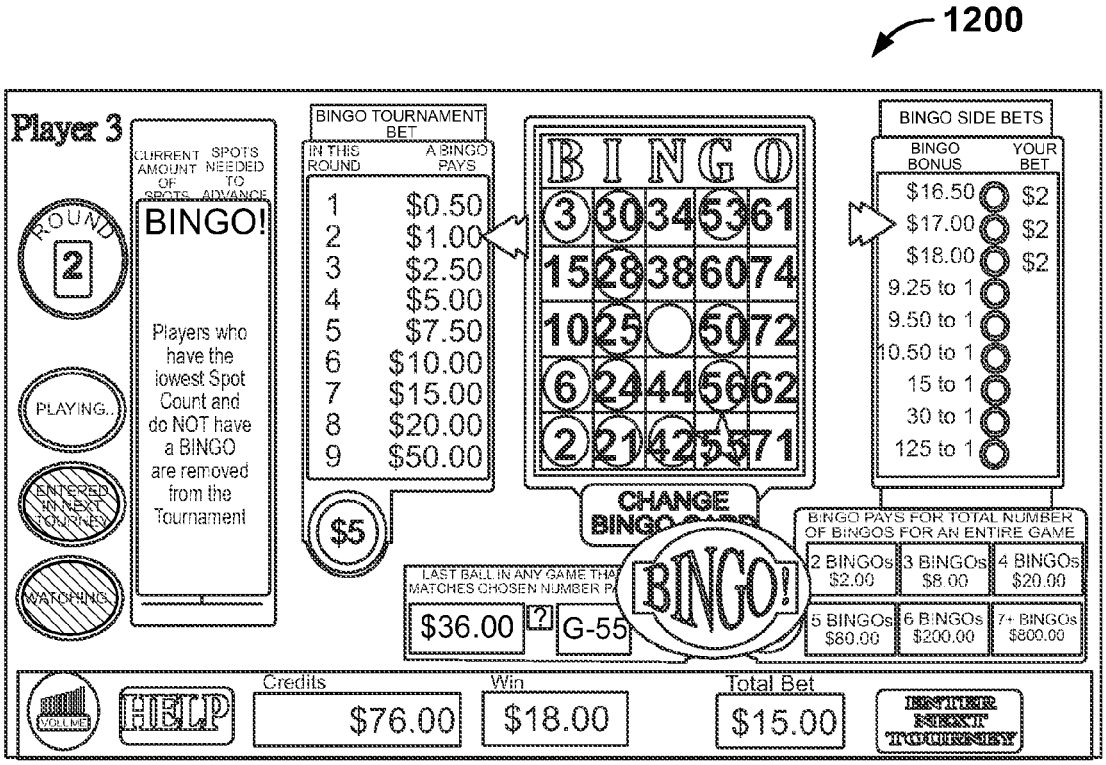

Screenshot 1200 of FIG. 12 shows the Player 3 display at the end of the second round of this tournament. Player 3 wins $1.00 for the Bingo Tournament Bet and $17.00 for the Bingo Bonus bet for a total of $18.00, which is added to Player 3's Credits and Win meters (along the bottom of the display). In FIG. 12, a large "Bingo!" button appears on the display below the Bingo Card. In this embodiment, if the player touches this button, the Large Display speakers will play a recorded shout of "Bingo!" for players of the game to hear.

In this embodiment, there is no reward for pressing the Bingo button, other than the enjoyment of hearing the shout of Bingo come from the game system; however, in another embodiment, there could be an award based on how fast the Bingo button is touched. Furthermore, if more than one player achieved a Bingo combination on the same ball, in another embodiment, the awards for the Bingo could be limited to the first player to touch the Bingo button, or a bonus could be given to the first player to touch the button. In yet another embodiment, other sensory feedback could result from the press of the button such as but not limited to a siren, lighting effects or even confetti blasted out of a confetti canon.

Figure 13:
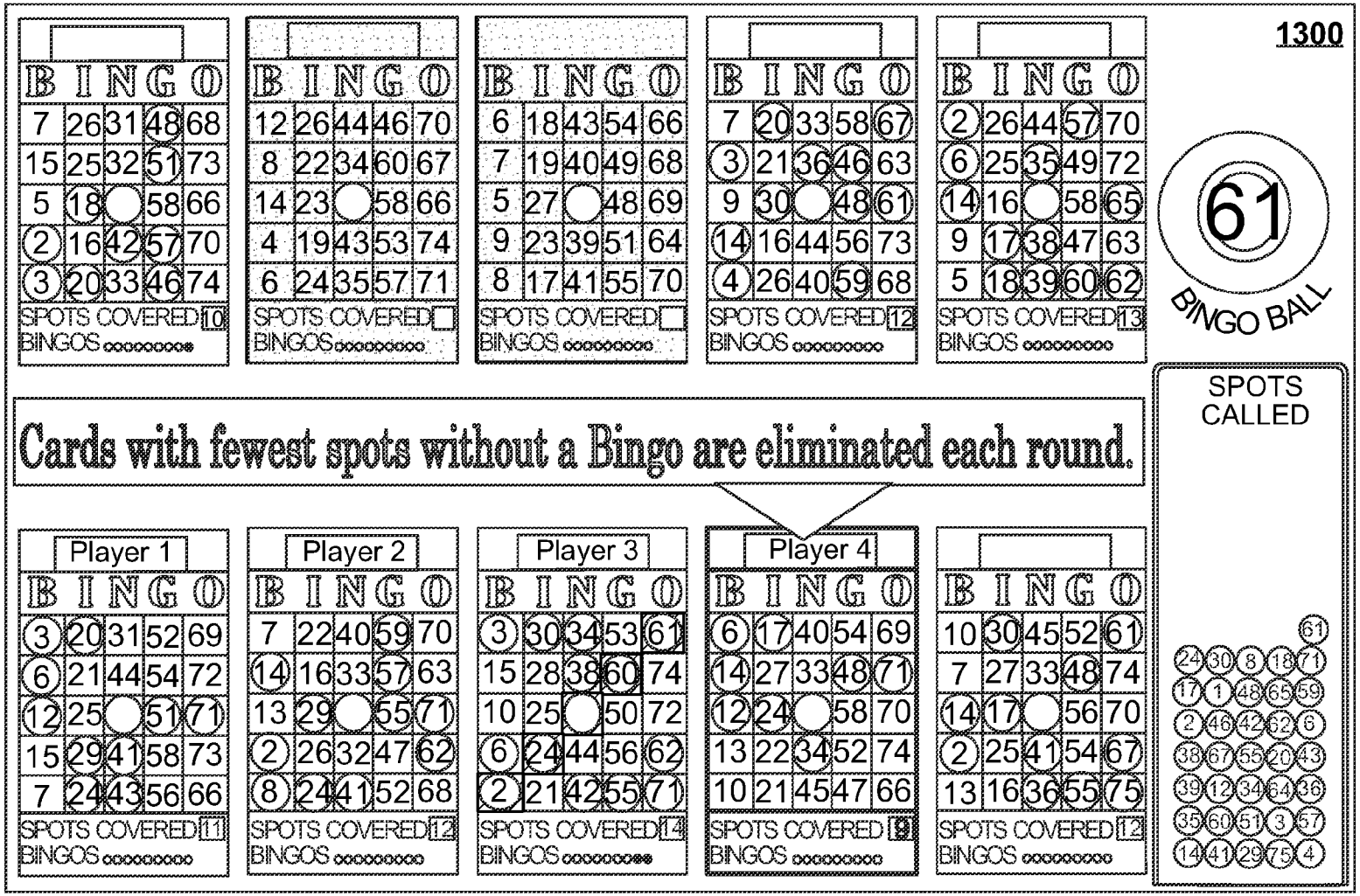

The server advances the game to Round 3 in the same manner, which ends with a call of O-61, resulting in another Player 3 Bingo as shown in screenshot 1300 of FIG. 13. Player 4 is now eliminated after marking only nine spots, which is the then-lowest in the game. The "Bingos" counter under Player 3's card now shows 2 lit dots.

Figure 14:
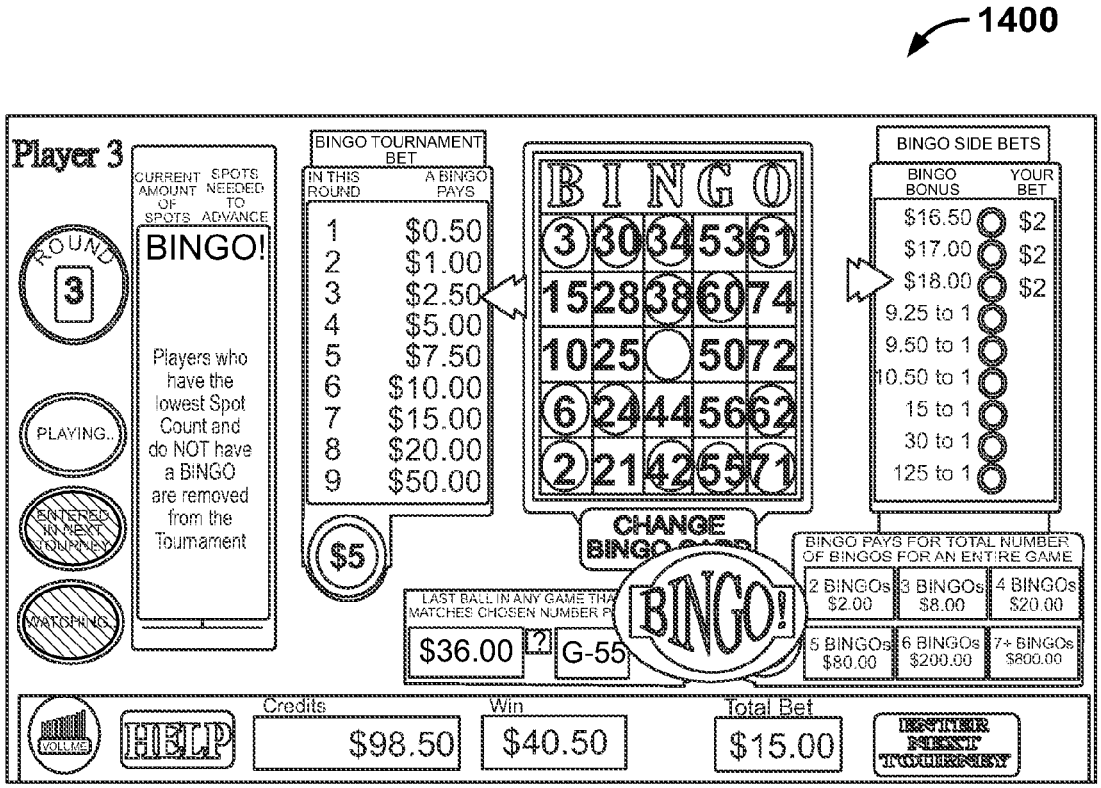

Screenshot 1400 of FIG. 14 shows Player 3's display at the end of Round 3. In this round, Player 3 wins $2.50 for the Tournament Bet, $18.00 for the third-round Bingo Bonus bet, and $2.00 for the Total Number of Bingos bet, for a total round win of $22.50. This is added to Player 3's Credits and Win meters, which now show that Player 3 has won a total of $40.50 in this tournament.

Figure 15:
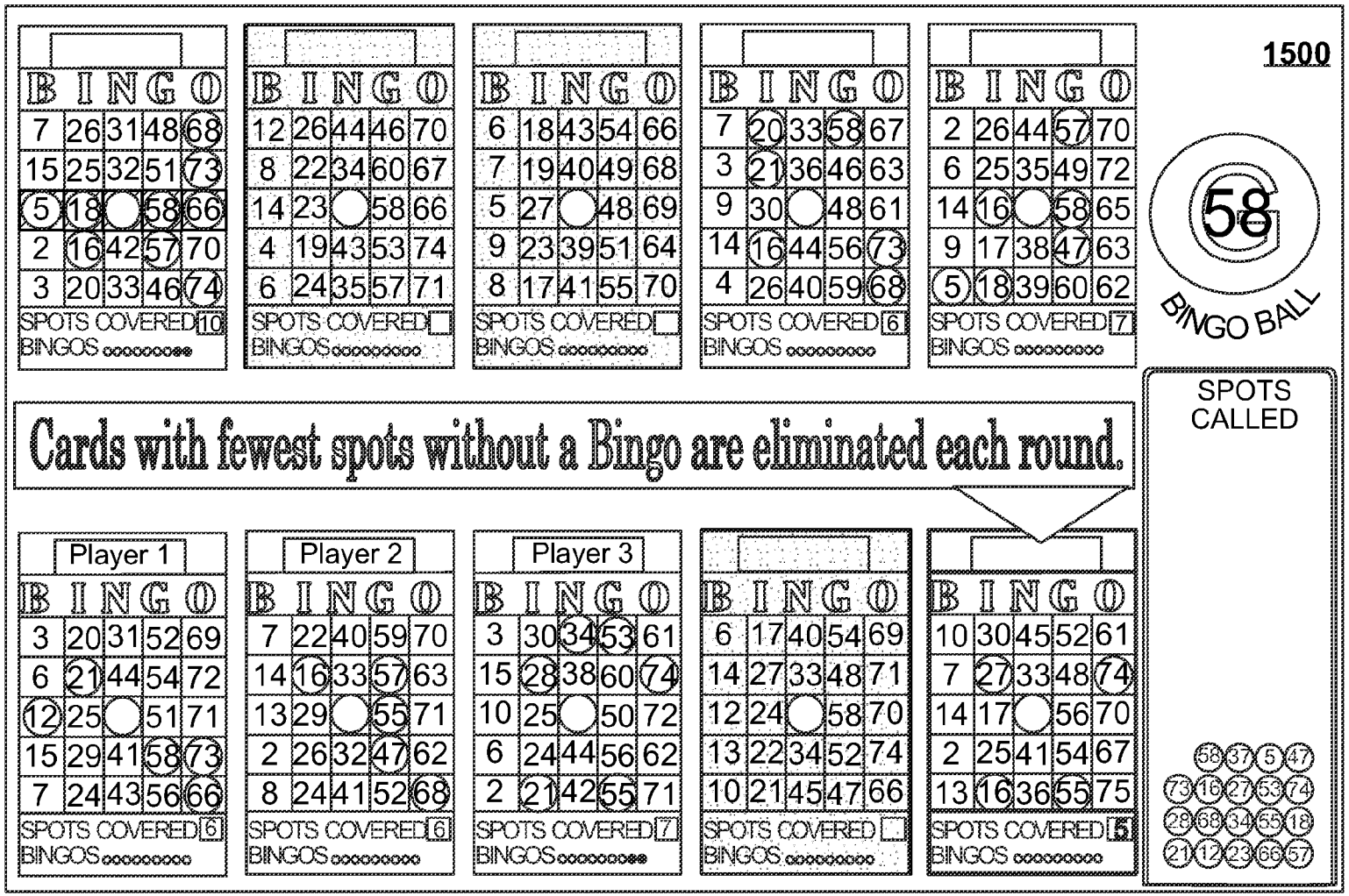

The server advances the game to Round 4 in the same manner, which ends with a call of G-58, resulting in a Bingo for the upper-left contestant, as shown in screenshot 1500 of FIG. 15. The lower-right contestant is now eliminated after marking only five spots, which is then the lowest in the game. The "Bingos" counter under the upper-left contestant card now shows two lit dots.

Figure 16:
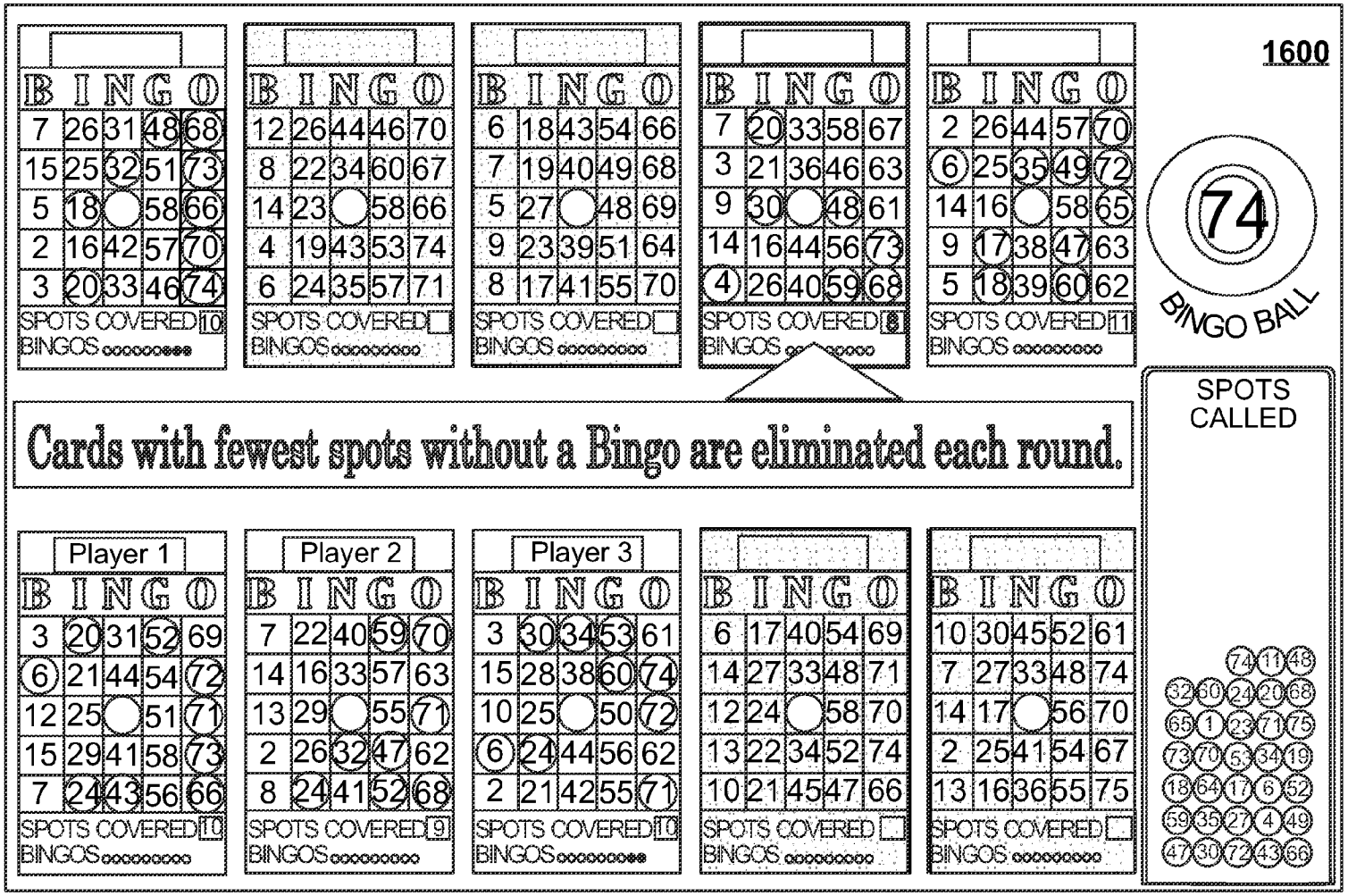

The server advances the game to Round 5 in the same manner, which ends with a call of O-74, resulting in another Bingo for the upper-left contestant, as shown in screenshot 1600 of FIG. 16. The fourth contestant on the top row is now eliminated after marking only eight spots, which is then the lowest in the game. The "Bingos" counter under the upper-left contestant card now shows three lit dots.

Figure 17:
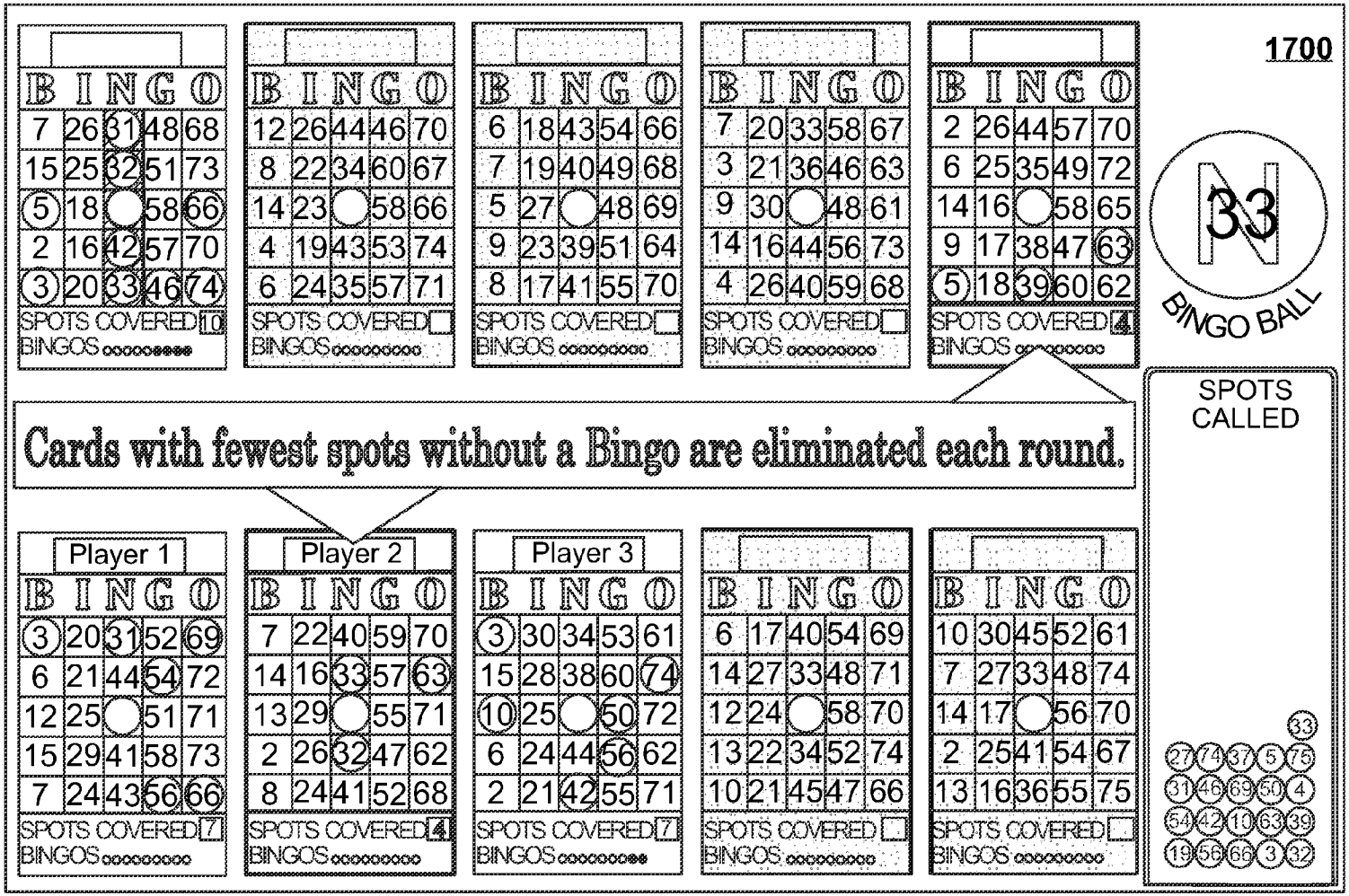

The server advances the game to Round 6 in the same manner, which ends with a call of N-33, resulting in a Bingo for the upper-left contestant, as shown in screenshot 1700 of FIG. 17. The fifth contestant on the top row and Player 2 are now both eliminated after each marking only four spots, which is, at that time, the lowest in the game. The "Bingos" counter under the upper-left contestant card now shows four lit dots. With two contestants eliminated in Round 6 of the tournament, it is now possible to have a maximum of only eight rounds (rather than the theoretical, pre-tournament maximum of nine rounds) before only one contestant will be left.

Figure 18:
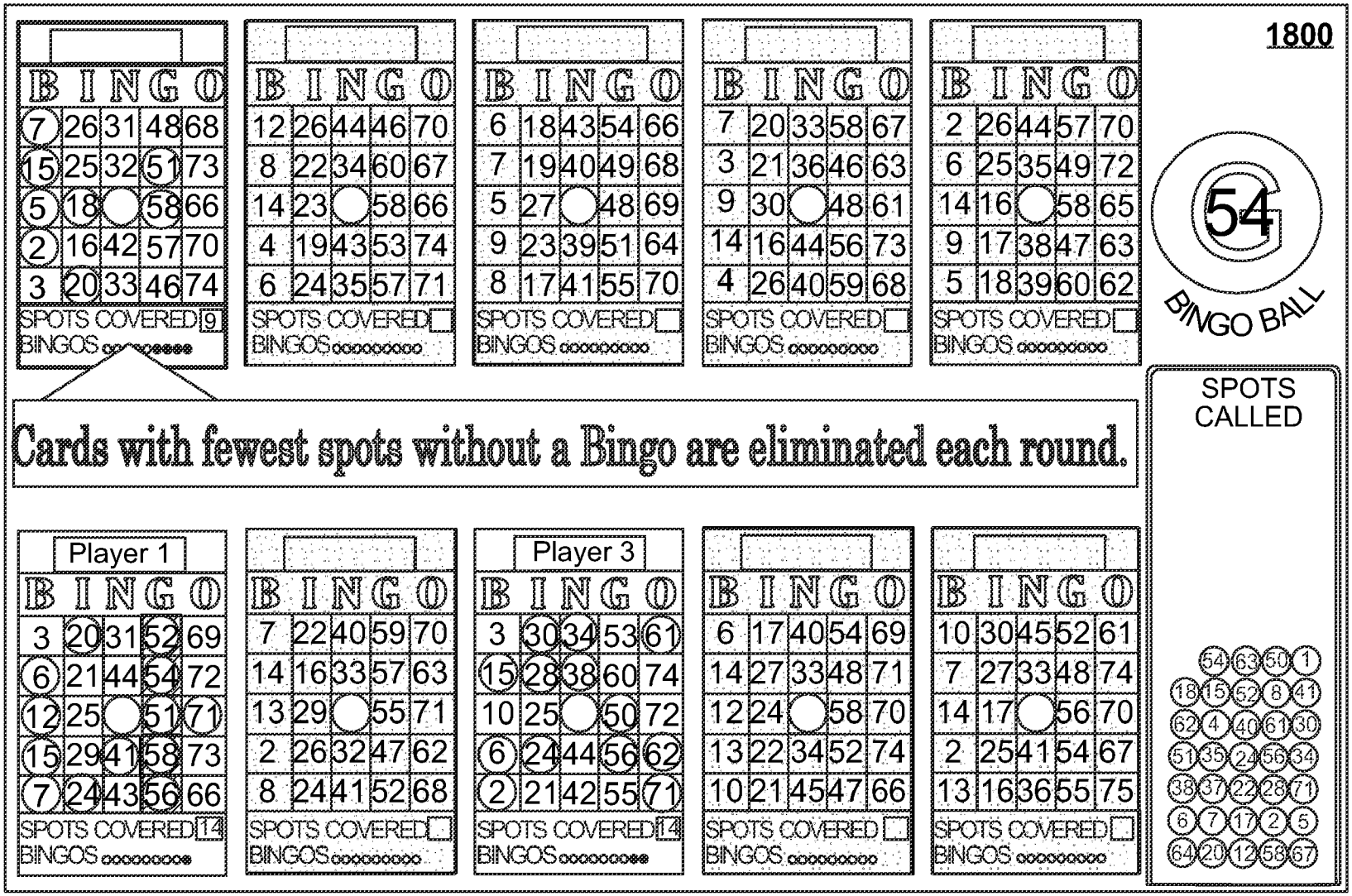

The server advances the game to Round 7 in the same manner, which ends with a call of G-54, resulting in a Bingo for Player 1, as shown in screenshot 1800 of FIG. 18. The first contestant on the top row is now eliminated after marking only nine spots, which is then the lowest in the game. The "Bingos" counter under the Player 1 card now shows one lit dot.

Figure 19:
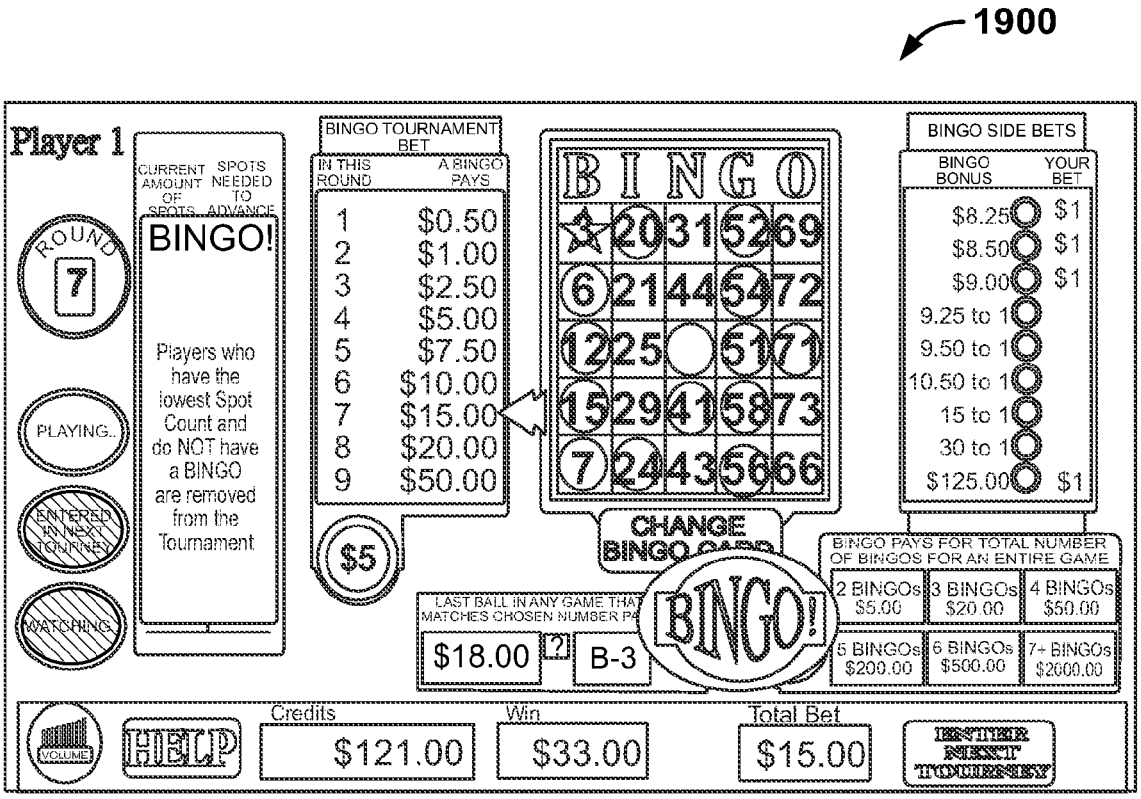

Screenshot 1900 of FIG. 19 shows the Player 1 display at the end of the seventh round of this exemplary tournament. The numbers in the Bingo combination are highlighted on the Bingo card and the Bingo! Button is presented for the player to press. The Bingo Tournament Bet pays $15.00 for this seventh-round Bingo. Player 1 did not make a Bingo Bonus bet on the 7th round, which is unfortunate (for Player 1, though not for the house) because it would have paid 15-for-1. The $15.00 win is added to the Credits and Win meters, showing a win so far of $33.00, which includes the $18.00 won in Round 1 for betting on the last number called and the $15.00 won for a Bingo in the seventh round of the tournament.

The server advances the game to Round 8 in the same manner. This will be the final round since there are only two contestants remaining and at least one will be eliminated at the end of the round. One novel feature of this invention that now becomes clear is that, as you advance through the tournament, it becomes easier and easier to achieve a Bingo. Player 1 did not score any Bingos in the first six rounds of the tournament, but marked enough spots to avoid elimination. In Round 7, where the tournament bet paid $15 for a $5 bet, Player 1 had a little better than a 1-in-3 chance of Bingo, and now in Round 8 has a slightly better than a 1-in-2 chance at a Bingo. Compared with traditional Bingo, where, as the prizes increase, the chance of getting Bingo is lower, this invention presents a situation where, as the prizes get larger, the chance of getting Bingo is higher.

Figure 20:
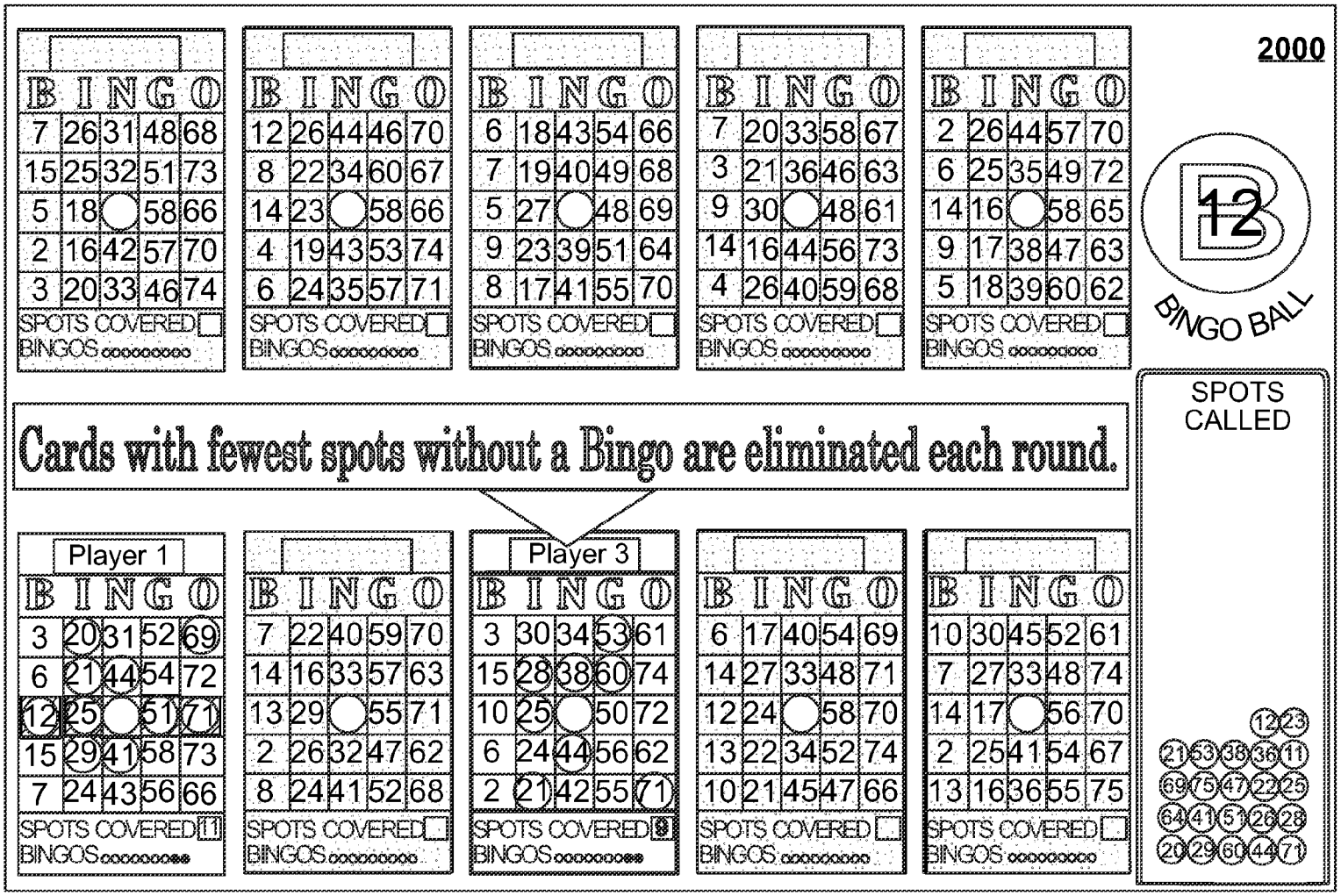

In this example, Round 8 concludes with a call of B-12, resulting in a Bingo for Player 1, as shown in screenshot 2000 of FIG. 20. Player 3 is now eliminated after marking nine spots, which is the lowest in the game. Note that, at the end of each round, the card(s) with the fewest marked spots and no Bingo are eliminated. Thus, in this last example, since there were only two cards and the other card got a Bingo, Player 3 would be eliminated no matter how many spots were marked on Player 3's card, even if that number were higher than the number of spots on the Bingo-achieving Player-1 card. The "Bingos" counter under the Player 1 card now shows 2 lit dots.

Figure 21:
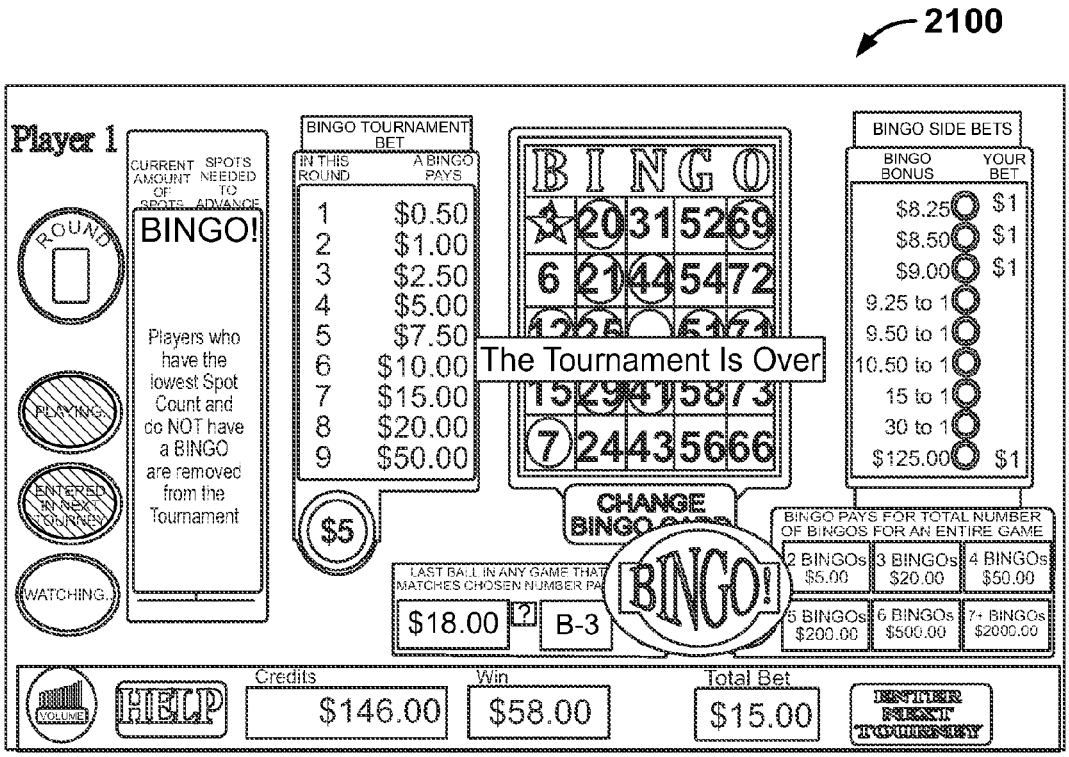

Screenshot 2100 of FIG. 21 shows the Player 1 display at the end of Round 8. The Bingo! Button is on-screen to allow the player to celebrate the latest accomplishment. The Bingo Tournament win of $20.00 for this Round-8 Bingo is highlighted, as well as the Total Number of Bingos payout of $5.00 for this 2nd Bingo in the game. Again, Player 1 did not make a Bingo Bonus bet on round 8, which would have paid a whopping 30-for-1. The total win in round 8 of $25.00 is added to the Credits and Win meters, giving Player 1 a total win in the tournament of $58.00. Player 1 is also the winner of this tournament. Had Player 1 made the side bet to win the tournament (not shown), this player would be paid 9.5-for-1 for this bet, in exemplary embodiments.

Math Analysis and Paytable Construction

In order to construct the paytables for the game of the present invention, a computer program well within the skill of the art was written in the C programming language, which rapidly simulates the operation of this system and tabulates the distribution of various results necessary to determine the frequency of the various winning events. This computer program simulated 100 million tournaments with ten contestant cards, each of which played using randomized Bingo cards. 100 million was a large sample size chosen to demonstrate this process. It is well known in the art how to choose a sample size large enough for the desired confidence factor as well as using tests for convergence as the sample size is increased. Each contestant card is set up with random numbers using the RNG of the computer at the start of each simulated tournament.

For the Bingo Tournament bet and the Bingo Side bets, the data needed are the number of Bingos achieved in each round, as well as (for each round) the number of times multiple simultaneous Bingo combinations were achieved. It is possible to achieve two Bingo combinations simultaneously (such as when the same final number completes a row and a column) as well as three simultaneous Bingo combinations (when the final number completes a Bingo combination in a row, column and diagonal). In this embodiment of the invention, each round of the tournament ends when any card gets a Bingo combination. Each contestant card that has a Bingo combination after the final ball in the round gets credit for the Bingo.

Additionally, with respect to the Bingo Tournament Bet and the Bingo Side Bets, the payout is made multiple times to a player that completes more than one Bingo combination with the selection of the final ball. The decision to make these multiple payouts affects the paytable or payout percentage; note that the paytables could be constructed based on a single payout for multiple bingos without departing from the invention. The game rules could also be configured such that, when multiple contestants get a Bingo on the same final ball, other criteria (such as amount of spots covered) determine a single winner. These types of tradeoffs affect the volatility and excitement of the game, and the game may be configured with many rule variations without departing from the invention.

Table 2 shows the calculation and return of the Bingo Tournament Bet. The number of Bingos for one of the ten contestant cards in the 100-million-tournament simulation was tracked by the round in which it occurred. Columns 2-4 of Table 2 show the number of Single Bingos, Double Bingos and Triple Bingos achieved by a particular card in each round. The "Times Paid" column shows the number of times the "Pay" value would be paid assuming that each Single Bingo is paid once, each Double Bingo is paid twice and each Triple Bingo is paid 3 times. The Pay column shows the amount paid for each Bingo in each round for each unit bet on the Bingo Tournament bet.

The probability column is computed by dividing the Times Paid value by the 100,000,000 tournaments played. This represents the ratio of pays to the total number of tournaments. The expected value (EV) for each Pay is computed by multiplying the pay value times the probability of receiving that Pay value. This is done for each row of Table 2, with the total EV computed as the sum of each value in the EV column, which is 0.958549 in Table 2. This means that, for every $1.00 wagered on the Bingo Tournament Bet, that $0.958549 will be returned in the long run. In other words, this game has a 95.8549% payout percentage.

It is well known in the art to modify the payout percentage by changing the Pay values to increase or decrease the expected return. Given the rules of the game as stated, this would be the way to modify the payout percentage, as the probability values are directly a result of the rules of the game. The rules could be changed to modify the payout percentage, as is well known in the art. For example, if the rules were changed such that Double and Triple Bingos only paid out 1 time the pay value, this would lower the expected return. Conversely, if the tournament was modified to play with nine contestants instead of ten, this would raise the payout percentage. It is well known in the art how to make changes that affect the probabilities and to do this in addition to or instead of modifying the paytable. These modifications are all part of the process of balancing and tuning a game and fall within the scope of the invention.

TABLE 2

| Round | Single Bingos | Double Bingos | Triple Bingos | Times Paid | Pay | Probability | EV |
|---|---|---|---|---|---|---|---|
| 1 | 10,768,627 | 113,263 | 422 | 10,996,419 | 0.1 | 0.10996419 | 0.010996 |
| 2 | 10,698,430 | 131,730 | 590 | 10,963,660 | 0.2 | 0.1096366 | 0.021927 |
| 3 | 10,603,986 | 157,279 | 1,022 | 10,921,610 | 0.5 | 0.1092161 | 0.054608 |
| 4 | 10,446,766 | 193,790 | 1,518 | 10,838,900 | 1 | 0.108389 | 0.108389 |
| 5 | 10,028,924 | 236,927 | 2,557 | 10,510,449 | 1.5 | 0.10510449 | 0.157657 |
| 6 | 8,808,235 | 260,648 | 3,562 | 9,340,217 | 2 | 0.09340217 | 0.186804 |
| 7 | 6,309,413 | 223,329 | 3,534 | 6,766,673 | 3 | 0.06766673 | 0.203 |
| 8 | 3,092,688 | 123,501 | 2,179 | 3,346,227 | 4 | 0.03346227 | 0.133849 |
| 9 | 745,651 | 32,825 | 627 | 813,182 | 10 | 0.00813182 | 0.081318 |
| | | | | | | | 0.958549 |

Table 3 shows a similar calculation for the Bingo Side Bet shown in the example game. The first five columns use the same values showing how many times a player will Bingo in a given round in 100,000,000 plays. The Pay column now lists the Pay values for the Bingo Side bets in each round of the tournament. The probabilities are the same in the next column, and the EV column is the same product of Pay and Probability. Since each bet is made independently and applies to the given row, the EV in each row is the expected return for each $1.00 bet on the round specified in the row. Looking at the Expected Value column, the payout percentage for round 4, 7, 8 and 9 are each over 100%. In the long run, bets made on these rounds with these payouts will be a losing proposition for the operator of the game. As discussed above, there are various ways to modify the payout percentage; two different ways are shown in Tables 4 and 5.

TABLE 3

| Round | Single Bingos | Double Bingos | Triple Bingos | Times Paid | Pay | Probability | EV |
|---|---|---|---|---|---|---|---|
| 1 | 10,768,627 | 113,263 | 422 | 10,996,419 | 8.25 | 0.10996419 | 0.907205 |
| 2 | 10,698,430 | 131,730 | 590 | 10,963,660 | 8.5 | 0.1096366 | 0.931911 |
| 3 | 10,603,986 | 157,279 | 1,022 | 10,921,610 | 9 | 0.1092161 | 0.982945 |
| 4 | 10,446,766 | 193,790 | 1,518 | 10,838,900 | 9.25 | 0.108389 | 1.002598 |
| 5 | 10,028,924 | 236,927 | 2,557 | 10,510,449 | 9.5 | 0.10510449 | 0.998493 |
| 6 | 8,808,235 | 260,648 | 3,562 | 9,340,217 | 10.5 | 0.09340217 | 0.980723 |
| 7 | 6,309,413 | 223,329 | 3,534 | 6,766,673 | 15 | 0.06766673 | 1.015001 |
| 8 | 3,092,688 | 123,501 | 2,179 | 3,346,227 | 30 | 0.03346227 | 1.003868 |
| 9 | 745,651 | 32,825 | 627 | 813,182 | 125 | 0.00813182 | 1.016478 |

Table 4 shows the expected return calculation for the Bingo Side Bets with a change in the rules to only pay the Pay value one time, even when a double or triple Bingo occurs. The fifth column now shows the Total number of Bingos for the round in 100,000,000 plays, which is the sum of the Single, Double, and Triple Bingos for that round. The Probability is the Total Bingos divided by the 100,000,000 simulated tournaments, and the EV, as always, is the Pay value times the Probability. Now, the expected return for each Bingo Side Bet is under 100%, and the best Bingo Side bet for a player (returning the highest percentage) is on the fourth round, returning 98.4392%, while the worst Bingo Side bet is on Round 1, returning 89.7791%.

TABLE 4

| Round | Single Bingos | Double Bingos | Triple Bingos | Total Bingos | Pay | Probability | EV |
|---|---|---|---|---|---|---|---|
| 1 | 10,768,627 | 113,263 | 422 | 10,882,312 | 8.25 | 0.10882312 | 0.897791 |
| 2 | 10,698,430 | 131,730 | 590 | 10,830,750 | 8.5 | 0.1083075 | 0.920614 |
| 3 | 10,603,986 | 157,279 | 1,022 | 10,762,287 | 9 | 0.10762287 | 0.968606 |
| 4 | 10,446,766 | 193,790 | 1,518 | 10,642,074 | 9.25 | 0.10642074 | 0.984392 |
| 5 | 10,028,924 | 236,927 | 2,557 | 10,268,408 | 9.5 | 0.10268408 | 0.975499 |
| 6 | 8,808,235 | 260,648 | 3,562 | 9,072,445 | 10.5 | 0.09072445 | 0.952607 |
| 7 | 6,309,413 | 223,329 | 3,534 | 6,536,276 | 15 | 0.06536276 | 0.980441 |
| 8 | 3,092,688 | 123,501 | 2,179 | 3,218,368 | 30 | 0.03218368 | 0.96551 |
| 9 | 745,651 | 32,825 | 627 | 779,103 | 125 | 0.00779103 | 0.973879 |

A different way to correct the problem (in Table 3), where certain rounds have too high of a payoff, would be to retain the double and triple rule, but to change the paytable values to those shown in Table 5. The Table 5 returns are calculated in the same manner as with Table 3; however, by changing the Pay values, the EV values now are all under 100%, and the multiple bingo pay feature has been retained.

TABLE 5

| Round | Single Bingos | Double Bingos | Triple Bingos | Times Paid | Pay | Probability | EV |
|---|---|---|---|---|---|---|---|
| 1 | 10,768,627 | 113,263 | 422 | 10,996,419 | 8.25 | 0.10996419 | 0.907205 |
| 2 | 10,698,430 | 131,730 | 590 | 10,963,660 | 8.5 | 0.1096366 | 0.931911 |
| 3 | 10,603,986 | 157,279 | 1,022 | 10,921,610 | 8.75 | 0.1092161 | 0.955641 |
| 4 | 10,446,766 | 193,790 | 1,518 | 10,838,900 | 9 | 0.108389 | 0.975501 |
| 5 | 10,028,924 | 236,927 | 2,557 | 10,510,449 | 9.25 | 0.10510449 | 0.972217 |
| 6 | 8,808,235 | 260,648 | 3,562 | 9,340,217 | 10 | 0.09340217 | 0.934022 |
| 7 | 6,309,413 | 223,329 | 3,534 | 6,766,673 | 14 | 0.06766673 | 0.947334 |
| 8 | 3,092,688 | 123,501 | 2,179 | 3,346,227 | 28 | 0.03346227 | 0.936944 |
| 9 | 745,651 | 32,825 | 627 | 813,182 | 115 | 0.00813182 | 0.935159 |

For the Number of Bingos side bet, for each contestant card, the present simulation tracked the number of rounds that the card had a Bingo in each tournament, and kept a count for each card of the number of times zero Bingos, one Bingo, two Bingos, etc. occurred in the 100,000,000 tournament sample. For the purpose of this wager, the possibility of two or three simultaneous Bingos in a round count as a single round containing a Bingo. The calculation could be done counting double and triple Bingos multiple times without departing from the invention. Table 6 shows the results for the ten cards on a 100,000,000-tournament sample. It should be noted that the sum of the results for each contestant card is equal to the 100,000,000-tournament sample size as expected. Also as expected, for a given round, the results for each contestant card are of similar size. This is as expected because each card plays using the same rules, and thus no card has any inherent advantage over the other cards. And measured over a sample size this large, the results are predictably similar for each card.

TABLE 6

| Number of Rounds with a Bingo | Contestant 1 | Contestant 2 | Contestant 3 | Contestant 4 | Contestant 5 | Contestant 6 |
|---|---|---|---|---|---|---|
| 0 | 56366570 | 56360621 | 56369760 | 56348183 | 56369136 | 56357071 |
| 1 | 24367355 | 24371236 | 24370362 | 24387692 | 24377754 | 24381569 |
| 2 | 11820584 | 11818622 | 11819076 | 11819296 | 11814883 | 11817960 |
| 3 | 5287866 | 5289894 | 5284627 | 5286403 | 5281367 | 5283843 |
| 4 | 1728445 | 1729296 | 1726420 | 1728938 | 1727260 | 1730298 |
| 5 | 373664 | 374420 | 374030 | 374107 | 374096 | 373806 |
| 6 | 50993 | 51428 | 51276 | 50854 | 50987 | 50894 |
| 7 | 4345 | 4279 | 4247 | 4342 | 4305 | 4347 |
| 8 | 173 | 200 | 196 | 185 | 208 | 206 |
| 9 | 5 | 4 | 6 | 0 | 4 | 6 |
| | 100000000 | 100000000 | 100000000 | 100000000 | 100000000 | 100000000 |

| Number of Rounds with a Bingo | Contestant 7 | Contestant 8 | Contestant 9 | Contestant 10 |
|---|---|---|---|---|
| 0 | 56363505 | 56369546 | 56363151 | 56368912 |
| 1 | 24374536 | 24370659 | 24374317 | 24371525 |
| 2 | 11820122 | 11819415 | 11818614 | 11816682 |
| 3 | 5284961 | 5283993 | 5286516 | 5284839 |
| 4 | 1728309 | 1727590 | 1727212 | 1728572 |

TABLE 6-continued

| | | | | |
|---|---|---|---|---|
| 5 | 372856 | 373774 | 374349 | 373570 |
| 6 | 51156 | 50522 | 51437 | 51348 |
| 7 | 4370 | 4265 | 4178 | 4365 |
| 8 | 182 | 232 | 222 | 184 |
| 9 | 3 | 4 | 4 | 3 |
| | 100000000 | 100000000 | 100000000 | 100000000 |

One way of determining the expected return of the Number of Bingos bet is shown in Table 7 below. Each row of Table 7 represents a particular number of Rounds with a Bingo, as shown in the first column. The second column, labeled "All Cards," shows the sum of the ten contestant cards of Table 6, to make use of the one billion tournament results created by tracking one hundred million tournaments on ten cards. The third column shows the result of calculating the probability of each number of Bingos, by dividing the second column "All Cards" value by the one billion tournaments played. As expected, the sum of this column is 1.

The fourth column shows the paytable value for each number of Bingos starting at two, which is the first payout point in this embodiment. Note that, in this column, 400 units are paid out for 7, 8, and 9 Bingos; that is, the seventh and each successive Bingo pays this amount. The paytable could have been designed such that the player received a single pay for seven or more Bingos and did not get an additional payout for the eighth and ninth Bingo in a game. Note that the eight-Bingo Games and nine-Bingo games are so rare that the additional 400 or 800 units has almost no effect on the overall payout percentage.

The next column in Table 7 is the Cumulative Pay column. The numbers in this column form the sum of all numbers in the previous column up to and including the current row. This is the total won from this wager when the specified number of Bingos occurs (e.g. in a game that has four Bingos, the player is paid 1+4+10=15 for the second, third, and fourth Bingo, respectively. This is why, on the four-Bingo row, the Cumulative Pay column shows 15.

The EV in the final column is the product of the third-column probabilities and the fifth-column Cumulative Pay values; furthermore, the sum of EV components results in an expected return of $0.952348 for every $1.00 wagered—or a 95.2348% payout percentage. As with the previous bets, the payout percentage may be modified by changing the paytable values or rules of the game in ways that are well known in the art.

Table 7A shows a payout analysis for the Number of Bingos bet with the implementation of the "Envy Bonus" described above. In this embodiment, when any player card gets five or more Bingos in a single tournament, any player that has wagered at least $5.00 on the Number of Bingos bet will get paid. The pay is a fixed amount for a wager of $5, and is not scaled by the bet, although it could be scaled by the bet without departing from the invention. Table 7A shows the return for a $5 wager, which provides the highest return on this bet.

There are many different ways to implement this type of bet, all of which fall in the scope of this invention. For example, the bet could pay for every contestant card, whether or not it was for a human player (who could win the money and thus induce envy). The bet could also only pay until the player making the wager is eliminated. However, in this embodiment, the bet is only paid if a human player gets five or more Bingos, but it will pay after the wagering player is eliminated from the tournament.

Referring to Table 7A, the first three columns are identical to Table 7, showing the probability of each possible number of Bingos in a game. The fourth column "This Pay" is scaled by the $5 bet. The fifth column shows the "Envy" Pay. This is the amount paid to any player—who bets $5 or more on the Number of Bingos bet—when another human player gets five or more Bingos in a tournament. When a human player gets their fifth Bingo in a given tournament, all players that wagered $5 or more on the Number of Bingos bet get paid $5. If that player gets a sixth Bingo, then all of the players that wagered $5 on the Number of Bingos bet receive an additional $20, for a total win in this category of $25. This continues up to an additional $500 for the lucky player's ninth Bingo, and a total possible Envy Bonus of $875.

The next column shows the maximum possible human players in the tournament. In this embodiment, up to five of the ten contestant cards can be human. The Total Max Pay column is the sum of the "This Pay" column and four times the Envy Pay column. The factor of four is used because, from

TABLE 7

| Number of Rounds with a Bingo | All Cards | Probability | This Pay | Cumulative Pay | EV |
|---|---|---|---|---|---|
| 0 | 563,636,455 | 0.5636365 | | | |
| 1 | 243,747,005 | 0.243747 | | | |
| 2 | 118,185,254 | 0.1181853 | 1 | 1 | 0.118185 |
| 3 | 52,854,309 | 0.0528543 | 4 | 5 | 0.264272 |
| 4 | 17,282,340 | 0.0172823 | 10 | 15 | 0.259235 |
| 5 | 3,738,672 | 0.0037387 | 40 | 55 | 0.205627 |
| 6 | 510,895 | 0.0005109 | 100 | 155 | 0.079189 |
| 7 | 43,043 | 4.304E−05 | 400 | 555 | 0.023889 |
| 8 | 1,988 | 1.988E−06 | 400 | 955 | 0.001899 |
| 9 | 39 | 3.9E−08 | 400 | 1355 | 5.28E−05 |
| | 1,000,000,000 | 1 | | | 0.952348 |

the game operator's point of view, when any player gets five or more Bingos, the Envy payout could be required up to four times (to the other four players). From a player's point of view, the factor of four represents the four chances that they have for human players to get five or more Bingos. The Cumulative Pay column adds up the total paid in each round, and the EV column is again the Probability times the Cumulative Pay column, this time divided by the $5 bet size. The sum of all of the EV components shows that this bet now returns 98.2448%. This is slightly more than 3% greater than the Number of Bingos bet without this envy feature; that is, in this embodiment, this feature adds a little over 3% to the expected return of the bet.

TABLE 7A

| Number of Bingos | All Cards | Probability | This Pay | Envy Pay | Max Players | Total Max Pay | Cumulative Pay | EV |
|---|---|---|---|---|---|---|---|---|
| 0 | 563,636,455 | 0.56363646 | | | | | | |
| 1 | 243,747,005 | 0.24374701 | | | | | | |
| 2 | 118,185,254 | 0.11818525 | 5 | | | 5 | 5 | 0.118185 |
| 3 | 52,854,309 | 0.05285431 | 20 | | | 20 | 25 | 0.264272 |
| 4 | 17,282,340 | 0.01728234 | 50 | | | 50 | 75 | 0.259235 |
| 5 | 3,738,672 | 0.00373867 | 200 | 5 | 5 | 220 | 295 | 0.220582 |
| 6 | 510,895 | 0.0005109 | 500 | 20 | 5 | 580 | 875 | 0.089407 |
| 7 | 43,043 | 4.3043E−05 | 2000 | 100 | 5 | 2400 | 3275 | 0.028193 |
| 8 | 1,988 | 1.988E−06 | 2000 | 250 | 5 | 3000 | 6275 | 0.002495 |
| 9 | 39 | 3.9E−08 | 2000 | 500 | 5 | 4000 | 10275 | 8.01E−05 |
| | 1,000,000,000 | 1 | | | | | | 0.982448 |

For the Final Ball bet, this simulation kept track of the final ball drawn for each game, and kept a counter for each of the 75 possible final balls. Table 8 shows the number of times each particular Bingo Ball was the final number of a Bingo game:

TABLE 8

| B (1-15) | I (16-30) | N (31-45) | G (46-60) | O (61-75) | |
|---|---|---|---|---|---|
| 9,913,444 | 9,917,065 | 9,022,955 | 9,911,970 | 9,915,158 | |
| 9,916,069 | 9,906,402 | 9,015,702 | 9,906,064 | 9,911,403 | |
| 9,914,357 | 9,908,098 | 9,017,351 | 9,909,897 | 9,911,755 | |
| 9,911,100 | 9,908,300 | 9,019,392 | 9,906,465 | 9,908,211 | |
| 9,912,660 | 9,910,033 | 9,014,660 | 9,905,112 | 9,908,399 | |
| 9,909,205 | 9,906,537 | 9,017,880 | 9,906,970 | 9,913,461 | |
| 9,909,586 | 9,905,166 | 9,018,322 | 9,912,099 | 9,910,322 | |
| 9,910,732 | 9,914,122 | 9,018,770 | 9,907,713 | 9,910,430 | |
| 9,910,354 | 9,908,995 | 9,024,011 | 9,907,050 | 9,910,762 | |
| 9,912,875 | 9,910,922 | 9,016,985 | 9,909,193 | 9,907,390 | |
| 9,912,346 | 9,909,225 | 9,013,627 | 9,913,436 | 9,913,060 | |
| 9,907,342 | 9,910,195 | 9,021,083 | 9,916,041 | 9,907,675 | |
| 9,912,034 | 9,913,410 | 9,019,703 | 9,904,800 | 9,910,483 | |
| 9,907,337 | 9,911,711 | 9,015,302 | 9,911,484 | 9,909,819 | |
| 9,913,925 | 9,905,166 | 9,015,518 | 9,910,693 | 9,908,797 | |
| 148,673,366 | 148,645,347 | 135,271,261 | 148,638,987 | 148,657,125 | 729,886,086 |

It is clear that, in a particular column, each ball is as likely as any other ball in that column to be the last number called, and, as expected, the numbers in each column are of similar value. It is noticeable that the numbers in the N column (Bingo Balls 31-45) are less likely to be the final ball called; this is a result of the Free Space that is marked in the N column.

Table 9 shows the computation of the Expected Return of the Final Ball Bet based on which ball the bet is placed on. The second column shows how many Times the Final Ball was drawn from the particular column, and is taken from the bottom row of Table 8. It is interesting to note that, for our 100,000,000 tournaments, there were 729,886,086 games played. This means that, if every tournament is played to completion, there is an average of 7.3 games played per tournament, when ten contestant cards are used.

The third column shows the probability that a ball in the particular column is the final ball with B, I, G and O columns representing a little over 20% each, and the N column representing about 18.5%. The fourth column shows the probability of drawing any individual ball in the particular column, and is the third column value divided by 15 (which is the number of balls in each letter category B, I, N, G, and O). The fifth column is a fixed number of games that represents the average number of games in a tournament before a player is eliminated. This number comes from Table 12, which will be described below.

In this embodiment, the Last Ball Bet is only in play for a given player until that player is eliminated from the tournament. On average, each player plays 4.1 games per tournament, and this number scales the probability, since the bet will used in the example is $18.00 per $1.00 bet. The EV is computed as the product of the Probability of the ball times the Number of games per Tournament times the Pay value. Looking at Table 9, the EV for balls in the B, I, G, and O columns suggests a return of over 100%, so the example game would not be a good one for a casino operator. Note that the game could be constructed where the Last Ball Bet played even after the player was eliminated from the tournament. In this case, the fifth column value would be 7.29886086, which is the average number of games per tournament that was described above. The Pay value would then be adjusted down accordingly to arrive at a desired payout percentage.

TABLE 9

| Column | Times Final Ball | Probability of Column | Probability of any ball | Number of Games per Tournament | Pay | EV |
|---|---|---|---|---|---|---|
| B (1-15) | 148673366 | 0.203693931 | 0.013579595 | 4.098994209 | 18 | 1.001928 |
| I (16-30) | 148645347 | 0.203655543 | 0.013577036 | 4.098994209 | 18 | 1.001739 |
| N (31-45) | 135271261 | 0.185332018 | 0.012355468 | 4.098994209 | 18 | 0.91161 |
| G (46-60) | 148638987 | 0.203646829 | 0.013576455 | 4.098994209 | 18 | 1.001697 |
| O (61-75) | 148657125 | 0.20367168 | 0.013578112 | 4.098994209 | 18 | 1.001819 |
| | 729886086 | 1 | | | | |

Table 10 shows a more suitable return that results when the pay is reduced to $17.

TABLE 10

| Column | Times Final Ball | Probability of Column | Probability of any ball | Number of Games per Tournament | Pay | EV |
|---|---|---|---|---|---|---|
| B (1-15) | 148673366 | 0.203693931 | 0.013579595 | 4.098994209 | 17 | 0.946266 |
| I (16-30) | 148645347 | 0.203655543 | 0.013577036 | 4.098994209 | 17 | 0.946087 |
| N (31-45) | 135271261 | 0.185332018 | 0.012355468 | 4.098994209 | 17 | 0.860965 |
| G (46-60) | 148638987 | 0.203646829 | 0.013576455 | 4.098994209 | 17 | 0.946047 |
| O (61-75) | 148657125 | 0.20367168 | 0.013578112 | 4.098994209 | 17 | 0.946162 |
| | 729886086 | 1 | | | | |

In the Table 10 game, there is a skill factor in the Final Ball bet in that players that understand or figure out that betting on a number in columns B, I, G, or O is advantageous over betting on a number in column N. In one embodiment, the game is operated with this skill factor, and, just as the Bingo Side Bet has a different expected return based on which level is bet, the Last Ball Bet could have this type of feature. Alternatively, the payout could be increased when N is successfully wagered on as the final ball, as shown in Table 11. In this case, the payout for successfully wagering on a ball in the N column is $18.50-for-$1.00, rather than $17.00-for-$1.00. This appears to be a more attractive wager while, at the same time, being slightly more profitable to the game operator.

TABLE 11

| Column | Times Final Ball | Probability of Column | Probability of any ball | Number of Games per Tournament | Pay | EV |
|---|---|---|---|---|---|---|
| B (1-15) | 148673366 | 0.203693931 | 0.013579595 | 4.098994209 | 17 | 0.946266 |
| I (16-30) | 148645347 | 0.203655543 | 0.013577036 | 4.098994209 | 17 | 0.946087 |
| N (31-45) | 135271261 | 0.185332018 | 0.012355468 | 4.098994209 | 18.5 | 0.936932 |
| G (46-60) | 148638987 | 0.203646829 | 0.013576455 | 4.098994209 | 17 | 0.946047 |
| O (61-75) | 148657125 | 0.20367168 | 0.013578112 | 4.098994209 | 17 | 0.946162 |
| | 729886086 | 1 | | | | |

Table 12 shows the data used to determine the average number of games played before elimination from a tournament. For each contestant card, a count is made for each game played before elimination. The second column of Table 12 shows the number of games played by each contestant before elimination in the 100,000,000 sample tournaments. The third column shows the average number of games before elimination for each contestant card, with the bottom bold number representing the average of these averages. This is the number used in Tables 9-11 for the Number of Games per Tournament.

TABLE 12

| Contestant | Total Games Before Elimination | Games per Tournament |
|---|---|---|
| 1 | 409,900,355 | 4.09900355 |
| 2 | 409,945,022 | 4.09945022 |
| 3 | 409,893,031 | 4.09893031 |
| 4 | 409,926,185 | 4.09926185 |
| 5 | 409,874,092 | 4.09874092 |
| 6 | 409,934,695 | 4.09934695 |
| 7 | 409,892,120 | 4.0989212 |
| 8 | 409,874,931 | 4.09874931 |

TABLE 12-continued

| Contestant | Total Games Before Elimination | Games per Tournament |
|---|---|---|
| 9 | 409,871,775 | 4.09871775 |
| 10 | 409,882,003 | 4.09882003 |
| | 4,098,994,209 | 4.098994209 |

The final side bet that is part of this embodiment is the bet on winning the tournament. Table 13 shows the number of times each of the ten contestant cards won the tournament. The Probability column shows the probability of each card winning the tournament, which is a little under 10% because each of the ten cards has the same chance to win—however, some of the tournaments end with no winner. In another embodiment, when all remaining cards have Bingo with the same number of spots covered, they all win the tournament, in which case the probability of winning the tournament will be slightly over the 10% mark. The bottom number in the Probability column is the average of the numbers in that column, and represents the probability of any particular contestant winning the tournament. The Pay column shows the $9.50 pay for every $1.00 bet. By multiplying the probability with the Pay value we get a return of 0.945026969.

TABLE 13

| Contestant | Tournament Wins | Probability | Pay | EV |
|---|---|---|---|---|
| 1 | 9,951,072 | 0.09951072 | | |
| 2 | 9,950,852 | 0.09950852 | | |
| 3 | 9,943,581 | 0.09943581 | | |
| 4 | 9,951,653 | 0.09951653 | | |
| 5 | 9,945,931 | 0.09945931 | | |
| 6 | 9,952,616 | 0.09952616 | | |
| 7 | 9,942,233 | 0.09942233 | | |
| 8 | 9,941,580 | 0.0994158 | | |
| 9 | 9,948,902 | 0.09948902 | | |
| 10 | 9,948,103 | 0.09948103 | | |
| | 99,476,523 | 0.09947652 | 9.5 | 0.945026969 |

Taking into account that some tournaments will have no winner, another possible side bet could be that there will be no one winner of the tournament (because every remaining player got a Bingo with the same number of covered spots). Table 14 shows that this occurred 523,477 times in the 100,000,000 tournaments. This has a probability that is the ratio of those two numbers. If this wager paid $180 for every $1.00 bet, then it would have an expected return of 0.9422586.

TABLE 14

| Tournaments with no winner | Probability | Pay | EV |
|---|---|---|---|
| 523,477 | 0.005235 | 180 | 0.9422586 |

Operation of One Embodiment of the Game

In an embodiment of this invention that allows multiple players to participate in the same Bingo tournament, there may be separate computer programs running in a game server (server program) and in each individual gaming machine (client programs). There are many ways to configure client and server hardware, and many programming languages and protocols that could be used to make this system operate. The flowcharts of FIGS. 22-46 show one possible implementation of this game. Those of skill in the art are able to configure such a network and develop the computer programs in many different ways without departing from the invention.

Figure 22:
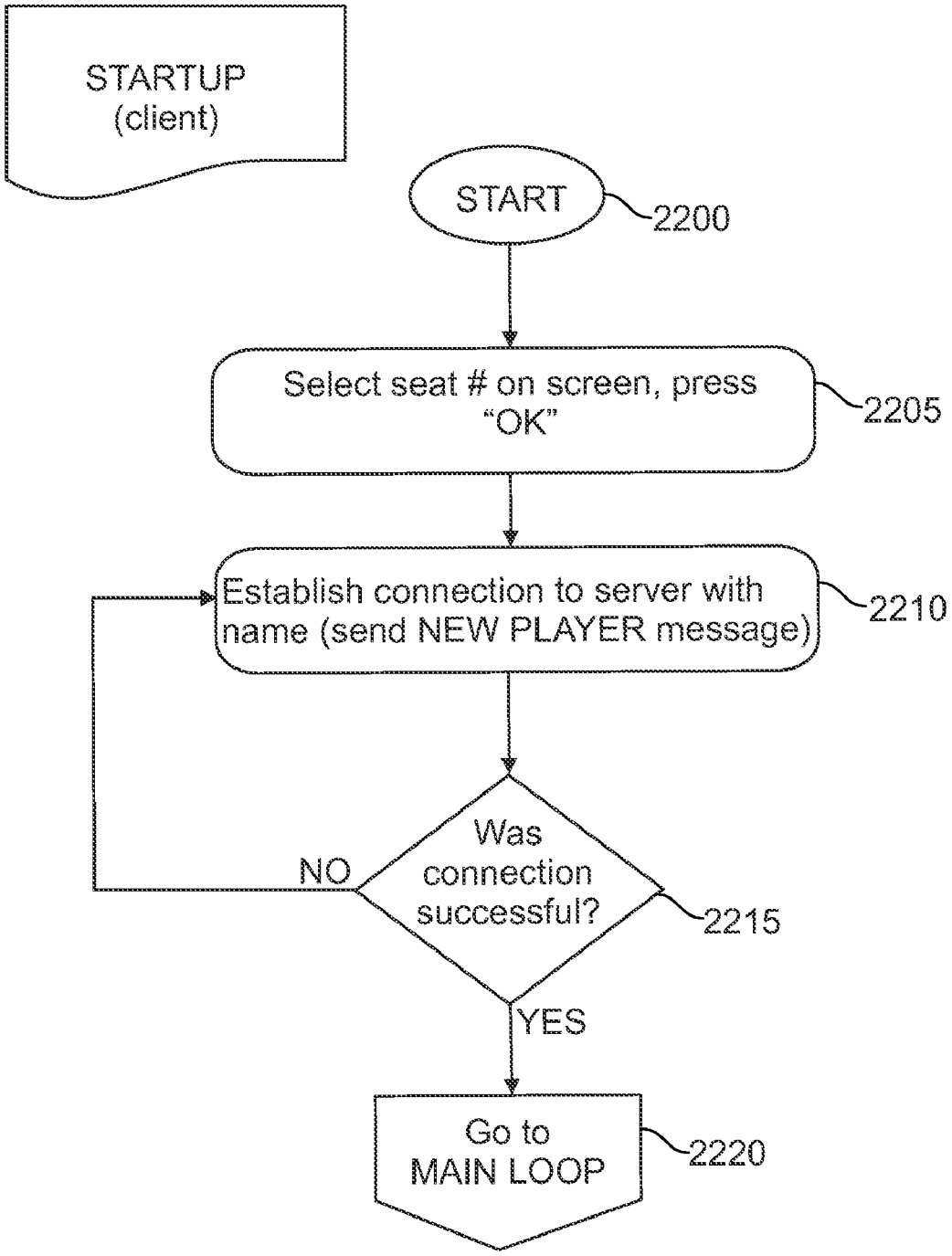
FIGS. 22 through 46 depict various flowcharts, in accordance with exemplary embodiments.

FIG. 22 shows the Startup condition of the client program on a gaming machine on the network of FIG. 1. In this embodiment, each gaming machine in FIG. 1 is running the same client program.

At 2205 the gaming machine displays a selection screen on its display which allows the player to select an open bingo position on the Large Display. After the player selects an open position and touches an "OK" button, the client program advances to 2210, where it sends a "NEW PLAYER" message to the server. The client program checks whether the connection was successful at 2215, looping back to 2210 until a successful connection is achieved. The client program then proceeds to the MAIN LOOP (at 2220), which is shown in FIG. 23.

Figure 23:
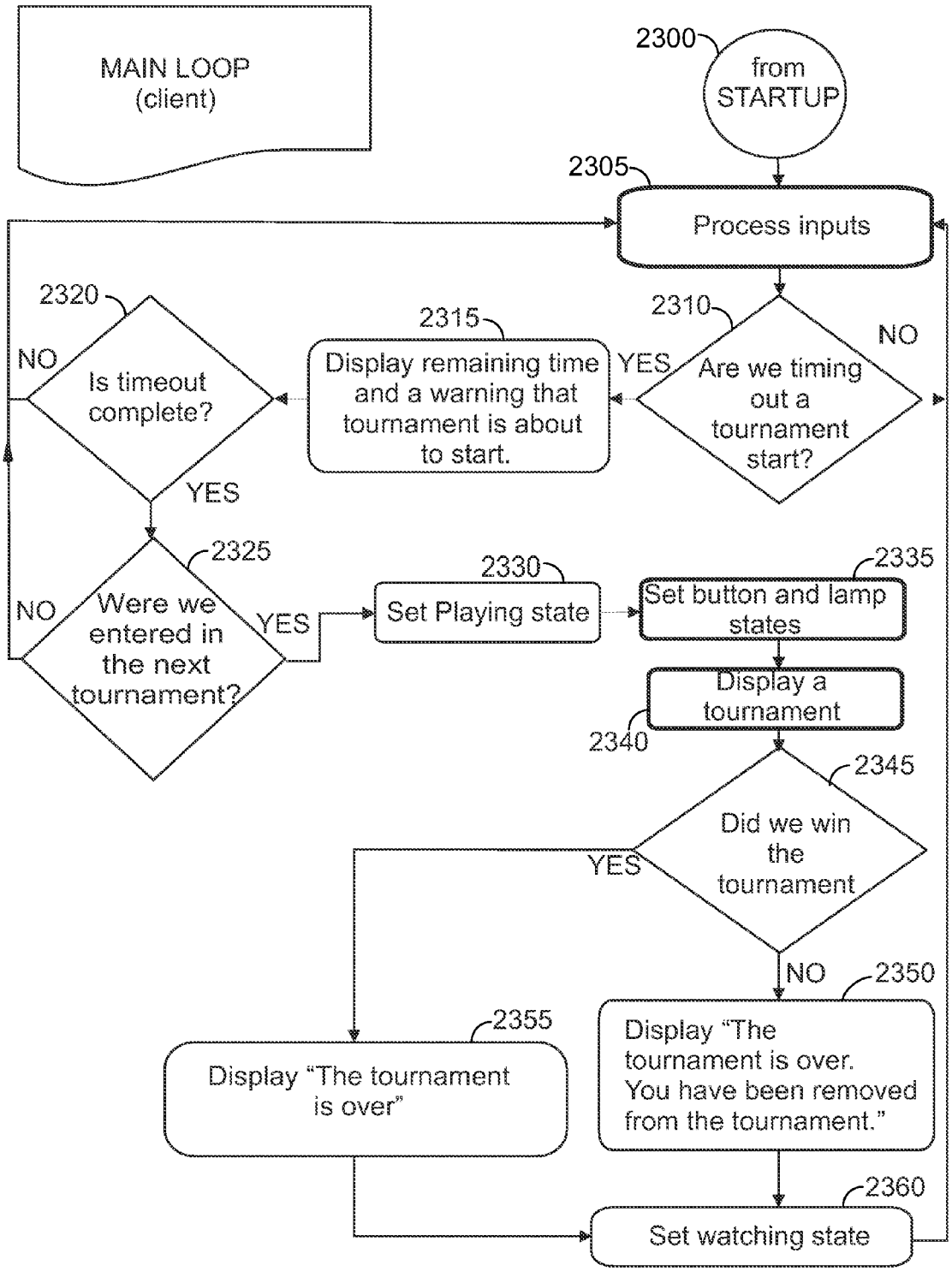

The MAIN LOOP shown in FIG. 23 has two sections. The upper section processes all of the betting input and other input choices made by the player while preparing to participate in a Bingo tournament. The lower section operates the tournament, and transitions back to the top half to repeat the process. After receiving control from the Startup routine at 2300, the client program enters a loop, where it calls the "Process Inputs" function at 2305, which is described below. The client program then checks at 2310 whether the countdown for the next tournament has begun, and loops back to 2305 if the answer is No. This process continues, allowing the player to set up bets for a Bingo tournament until a countdown begins.

When the countdown is detected at 2310, the client program enters a different loop where it displays the time until the next tournament on the gaming machine display (as well as playing out warning sounds as desired) at 2315. Then, at 2320 the client program checks whether the timeout until tournament start is complete and, if not, loops back to process inputs at 2305. This loop runs during the entire timer countdown, allowing the player to continue to make adjustments to their bets, while the client program updates the timer value on the gaming machine display.

Once the timer reaches zero at 2320, the tournament begins and control passes to 2325, where the client program checks to see if the player at this gaming machine has entered the tournament. If the player has not entered, then the client program returns to 2305, where the player (sitting out of the tournament) may continue to adjust the available bets. If the player is entered in the tournament at 2325, then the client program puts this gaming machine in the "playing" state at 2330 and calls the "Set button and lamp states" function (at 2335), which will be described below.

The client program then calls the "Display a tournament" function at 2340, which processes the entire Bingo tournament for this gaming machine, and will be described below. At the end of the tournament, the client program checks (at 2345) whether the player won the tournament. It the player won the tournament, then the message "The tournament is over" is shown on the gaming machine display at 2355. If the player was eliminated, then the additional message stating "You have been removed from the tournament" is also displayed at 2350, and, in either case, the state for this gaming machine is changed from "playing" to "watching" at 2360, and the program returns to the "Process Inputs" function at 2305.

Figure 24:
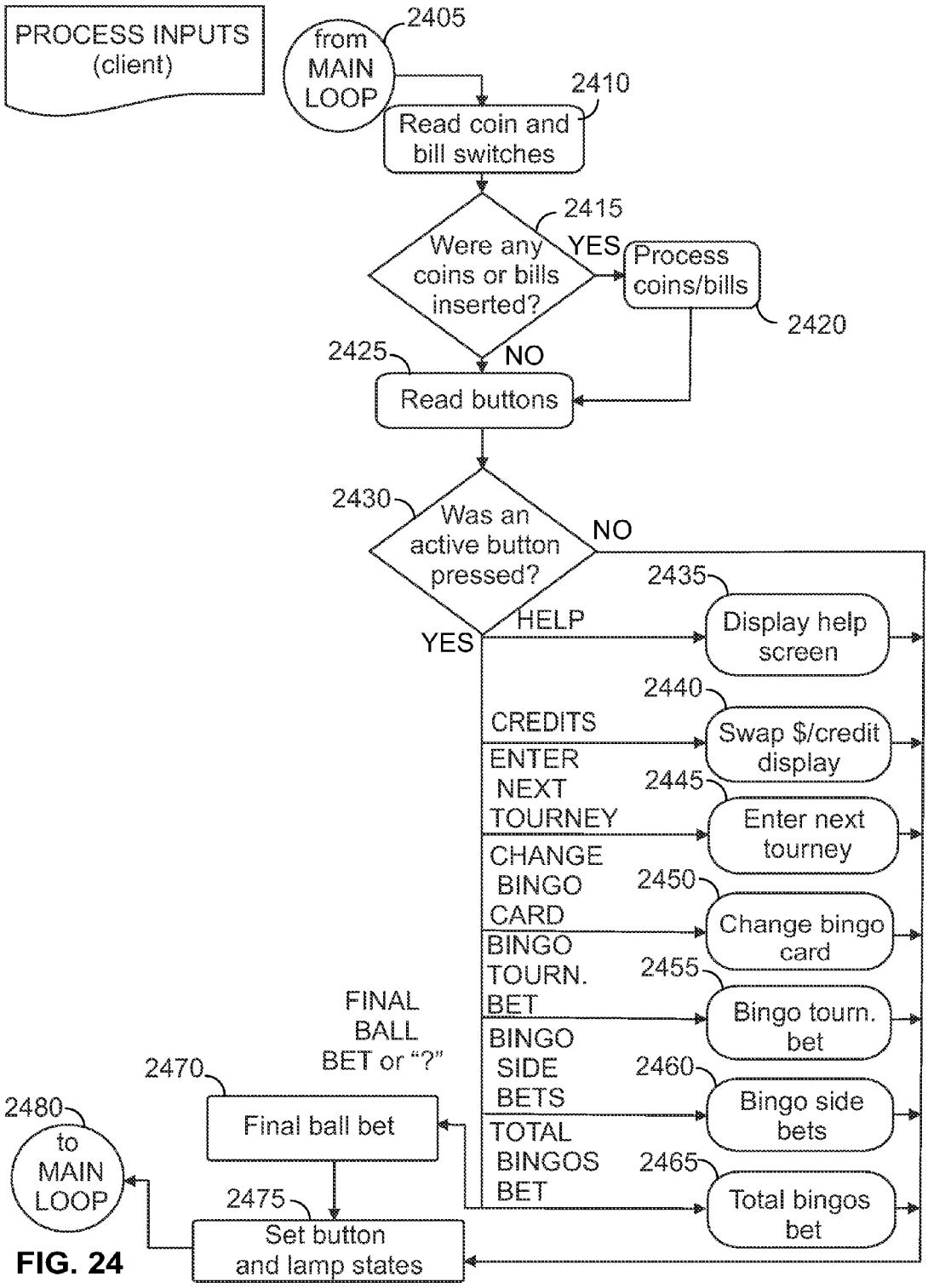

The PROCESS INPUTS function in FIG. 24 is called by the client program in every possible loop path of the Main Loop of FIG. 23 while the player is not playing in a tournament. This function receives all possible input from the player, and makes the necessary changes to the data and display in response to this input, in addition to queuing appropriate messages for the server. Upon entry from the Main loop at 2405, the client program checks the status of coin and bill switches (at 2410) using methods that are well known in the art. At 2415, the client program checks to see if there was any money inserted and, if so, modifies the player's credits in a manner known by those skilled in the art.

In either case, the states of the buttons or touch area are read into the client program at 2425 and, at 2430, a check is made to see if any buttons or touch areas have been pressed. If no buttons have been pressed, then the client program proceeds to the "Set button and lamp states" function (at 2475). If an active button has been pressed at 2430, then, depending on which button is pressed, the program calls one of the functions at 2435, 2440, 2445, 2450, 2455, 2460, 2465, or 2470, each of which is explained below.

Not shown on this flowchart is a check for the pressing of the "Bingo!" button, which may appear momentarily when the player has a bingo combination. If this button is pressed, then the client program generates the sound of a group shouting "Bingo!" in addition to queuing a message to the server to make this sound on the Large Display. Whether or not a button was pressed, the "Set button and lamp states" function, which will be explained below, is called (at 2475), and then this function exits back to the Main Loop at 2480.

Figure 25:
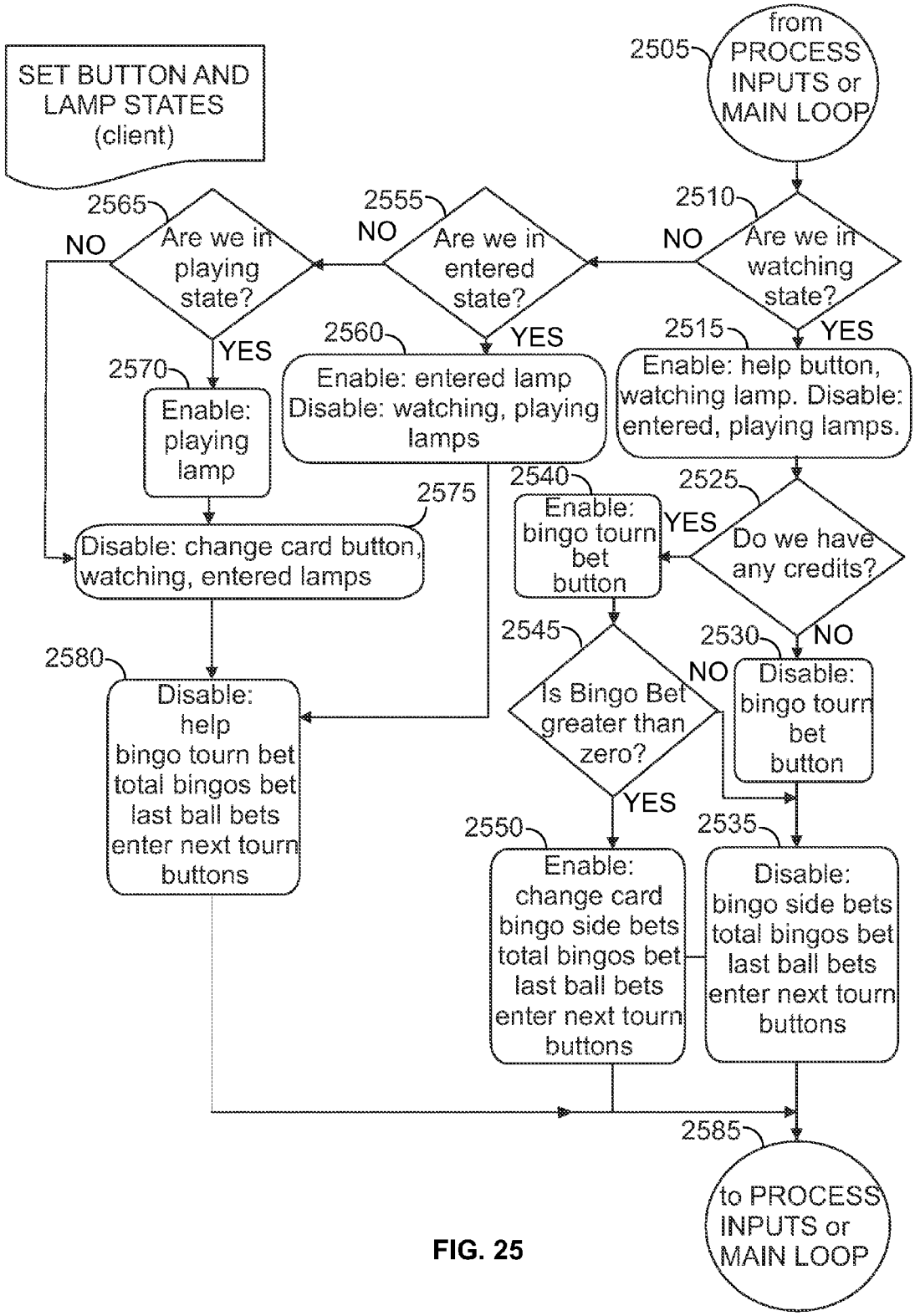

The SET BUTTON AND LAMP STATES function in FIG. 25 is called from the "Process Inputs" function as well as the "Main Loop," to enable or disable the buttons and the associated lamps (which may be a physical lamp in a mechanical button or a video button displayed as if it were lit up) based on data and states in the gaming machine. This function starts at 2505 and checks at 2510 to see if the game is in the "watching" state. If the game is in the watching state, then the "Watching" indicator is illuminated, while the "Entered" and "Playing" lamps are turned off (at 2515). The "help" button is also enabled at 2515.

At 2525, the client program checks to see if there are any credits on the gaming machine. If not, the Bingo Tournament Bet button is disabled at 2530, and the rest of the betting buttons are disabled at 2535, before returning to the calling program at 2585. If, at 2525, there are credits on the gaming machine, then the Bingo Tournament Bet button is enabled at 2540. At 2545, the client program checks whether a Bingo Tournament Bet has been entered. In this embodiment, a Bingo Tournament Bet is required before making any other bets; thus, if the Bingo Tournament Bet is greater than zero, the client program enables the other bets, the Change Card button and the Enter Next Tournament button at 2550. If there is no Bingo Tournament Bet, then the client program disables the other buttons at 2535 as is done when there are no credits on the gaming machine. Either way, control returns to the calling program at 2585.

Referring back to 2510, if the gaming machine is not in the watching state, control passes to 2555, where the client program checks whether the game is in the "Entered" state. If the gaming machine is in the "Entered" state, then, at 2560, the client program illuminates the Entered indicator while turning off the Watching and Playing indicators (at 2560). The client program then leaves the "Change Card" button enabled while disabling the rest of the buttons (at 2580) and returning to the calling program (at 2585). This locks in all bets once the player presses "Enter Next Tournament" (while still allowing the player to change the Bingo card until the tournament begins).

Back at 2555, if the gaming machine is not in the "Entered" state, it must be in the "Playing" state, and a sanity check for this is made at 2565. If the client program detects that the game is not in the Playing state, it has detected an error, as the game is not in any of the three valid states. An error handler or Tilt could be placed here, as is well known in the art, and in this embodiment the program proceeds to 2575 and 2580, where all buttons are disabled as a safety precaution. Back at 2565, if the "Playing" state is detected, then the client program illuminates the Playing indicator (at 2570), while turning off the Watching and Entered indicators at 2575. Also, the "Change Card" button is disabled at 2575, and the rest of the buttons are disabled at 2580, before returning to the calling program at 2585.

Figure 26:
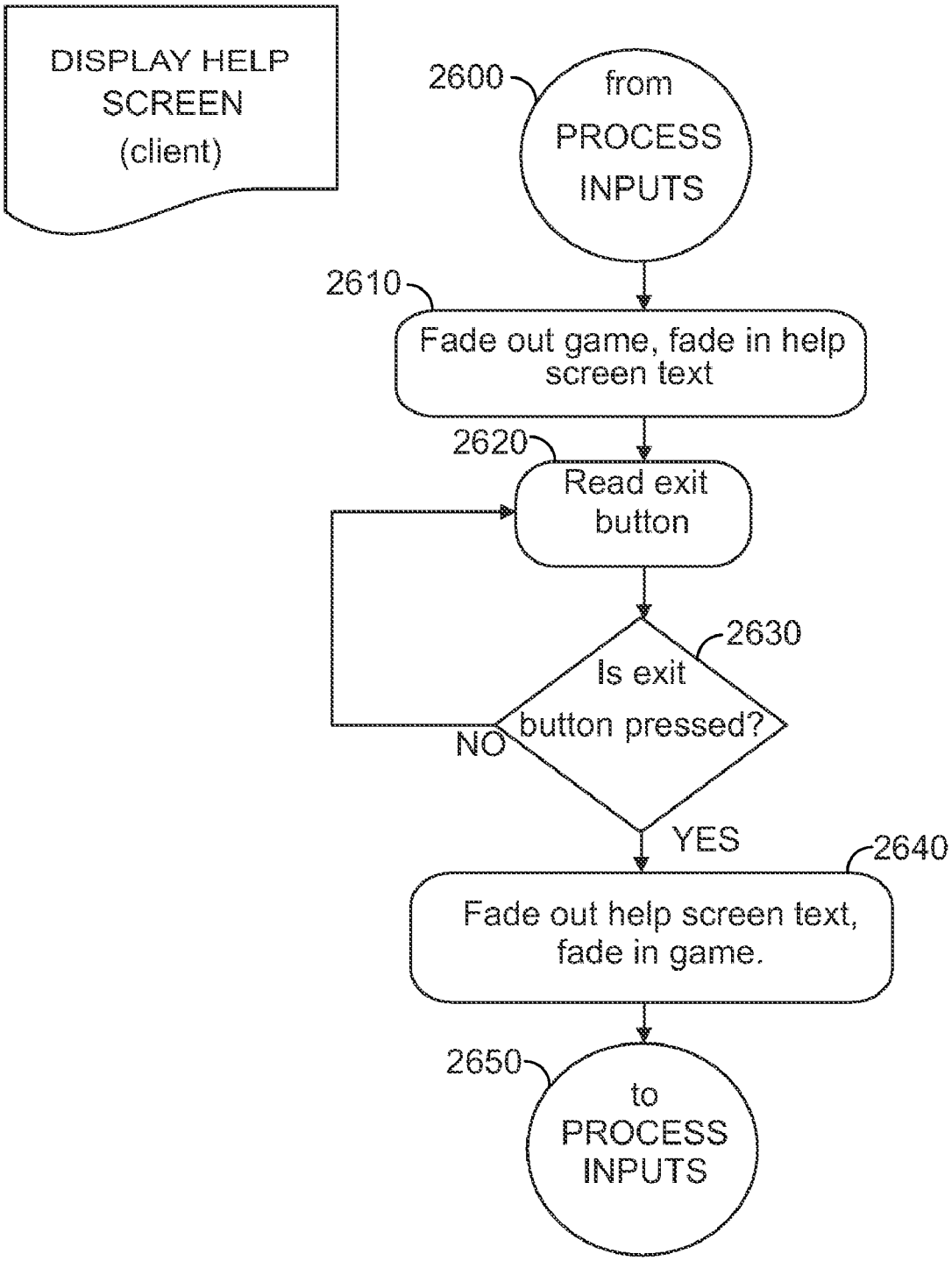

FIG. 26 shows the DISPLAY HELP SCREEN function, which is called from the "Process Inputs" function when the Help button is active and pressed. At 2610, the client program fades out the display of the current game and shows the help information on the display. The client program then enters a loop at 2620 and 2630, scanning for a press of the Exit button and looping back until it is pressed. Once the Exit button is pressed, the client program fades the game display back on at 2640, and then returns to the "Process Inputs" function at 2650.

Figure 27:
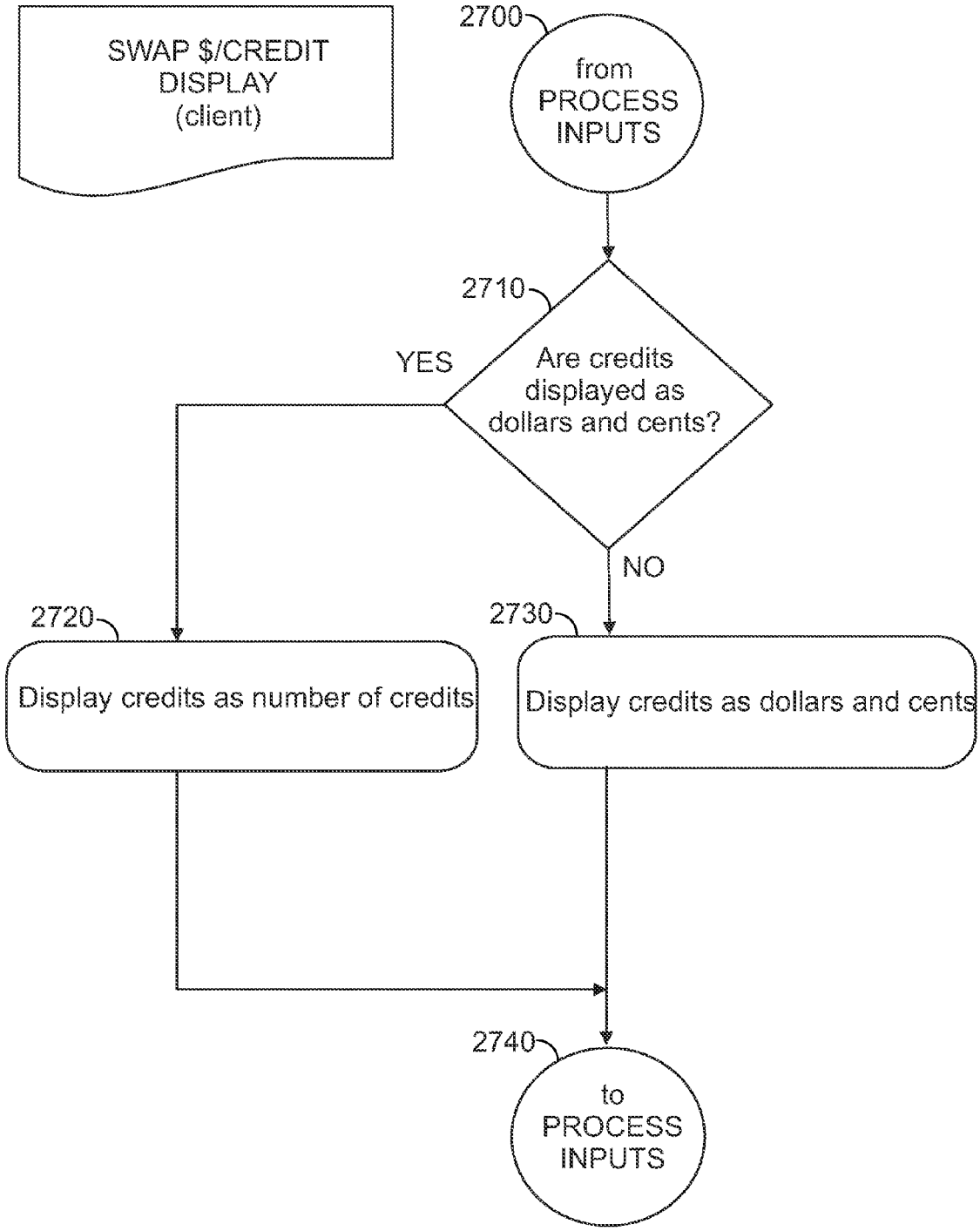

FIG. 27 shows the SWAP $/CREDIT DISPLAY function which is called from the "Process Inputs" function when the player touches the credits display to toggle the way the credits are displayed. At 2710, the client program checks to see if the credits are currently displayed as dollars and cents. If this is the case, then the display is changed to show the number of credits (total money/denomination) at 2720. Otherwise, the credit display is changed from number of credits to dollars and cents at 2730. In either case, the function returns to the "Process Inputs" function at 2740.

Figure 28:
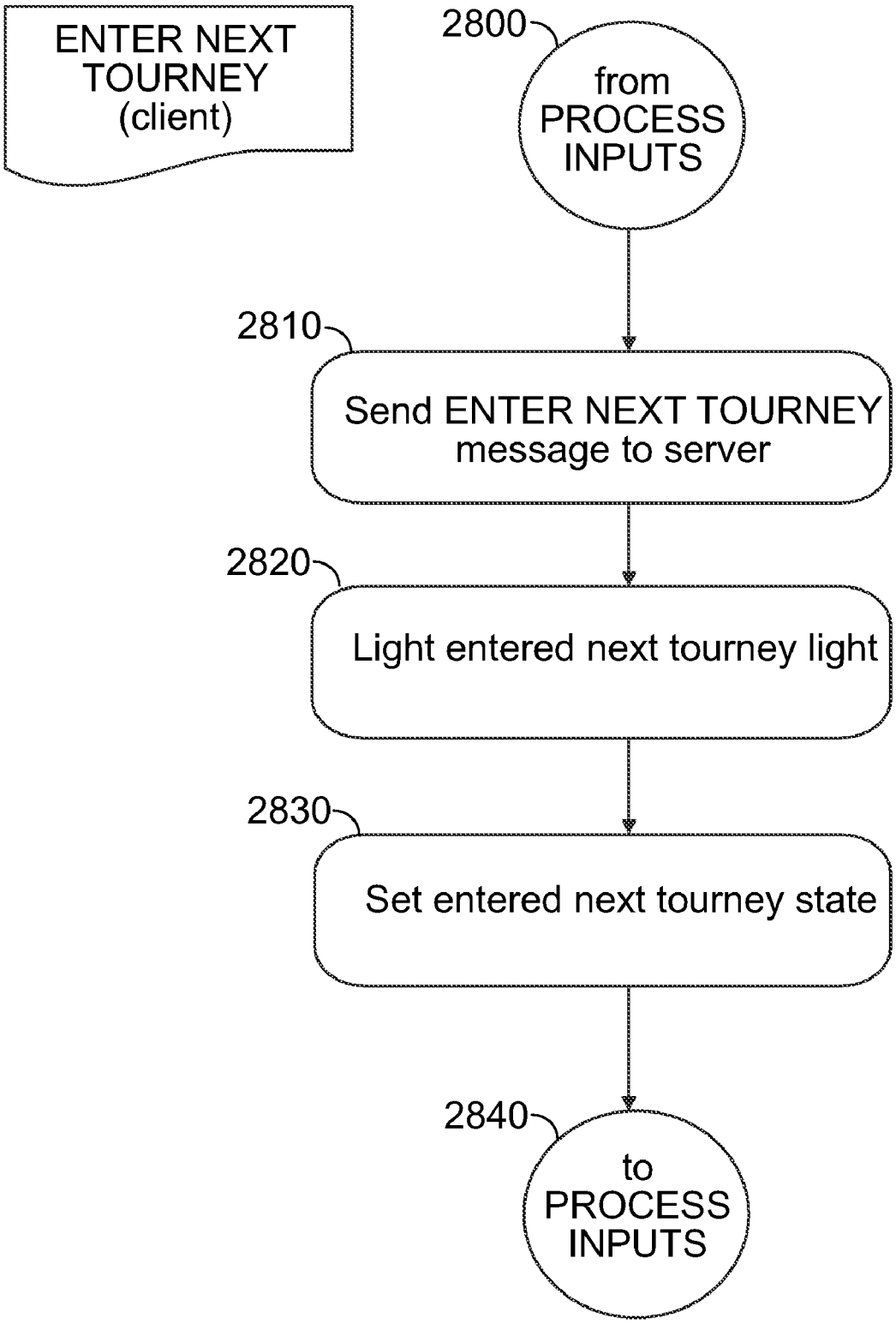

FIG. 28 shows the ENTER NEXT TOURNEY function, which is called from the "Process Inputs" function when the "Enter next Tourney" button is active and pressed. At 2810, the client program sends a message to the server to enter this gaming machine in the next tournament. This message includes all of the current wagers which have now been locked in as a result of pressing the Enter Next Tourney button. The client program then turns on the "Entered Next Tourney" light at 2820, and sets the game state to "entered next tourney" in 2830, before returning to "Process Inputs" at 2840.

Figure 29:
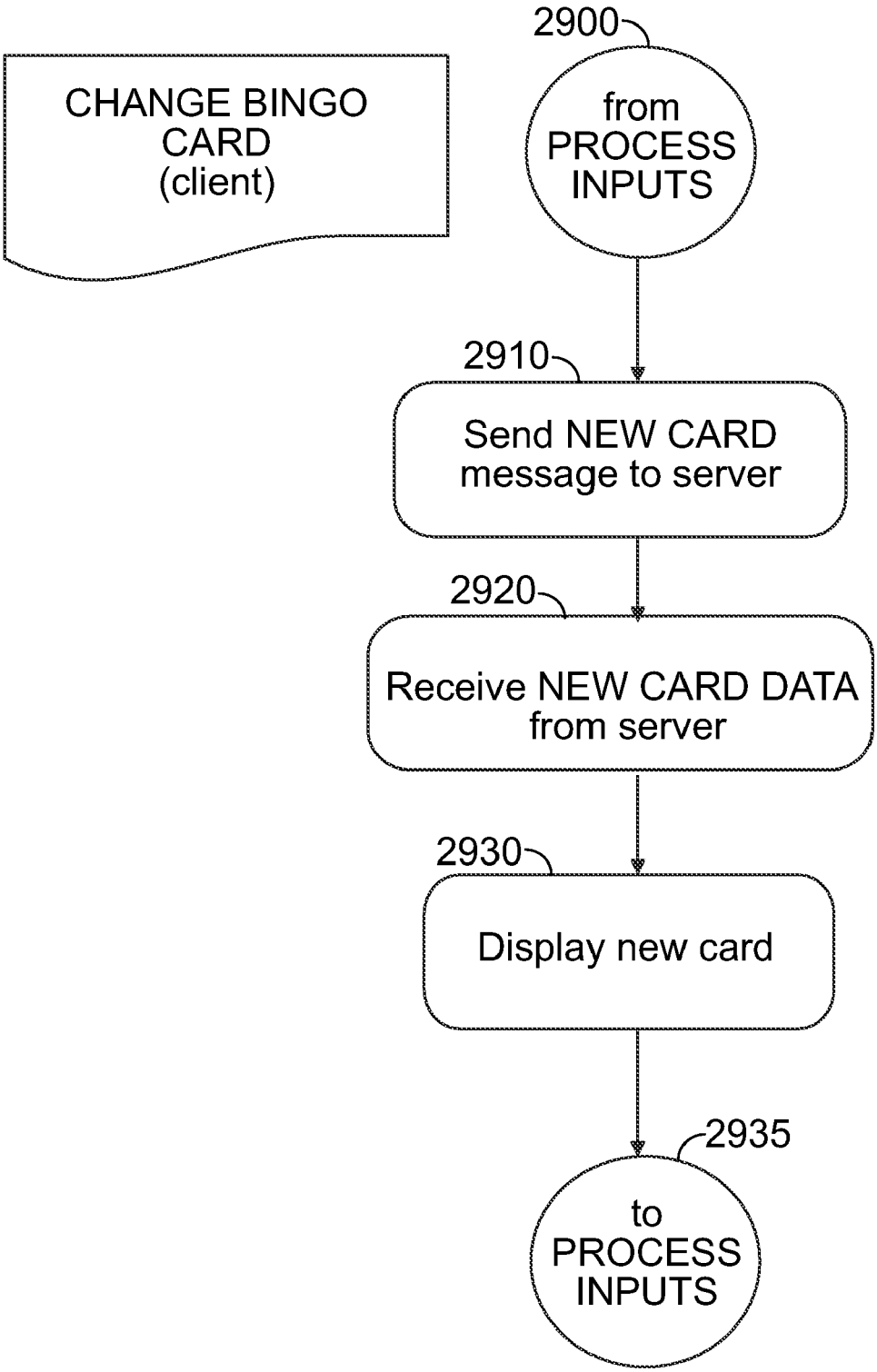

FIG. 29 shows the CHANGE BINGO CARD function, which is called from the "Process Inputs" function when the "Change Bingo Card" button is active and pressed. At 2910, the client program sends a message to the server requesting a new random Bingo card. At 2920, the client program waits to receive the data for a new card from the server, at which time the client program shows this new card on the gaming machine display (at 2930), before returning to "Process Inputs" at 2935.

Figure 30:
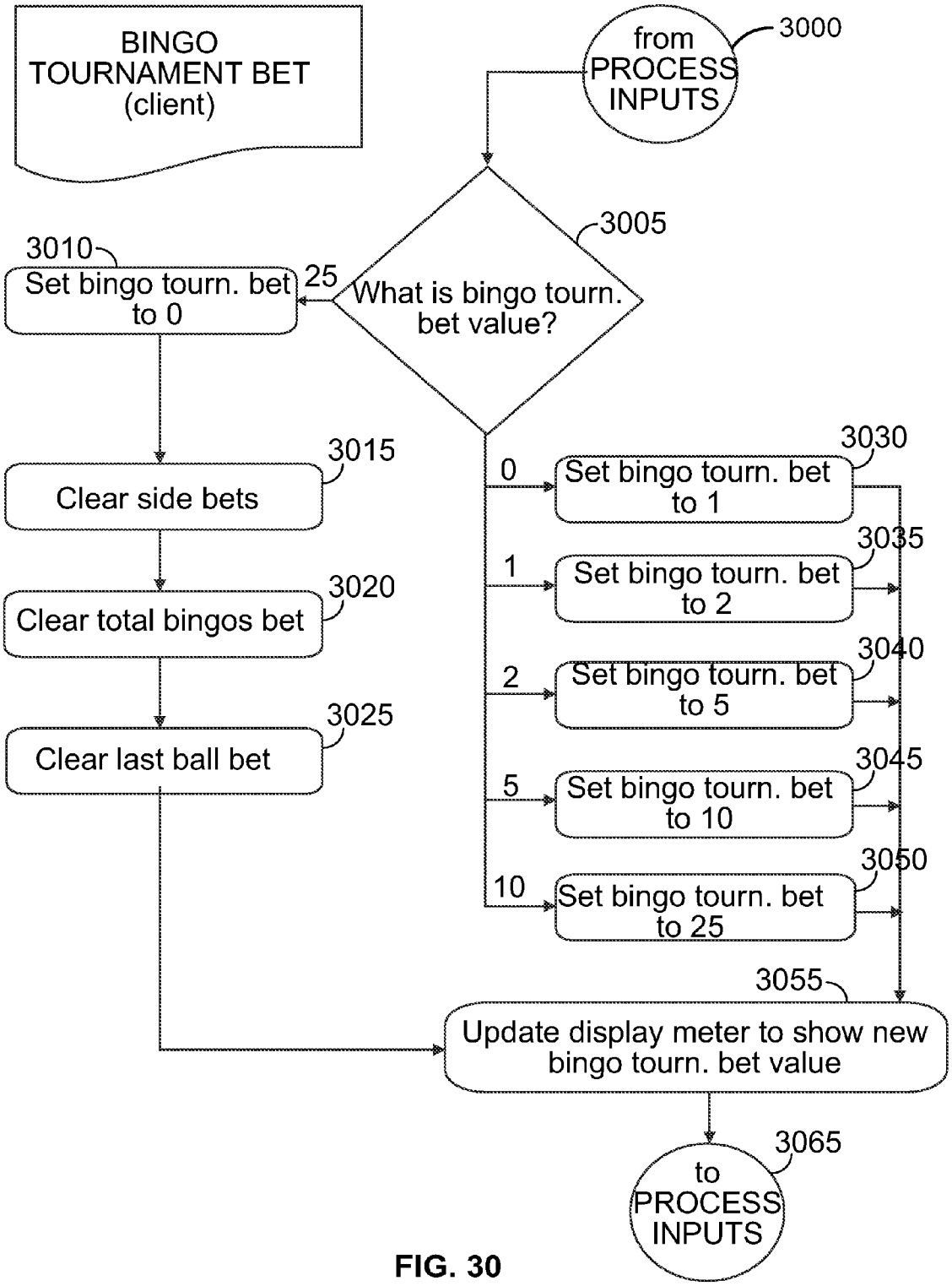

FIG. 30 shows the BINGO TOURNAMENT BET function, which is called from the "Process Inputs" function when the gaming chip representing the "Bingo Tournament Bet" is active and pressed. At 3005, the client program checks the current value of the Bingo Tournament Bet. In this embodiment, pressing the button cycles the bet from zero to $1, $2, $5, $10, and $25. If, at 3005, the current value of the Bingo Tournament Bet is at the maximum $25 value, the client program sets the Bingo Tournament Bet to zero at 3010. Since a Bingo Tournament bet is required in this embodiment, all of the other bets get cleared if the Bingo Tournament bet is set to zero, and this is done at 3015, 3020, and 3025. Back at 3005, if the current Bingo Tournament bet is not the maximum value, then it is increased to the next value at 3030, 3035, 3040, 3045, or 3050. All paths then lead to 3055, where the display on the gaming machine is updated to show the new value, before returning to "Process Inputs" at 3065.

Figure 31:
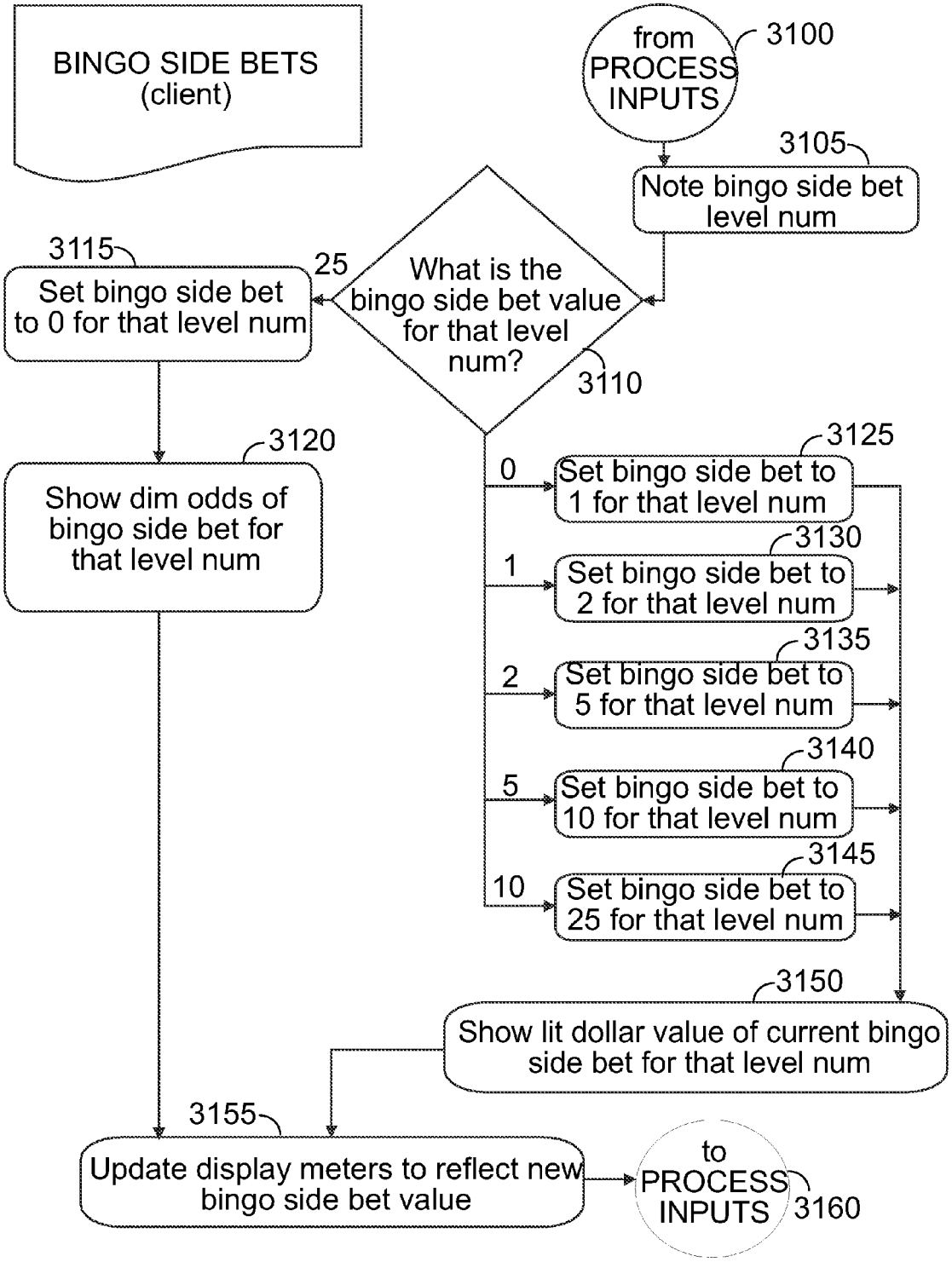

FIG. 31 shows the BINGO SIDE BETS function which, is called from the "Process Inputs" function when any "Bingo Side Bet" gaming chip button is active and pressed. At 3105, the client program assigns the variable "num" to store the level (or tournament round) whose gaming chip was touched by the player. The Bingo Side Bets are modified in the same manner as the Bingo Tournament Bet, by progressing through the sequence zero, $1, $2, $5, $10, and $25. At 3110, the current Bingo Side Bet for the specified level is examined. If it is the maximum value of $25, it is reset to zero at 3115. At 3120, the client program displays the odds (dimmed) on the gaming machine display for the level that was touched. Back at 3110, if the Bingo Side Bet for the selected level was not at the maximum, then the side bet is increased at 3125, 3130, 3135, 3140, or 3145, and then the total amount paid for a Bingo on the selected level is updated to show the new payout value based on the updated bet amount (at 3150). All paths lead to 3155, where the new Bingo Side Bet for the selected level is shown on the display of the gaming machine, before returning to "Process Inputs" at 3160.

Figure 32:
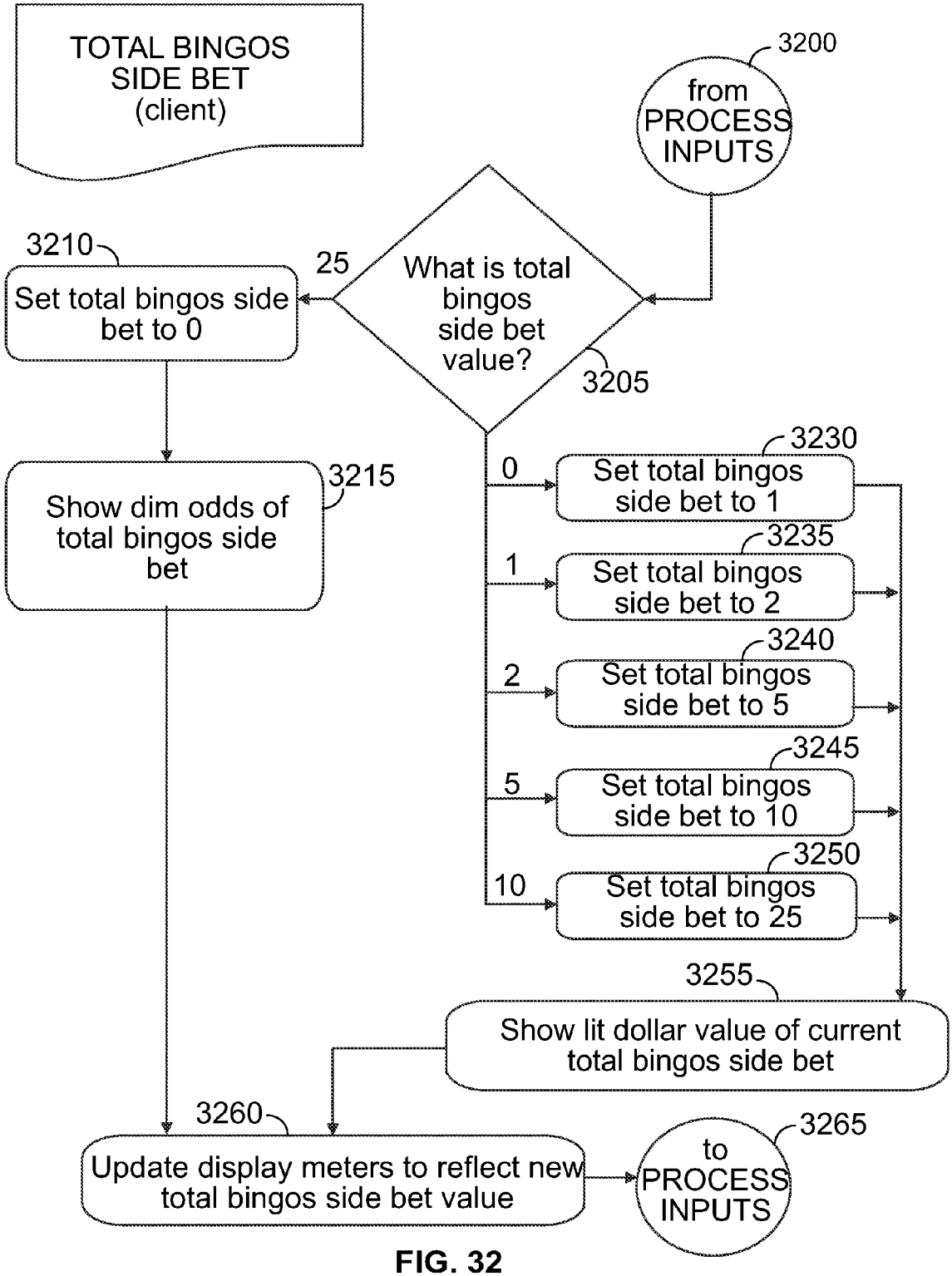

FIG. 32 shows the TOTAL BINGOS SIDE BET function, which is called from the "Process Inputs" function when the gaming chip next to "Bonus Pays for Total Number of Bingos for an Entire Game" is active and pressed. The Total Bingos Side Bet is modified in the same manner as the Bingo Tournament Bet by progressing through the sequence zero, $1, $2, $5, $10, and $25. At 3205, the client program checks the current value of the Total Bingos Side Bet, and, if it is at the maximum $25 value, it now sets the Total Bingos Side Bet to zero at 3210. At 3215, the display of the gaming machine is updated to show the payout odds for each pay for this side bet, dimmed out to reinforce that the bet is not currently in play. Back at 3205, if the current Total Bingos Side Bet is not the maximum value, then it is increased to the next value at 3230, 3235, 3240, 3245, or 3250. At 3255, the payout amounts for each possible bingo are updated for the new bet value and shown bright (undimmed) on the gaming machine display. All paths then lead to 3260, where the display on the gaming machine is updated to show the new Total Bingos Side Bet value, before returning to "Process Inputs" at 3265.

Figure 33:
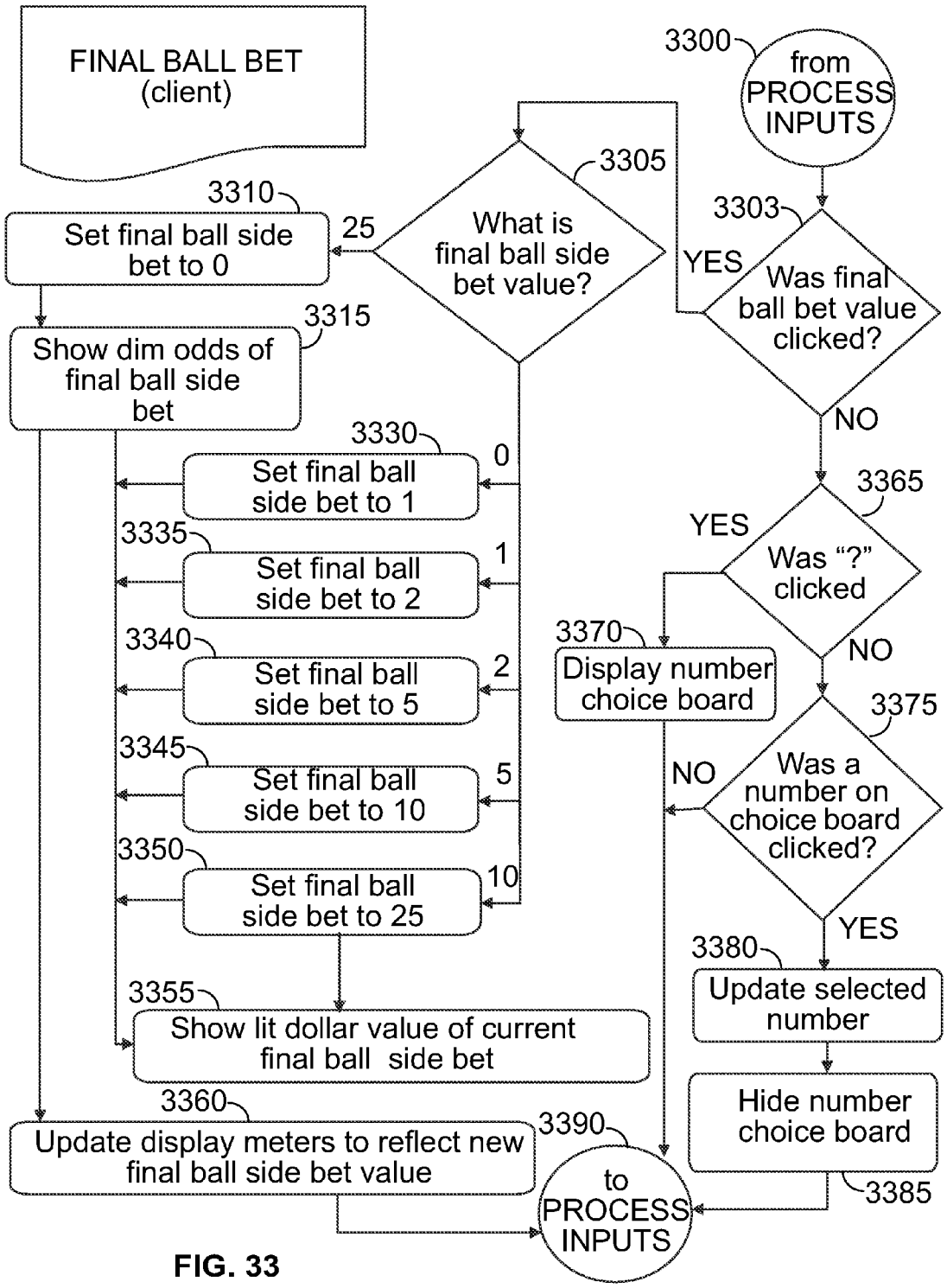

FIG. 33 shows the FINAL BALL BET function, which is called from the "Process Inputs" function when the gaming chip next to "Last Ball in any Game that Matches Chosen number" is active and pressed. This function is also called when the question mark icon—?—is pressed, or a number is touched from the Final Ball Bet choice board. At 3303, the client program checks to see which button was pressed to activate this function, and advances to 3305 if the gaming chip was pressed. The Final Ball Bet is modified in the same manner as the Total Bingos Side Bet, by progressing through the sequence zero, $1, $2, $5, $10, and $25. From 3305, the processing for changing the value of this bet at 3305 through 3360 is the same as the corresponding similarly numbered steps in FIG. 32.

Back at 3303, if the gaming chip wasn't pressed, a check is made at 3365 to see if the question mark icon was pressed. If it was, a grid showing the possible 1 through 75 Bingo Numbers is shown on the gaming machine display (at 3370) before exiting the function (at 3390). If it was not a press of the question mark icon, then a check is made at 3375 to see if a number was pressed. If a number was pressed, then the selected number for this bet is updated at 3380, and the number board is removed from the gaming machine display at 3385. Back at 3375, if a number wasn't pressed, we have encountered another error condition, which could be handled with a Tilt or other processing and recording; however, in this case, the function exits at 3390 to return control to the Process Inputs function.

Figure 34:
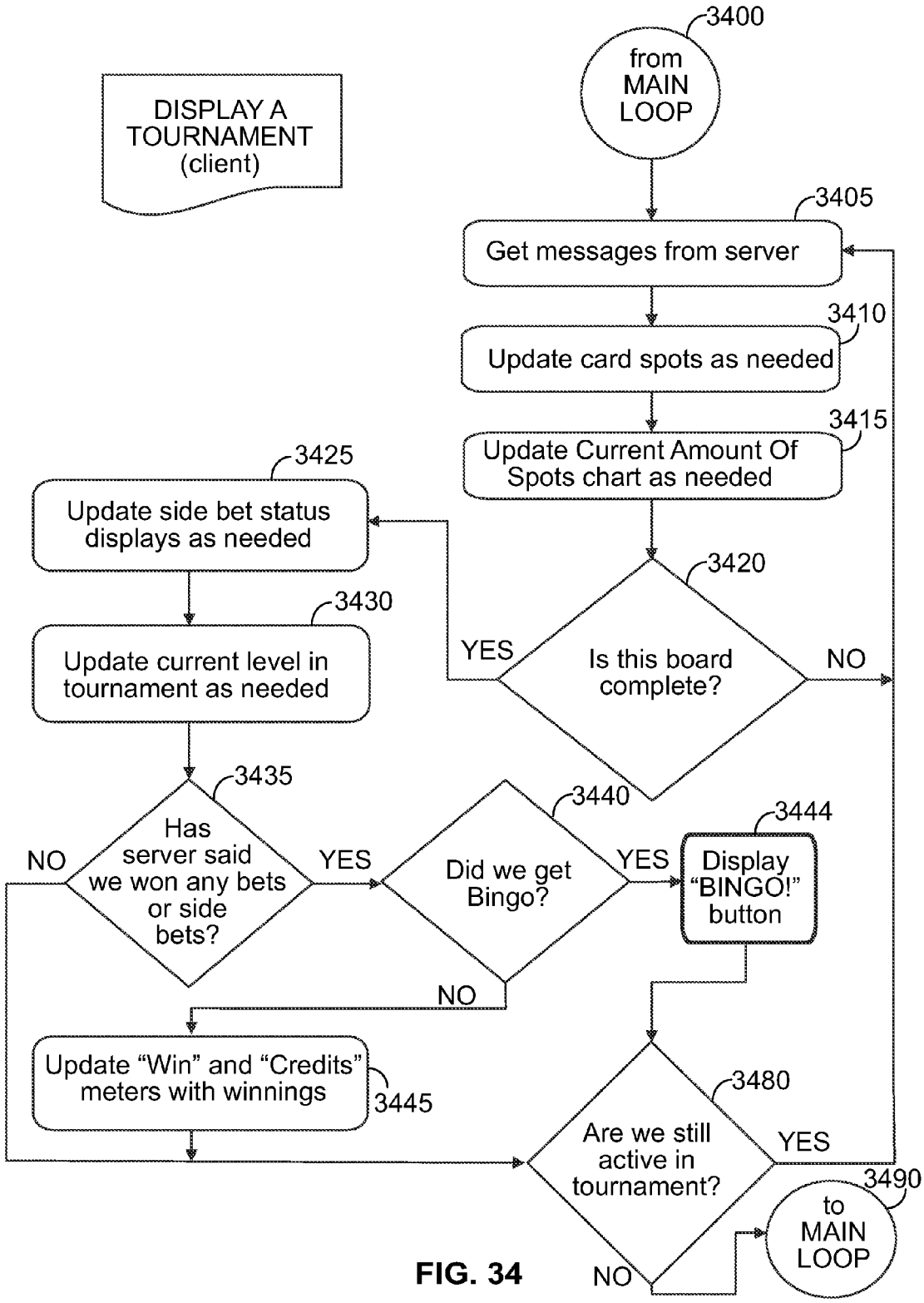

FIG. 34 shows the DISPLAY A TOURNAMENT function, which is called from the Main Loop when a Bingo Tournament begins. This function updates the gaming machine display and provides the sounds for the local display for the entire time that the player is active (i.e. not yet eliminated) from the tournament. As the bingo games play out, the client program operates a loop beginning at 3405 where messages are retrieved from the server. These messages contain the numbers of the balls being drawn, information as to whether a Bingo has occurred, identification of which contestant(s) have been eliminated, an indication as to whether the tournament is over, and/or any other tournament-play-related data values.

At 3410, the gaming machine display is updated, which includes marking numbers that are called and playing appropriate sounds. This step will preferably also highlight any Bingo combination detected on the Bingo Card. The step at 3410 will also update the card on the gaming-machine display when a new game message is received, to clear off the spots from the previous game. At 3415, the sliders on the left side of the gaming-machine display, which show the total number of marked spots and the current number of spots needed to avoid elimination, are updated.

At 3420, a check is made to see if this level is complete, which would occur when a contestant had a Bingo. If not, the game continues, and the client program loops back to 3405. Once at least one contestant has a Bingo (satisfying the "board complete" test at 3420), the client program updates all of the bet displays at 3425, and updates the tournament level at 3430 if the tournament is not over. At 3435, the client program checks the server messages to see if the player has won any of the bets and, if so, checks for a Bingo by this player at 3440. If the player at this machine does not have a Bingo, then the Win and Credits meters are updated at 3445. Back at 3440, if this player has a Bingo, the "Display 'Bingo!' button" function (described below) is called at 3444. All paths—winning, losing, or Bingo—converge at 3480, where a check is made to see if the player at this gaming machine will be participating in the next round of the tournament. If so, the process repeats for the next level at 3405; otherwise, the function returns to the Main Loop at 3490.

Figure 34A:
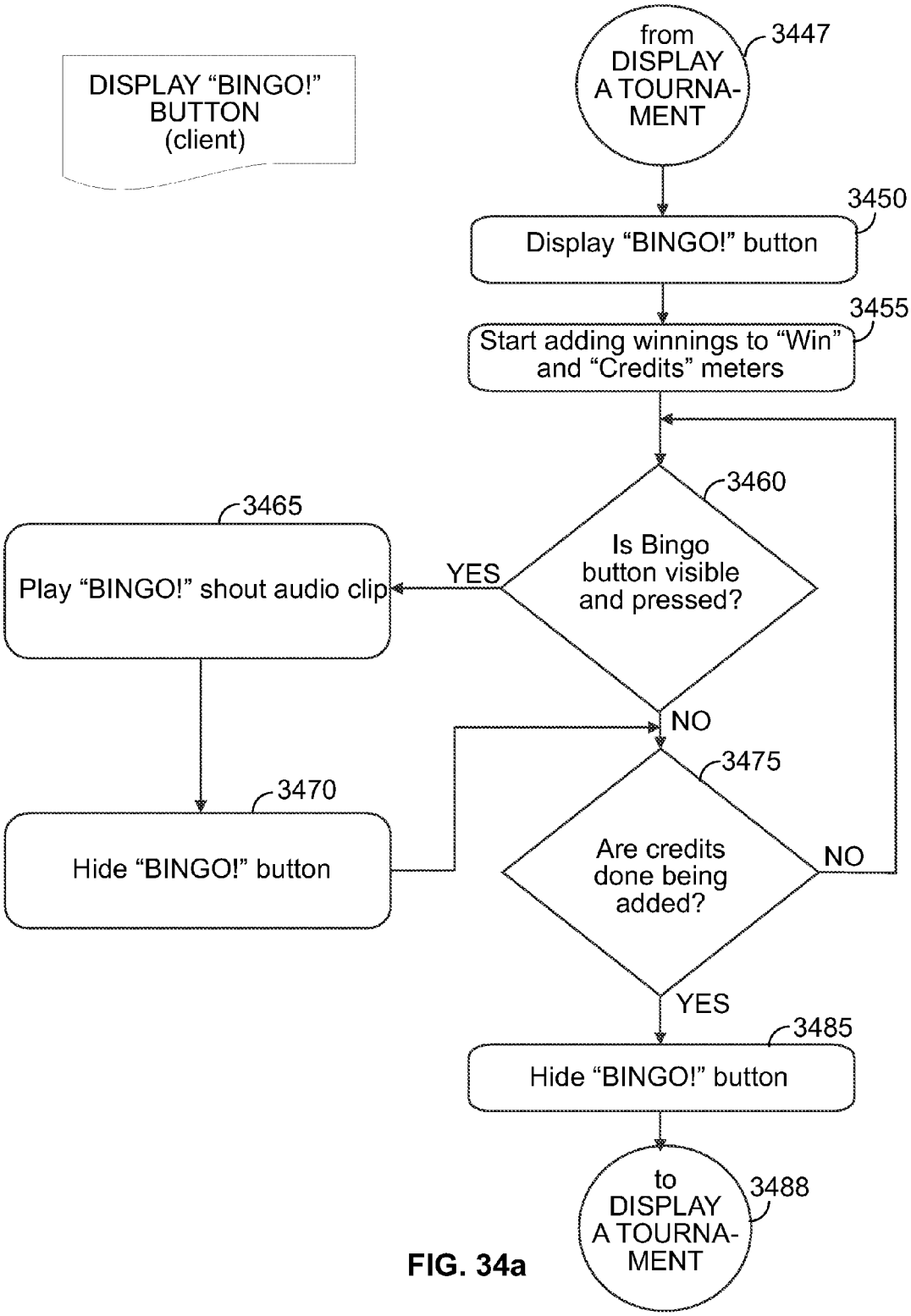

FIG. 34*a* shows the DISPLAY "BINGO!" BUTTON function, which is called from the "Display a Tournament" function when that function detects that the player at this gaming machine has a Bingo. The client program adds the "Bingo" button to the display of the gaming machine at 3450, and then begins the transfer of credits to the Win and Credits display at 3455. At 3460, the client program checks to see if the Bingo button has been pressed and, if so, an audio shout of "Bingo!" is made through the speakers on the gaming machine at 3465. A message is also sent to the server program at this step to shout "Bingo!" from the large display for all to hear.

The Bingo button is then removed at 3470 and, whether or not the button was pressed, the client program checks whether the transfer of the credits is complete at 3475. If the credits are still transferring, the client program loops back to 3460 to allow the credits to finish transferring. At 3485, the credit transfer has completed, so whether or not the player pressed the "Bingo!" button, the Bingo Button is removed from the display, thus ending the chance for the player to add this celebratory cheer. Control then returns to the "Display a Tournament" function at 3488.

Figure 35:
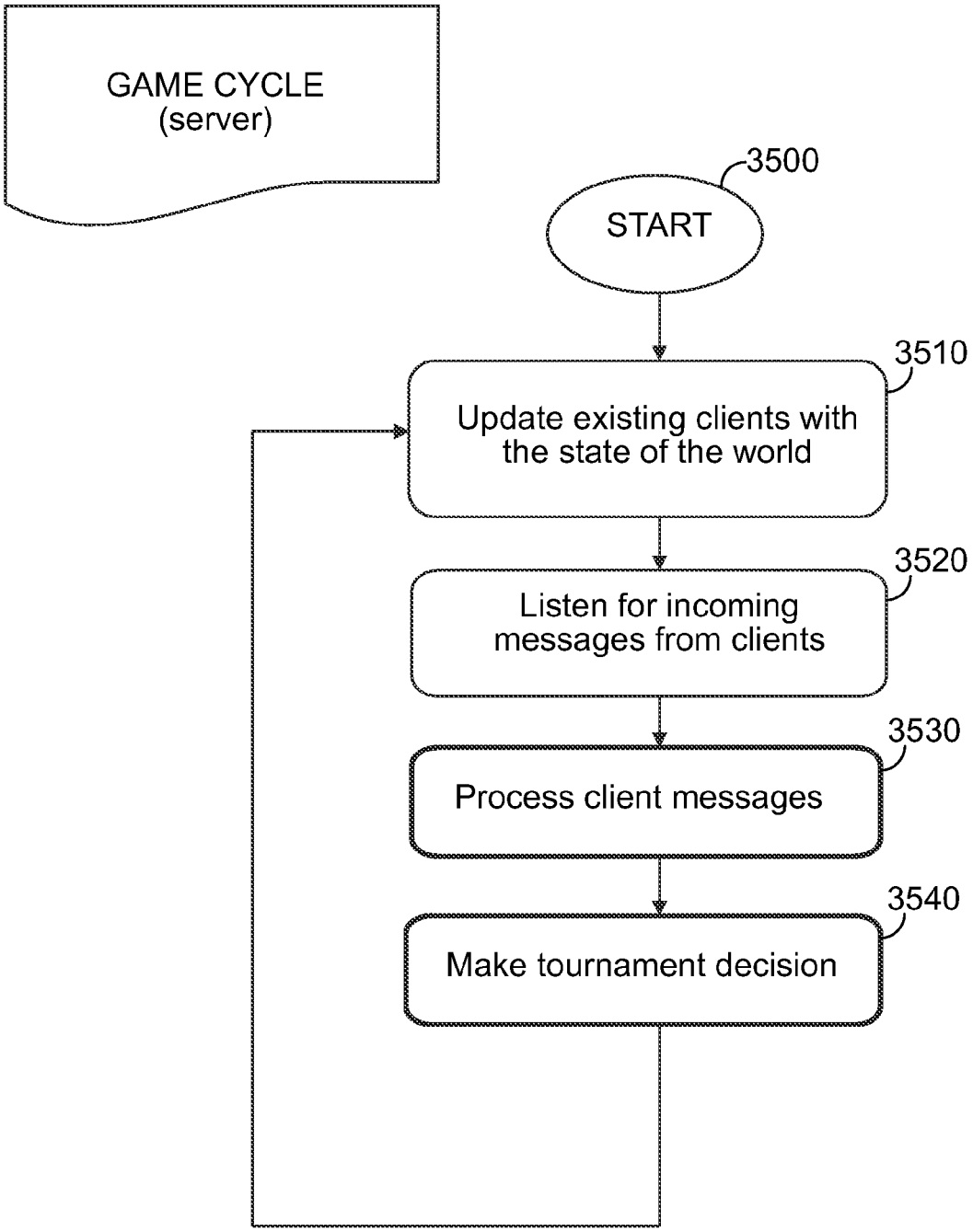

The operation of the server program is described beginning with the GAME CYCLE in FIG. 35. The server program runs this loop at all times, to facilitate message processing and game operation. After starting at 3500, the server program continually runs the loop starting at 3510, where the server program sends messages to each client program, providing information about the state of the system. At 3520, the server program checks for incoming messages from each of the client programs. At 3530, the "Process Client Messages" function (described below) is called to take the necessary actions for messages received by the client programs. Then the "Make Tournament Decision" function (also described below) is called at 3540 to execute all actions required for operating the tournaments. The server program then loops back to 3510 to run the loop again. This loop continues to run at all times while tournaments operate, and during the countdowns in between.

Figure 36:
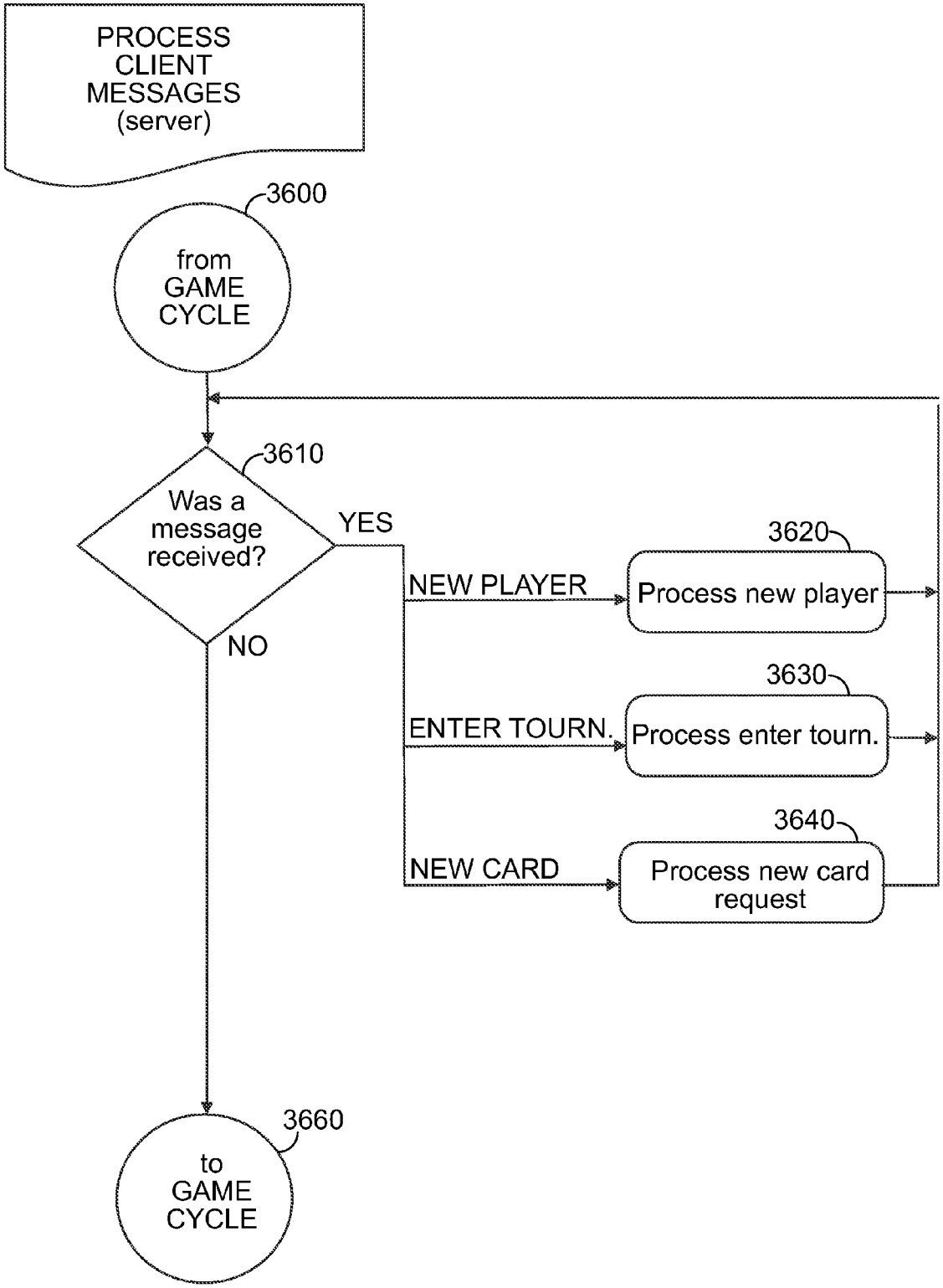

The PROCESS CLIENT MESSAGES function is shown in FIG. 36. The server program checks to see if a message has been received from a client program at 3610. If there are no messages, the function exits back to the Game Cycle loop at 3660. However, if a message has been received at 3610, then one of the functions numbered 3620, 3630, or 3640 is called, depending on which type of message was received. Each of these functions is described below. Not shown is the action for the "Bingo! Button" pressed message which causes an audible shout of "Bingo" to be generated at the Large Display. After processing the message through the appropriate function, the server program loops back to 3610 to process the next message, if any, in the message queue. Once there are no messages left in the queue, the server program returns control to the Game Cycle loop at 3660.

Figure 37:
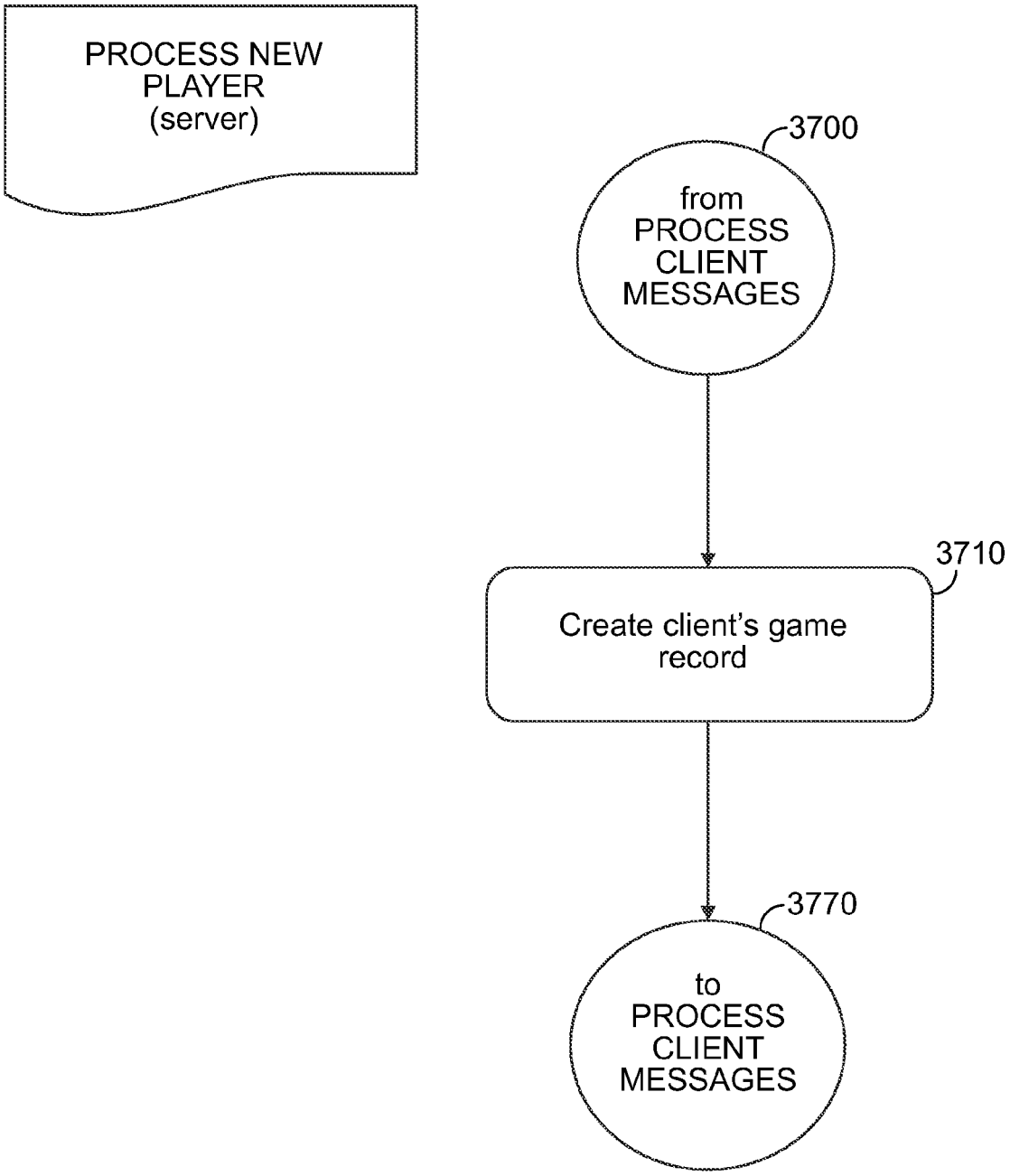

In FIG. 37, it can be seen that the PROCESS NEW PLAYER FUNCTION has the simple job of creating a game record (at 3710) for a client gaming machine, after receiving control (at 3700) from Process Client Messages, and then returning control to the Process Client Messages routine (at 3720).

Figure 38:
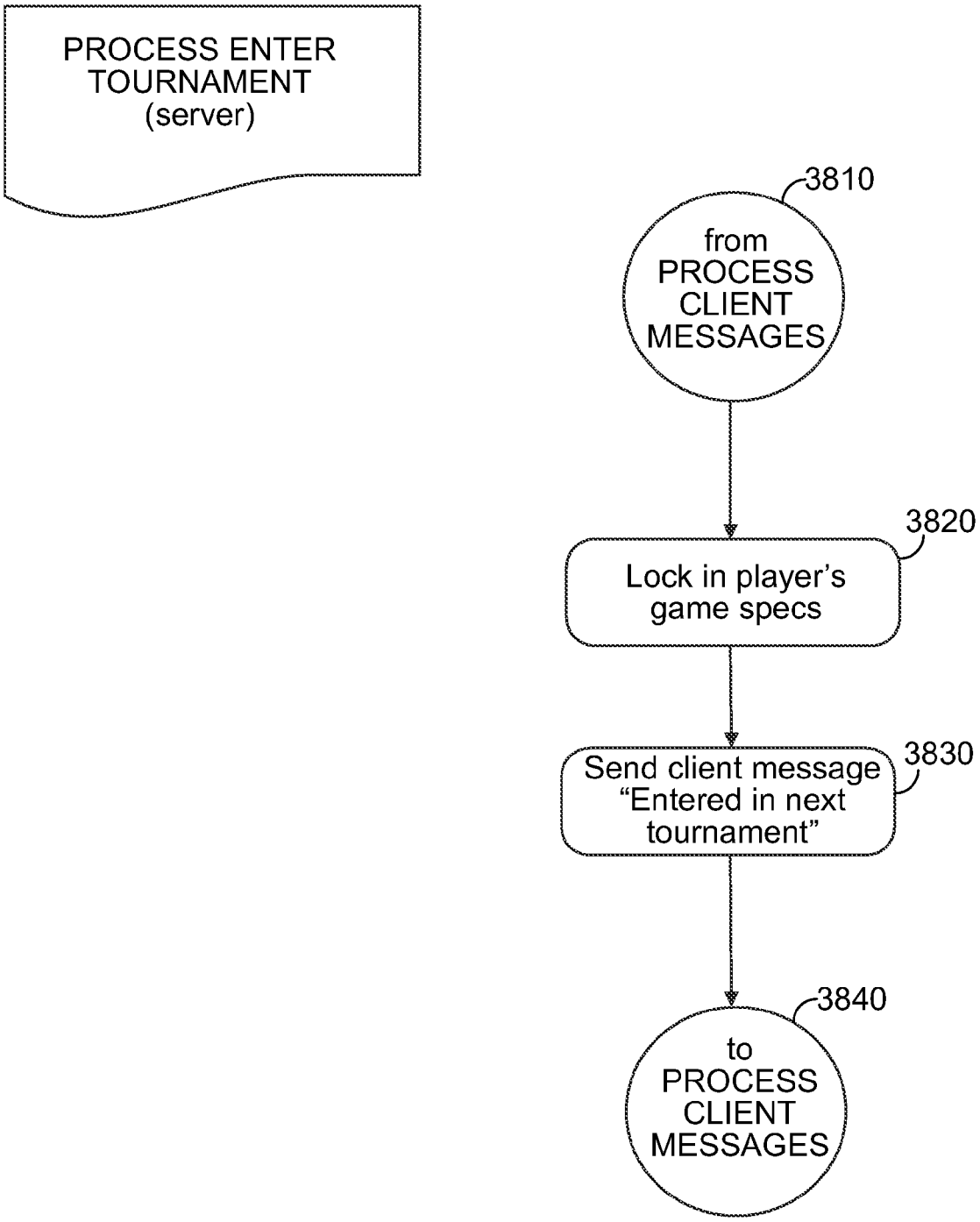

The PROCESS ENTER TOURNAMENT function is shown in FIG. 38. At 3820 (after receiving control from Process Client Messages at 3810), the server program copies the game specs contained in the message, which includes all of the betting information set up by the player at the initiating gaming machine. At 3830, the server program then sends a message back to the client program to confirm the entry in the next tournament, and proceeds to return control to Process Client Messages at 3840.

Figure 39:
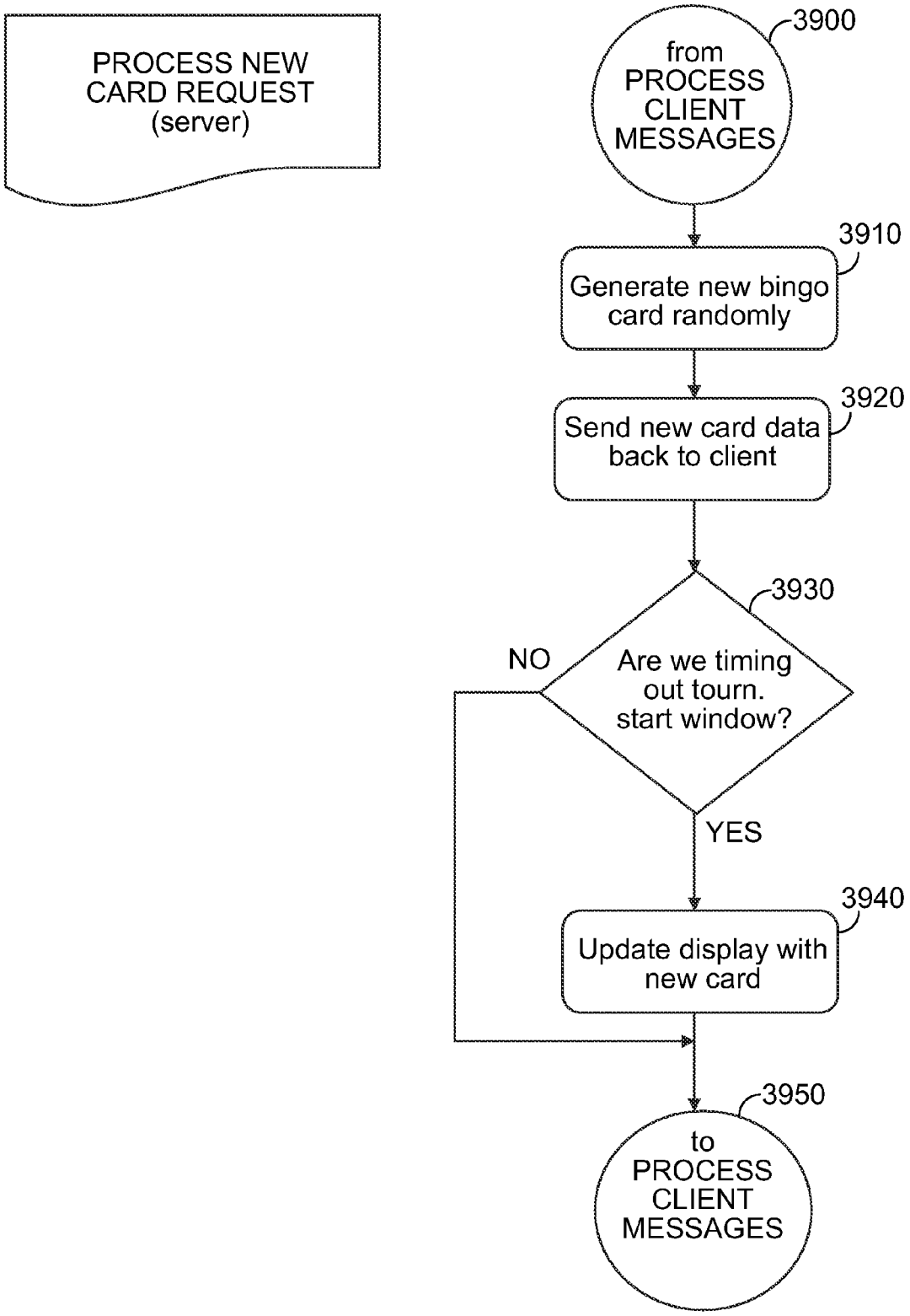

In FIG. 39, the function PROCESS NEW CARD REQUEST operates when a player requests a change of Bingo cards. After receiving control from Process Client Messages at 3900, the server program uses its Random Number Generator (RNG) to randomly generate a Bingo card (at 3910) in a manner that is well known in the art. At 3920, the server program then sends a message containing the data for the new card back to the client program. At 3930, the server program checks to see if the system is between tournaments (i.e. timing down to the next tournament start). If so, then at 3940, the Large Display is updated with the new card at the requesting player's position. If there is a tournament in progress, then there is no update to the Large Display at that player's position until the completion of the tournament, and, in either case, the function returns control to Process Client Messages at 3950.

Figure 40:
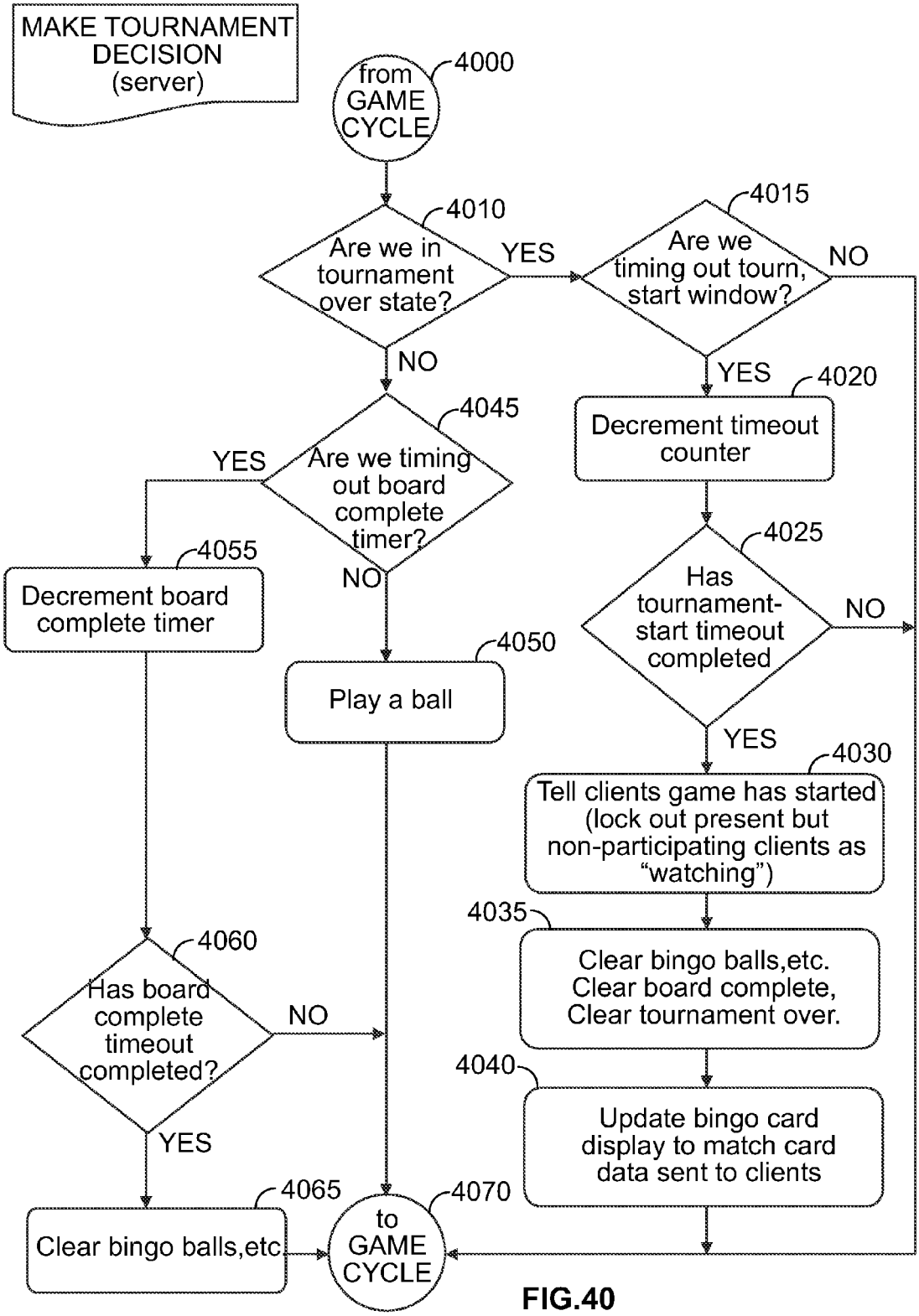

FIG. 40 shows the MAKE TOURNAMENT DECISION function, which is called from the "Game Cycle" loop (at 4000). At 4010, the server program checks whether the system is running a tournament or timing down until the next tournament, and advances to 4015 if it finds the "tournament over" (timing down until the next tournament) state. At 4015, a check is made to verify that the system is in the Timing Down mode. If not, we have an error condition, which could be handled by a Tilt or other recovery means, as is well known in the art. In this case, the server program returns to the Game Cycle loop at 4070.

After detecting the Timing Down mode at 4015, the server program decrements the timeout counter at 4020, and checks (at 4025) to see if the timeout counter has reached the threshold value at which the tournament should begin. If it is not time to begin the next tournament, then the function exits at 4070. Otherwise, at 4030, the server program sends messages to inform the client programs that the tournament has begun. Next, at 4035, the Bingo Balls from the previous tournament are cleared away (from memory and the Large Display), as well as other data and display elements that pertain to the previous tournament. At this time the "board complete" variable is cleared to let the client programs know the status of the game, and the "tournament over" variable is cleared to indicate the state of Playing a Tournament. At 4040, the server program updates the Large Display to show correct Bingo cards for each contestant.

Back at 4010, if it is detected that a tournament is in progress, then at 4045 a check is made to see if a game is running for which balls must be drawn, or if the "board complete" timer is running to create a pause between games. If the "board complete" timer is not running, the "Play a Ball" function (described below) is called at 4050. Otherwise, at 4055, the board-complete timer is decremented, and then checked for timeout at 4060. If the timer has timed out, then it is time to start a new game, so, at 4065, all of the Bingo balls from the last game are cleared off of the Large Display as well as the internal server memory. The spots are removed from the active Bingo cards and the spot counters are all cleared. A message is queued for each active gaming machine client program to indicate that a new game is starting. All paths through this function return back to the Game Cycle loop at 4070.

Figure 41:
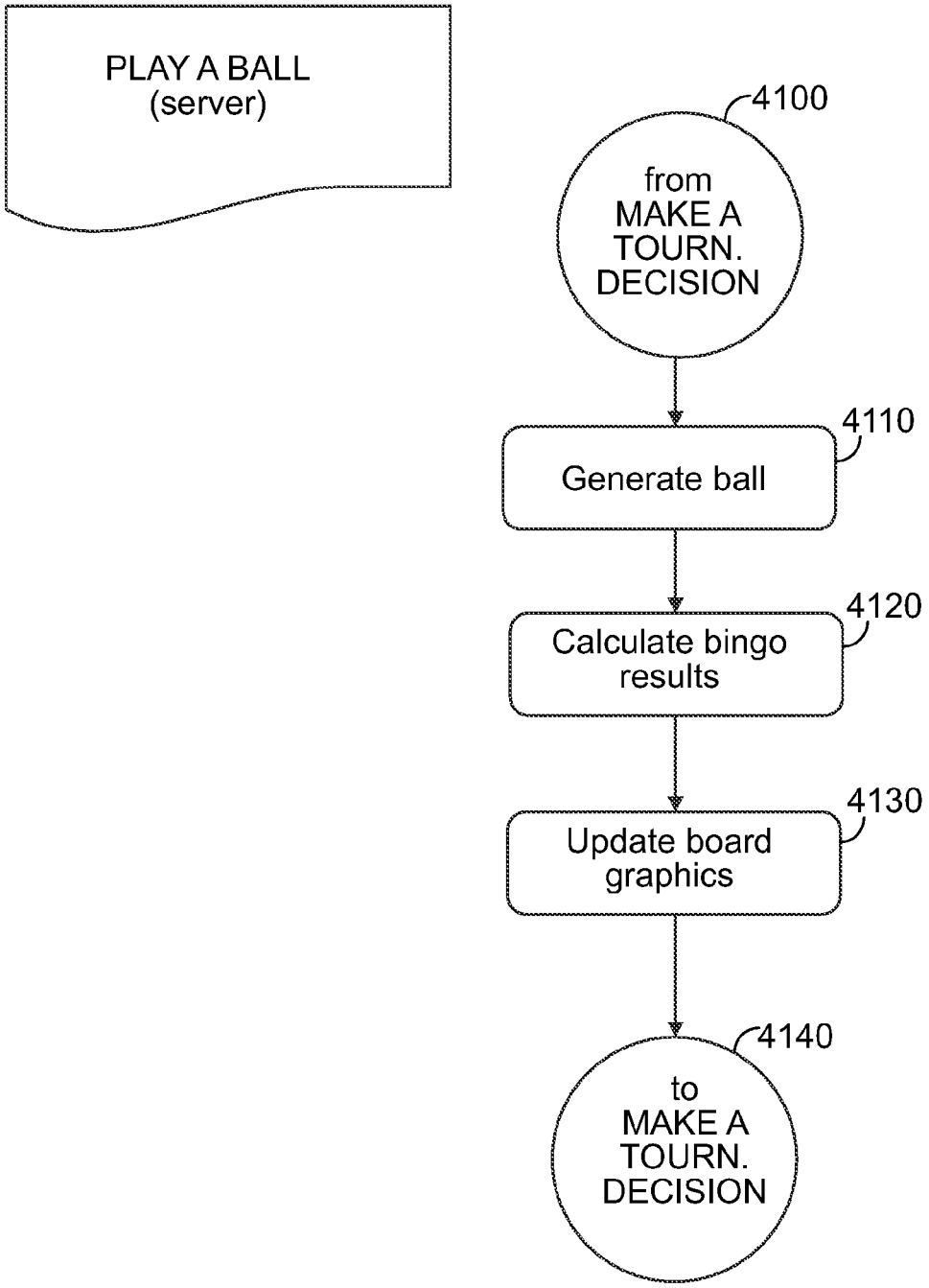

FIG. 41 shows the PLAY A BALL function, which is called from the "Make Tournament Decision" function at 4100. This function operates by invoking three function calls beginning with the "Generate Ball" function at 4110, followed by the "Calculate Bingo Results" function at 4120, and finally the "Update Board Graphics" function at 4130, before returning to Make a Tournament Decision at 4140. Each of these functions is explained below.

Figure 42:
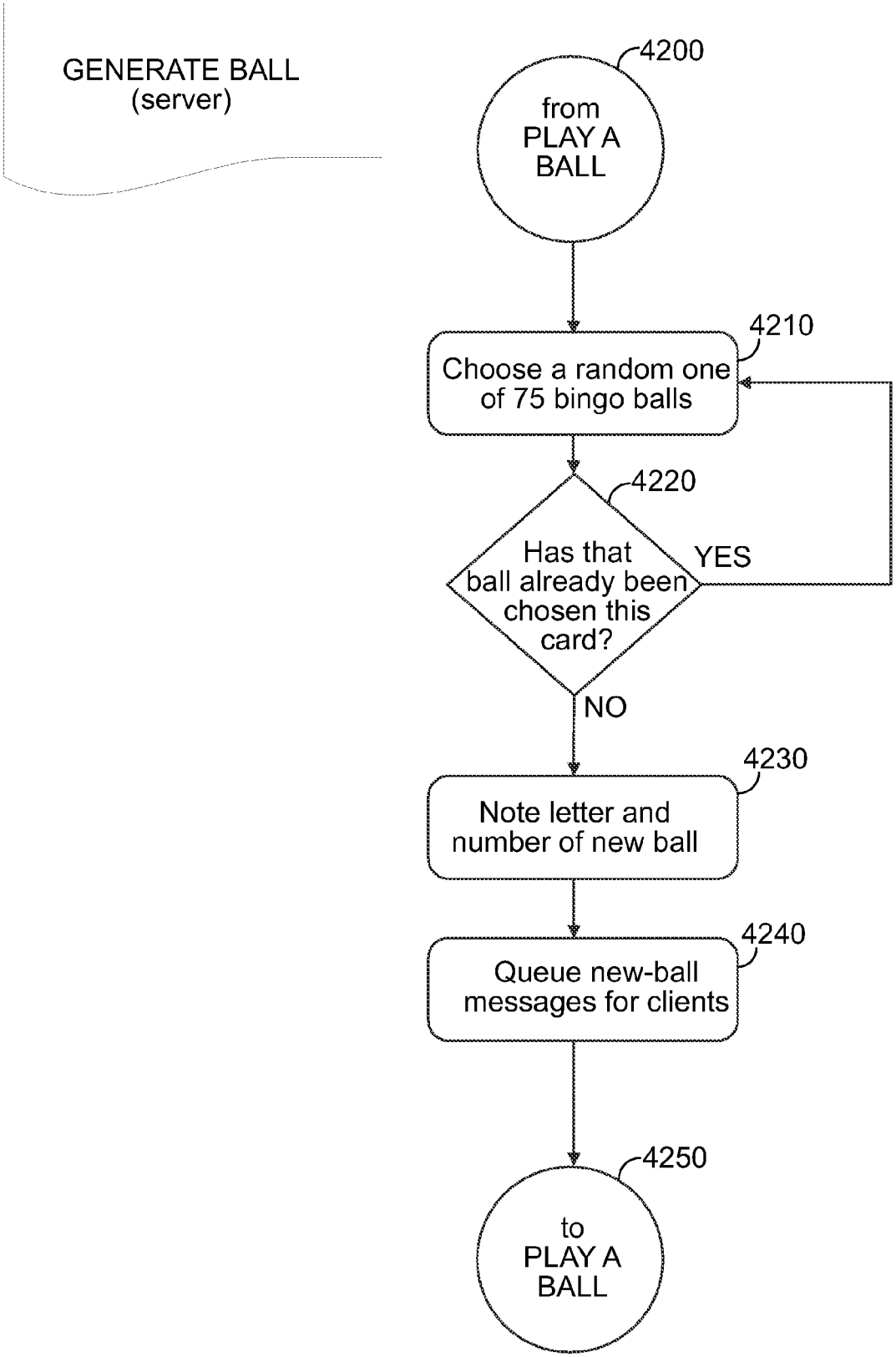

FIG. 42 shows the GENERATE A BALL function called from the "Play a Ball" function at 4200. At 4210, the server program uses its RNG to randomly choose one of the 75 Bingo balls. At 4220, the server program checks whether that ball has already been chosen in this game, and, if so, loops back to 4210 to draw another ball. Once a new ball has been selected, at 4230, the server program assigns the letter and number of this ball to a variable called "new ball," and, at 4240, adds client messages to the message queue containing information about the new ball, before returning to the "Play a Ball" function at 4250.

Figure 43:
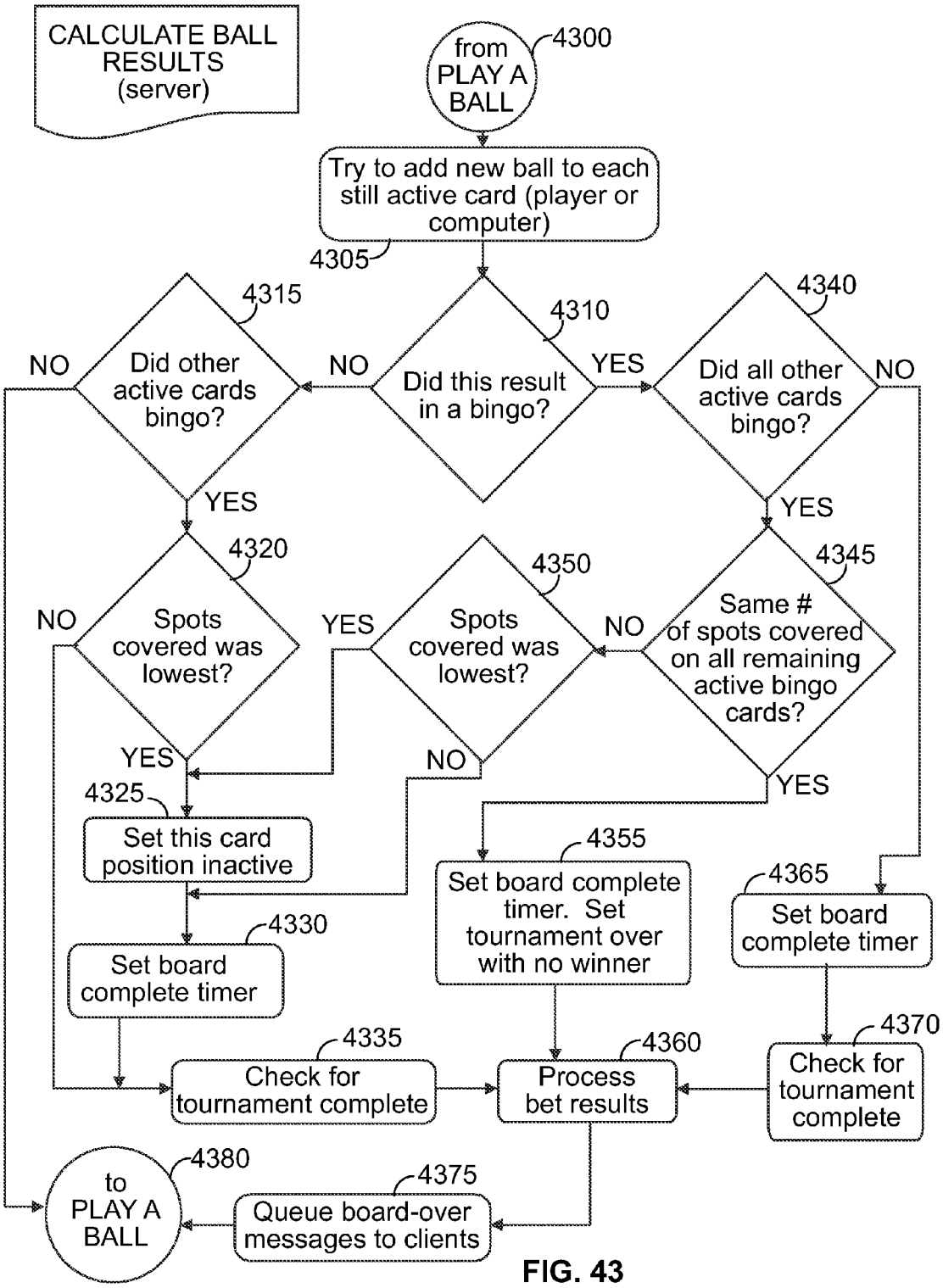

FIG. 43 shows the CALCULATE BINGO RESULTS function, called from the "Play a Ball" function at 4300. This somewhat complex function has been simplified a little bit for ease of explanation. At 4305, steps are taken for each active card to update the card based on the "new ball" that was just drawn. Any card containing this new number will be updated, including updating the total number of marked spots and whether a Bingo combination has been achieved. This step represents a loop through each card to complete this processing before moving to 4310.

With respect to steps 4310 through 4380, this logic is sequentially applied to each remaining active card. The check at 4310 determines if the current card has just achieved a Bingo combination. If the current card has not achieved a Bingo, then a check is made at 4315 as to whether a different card just achieved a Bingo. If 4315 returns a "false," then the function is finished processing the current card at 4380.

If, however, another card achieved a Bingo at 4315, then the spot count for the current card is checked at 4320. If it is the lowest spot count of cards not receiving a Bingo, then this card will be set "inactive" at 4325, removing it from the tournament. The server program then sets the "board complete" timer at 4330, which initiates the inter-game delay during the tournament. Now, whether or not this card was eliminated as a result of another card's Bingo, the server program calls the "Check for tournament complete" function at 4335 (explained below) and then the "Process Bet Results" function (also explained below) at 4360. As each card is processed, if a Bingo is detected (on that card or another), then this function will end at 4375, where messages for the associated client program are queued to send the information about the win, elimination, and bet results. Processing for that card then ends at 4380.

Back at 4310, if the current card being examined shows a Bingo combination, then a check is made at 4340 as to whether every other active card in the tournament also achieved a Bingo. This check is made because the rules in this embodiment require that at least one contestant card is removed after each round of the tournament. Getting a Bingo protects you from elimination, except for the case when every active card has a Bingo, in which case the card with the lowest number of spots marked is eliminated (whereas, when there is a Bingo on the card with the lowest number of spots, the Bingo would save that card if every other active card doesn't show Bingo).

If every active card gets a Bingo with the same number of spots covered, then all players are eliminated and the tournament ends without a winner. If it is detected at 4340 that every active card had a Bingo, then a check is made at 4345 to see if every active card has the same number of spots covered. If 4345 is "true," then the tournament is over with no winner, and the "board complete" timer and "tournament over" variables are set at 4355. The last two steps at 4360 and 4375 are completed in the same manner as when a Bingo is detected on a different card. If 4345 is "false," that means that all of the active cards did not have the same marked-spot count. In that situation, a check is made at 4350 to see if the current card has the lowest number of spots marked, and, if so, control moves to 4325, and this card is eliminated from this tournament, as described above. If, however, at 4350, this card does not have the lowest number of spots covered, then the server program proceeds at 4330 with the end-of-game processing for a game which had a Bingo, as also described above.

Returning to 4340, if one or more other active cards did not have Bingo (while the current card had a Bingo as detected at 4310), then a different card will be eliminated, and processing finishes at 4365 with the same steps for a game with a Bingo already described in reference to 4330. Once the sequential processing of 4310 through 4380 is complete for each active card, then the function returns to the "Play a Ball" function at 4380.

Figure 44:
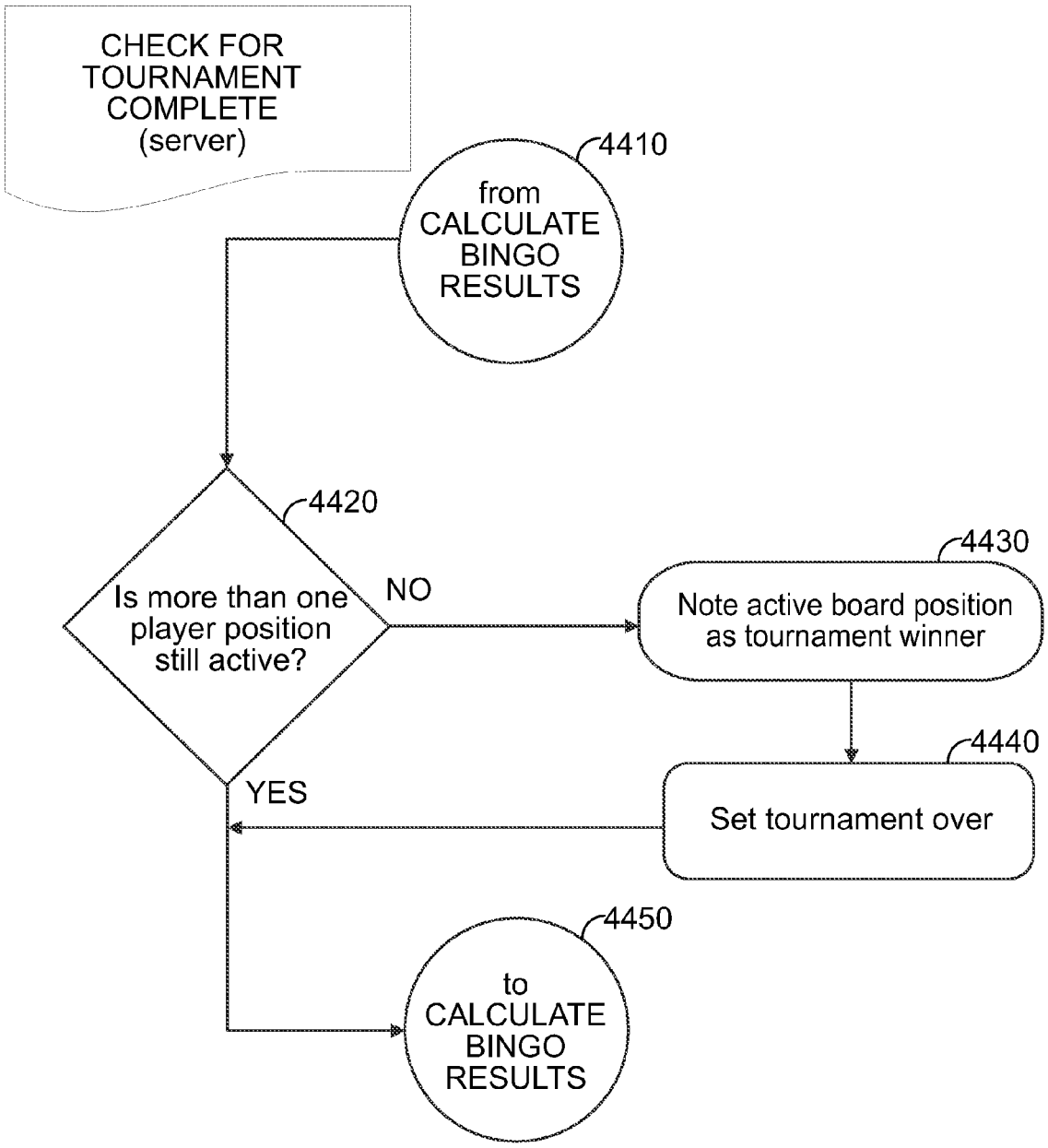

FIG. 44 shows the CHECK FOR TOURNAMENT COMPLETE function, called from the "Calculate Bingo Results" function (at 4410). At 4420, the server program checks to see if there is more than one active card remaining. If not, then, at 4430, the contestant number of the winning card (if any) is stored in a variable to be used later in client messaging. At 4440, the variable "tournament over" is set. In every case, control returns to "Calculate Bingo Results" at 4450.

Figure 45:
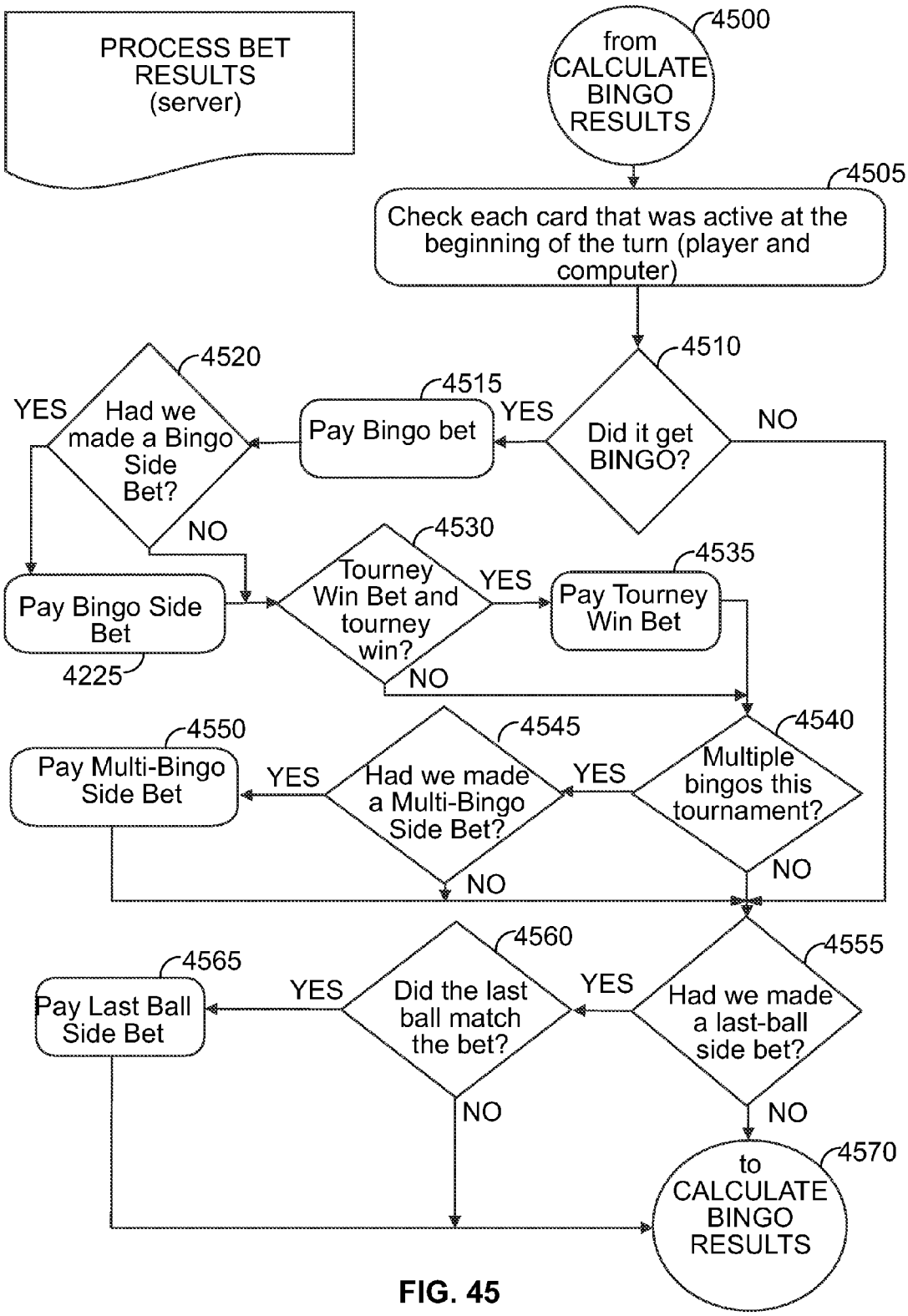

FIG. 45 shows the PROCESS BET RESULTS function called from the "Calculate Bingo Results" function (at 4500). 4505 indicates that the processing shown in 4510 through 4570 will be done for each card which was active when the current round began. The server determines each payout in this function, and, for each case where a bet is paid in FIG. 45, the server program queues a message for the gaming machine associated with the winning bet, containing information about the bet that won and the amount paid.

At 4510, a check is made to see if the current card has a Bingo combination in the current round. Four of the five bets used in this embodiment require a Bingo to generate each payout. If the current card has a Bingo, then, at 4515, the server program pays the Bingo Tournament Bet (by queuing the appropriate message to the associated gaming machine). At 4520, the server program checks whether this card had a Bingo side bet on the current tournament round. If so, then this side bet is paid at 4525, and, in either case, a check is made at 4530 as to whether the card had a bet on winning the tournament and whether this card has won the tournament.

If 4530 is "true," then the Tournament Win bet is paid at 4535, and, in either case, the server program checks at 4540 whether the Bingo for this card is not the first one. If this is "true," then this card will get another payout if the Multi-Bingo side bet was made, which is checked at 4545. If the Multi-Bingo side bet was made, then the win amount for the Multi-Bingo side bet is paid at 4550.

In one embodiment, there is an "Envy Bonus"—for a player that makes a large enough bet on the Multi-Bingo side bet—when another player gets a large number of Bingos in a game. The logic for this bonus could be added before 4555, where all previous paths now converge, including detecting an absence of Bingos on this card at 4510. At 4555, the server program checks whether a "last-ball" side bet has been made for this card. If so, a check is made at 4560 to see if the last ball drawn matched the ball associated with this bet and this card. If the last ball matches, then the bet is paid off at 4565. All paths then converge on 4570, which ends the processing for the current card. Once the section from 4510 through 4570 has been processed for all active cards, the function returns to "Calculate Bingo Results" at 4570.

Figure 46:
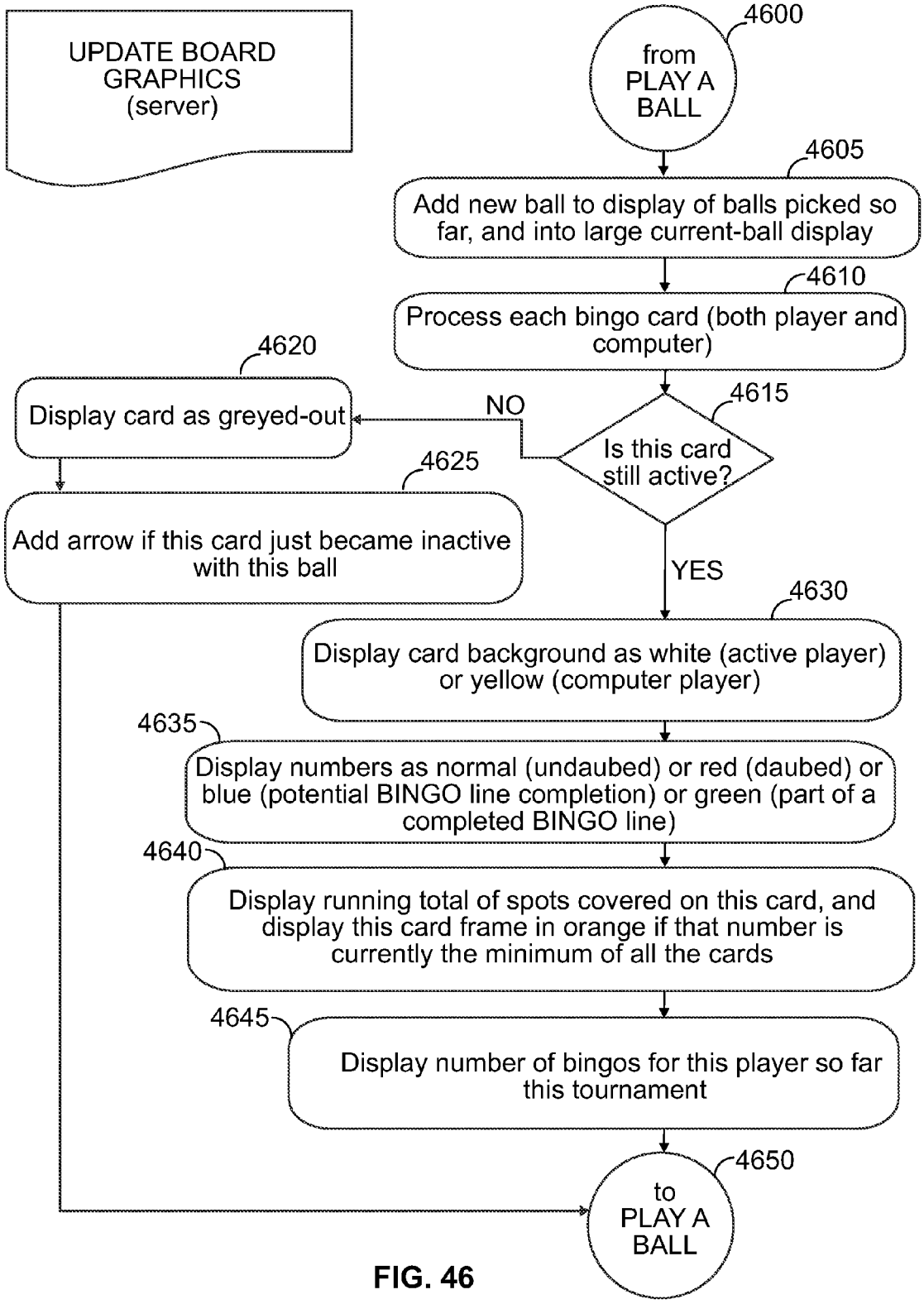

FIG. 46 shows the UPDATE BOARD GRAPHICS function, which is called from the "Play a Ball" function (at 4600). At 4605, the new ball that was just selected is added to the area in the Large Display where the balls are shown. 4610 indicates that 4615 through 4650 will be processed for each Bingo card, whether active or not. At 4615, a check is made to see if this card is still active. If the card is no longer active, it is shown grayed-out at 4620. At 4625, an arrow is shown on the Large Display pointing at the card, if it has just become inactive with the last ball picked.

Back at 4615, if the card is active, then the display of the card is updated on the Large Display, showing a white background if the card is associated with a gaming machine (player) or a yellow background if it is a non-player (computer) contestant card (at 4630). At 4635, the card is updated to show all matching numbers marked (daubed) using a color system to help spectators visually interpret the game. At 4640, the number of marked spots on the card is updated, and if this card has the lowest number of marked spots, it is shown with an orange background to emphasize that it is in danger of elimination. At 4645, the total number of Bingos for this card is indicated by a row of red dots, to allow those rooting for the player or monitoring for an Envy Bonus to have this information. The processing for each card ends at 4650. After all of the cards have been processed, the function returns to the "Play a Ball" function.

ALTERNATIVE EMBODIMENTS

The above description of the present invention has largely been in the context of a Bingo Elimination Tournament played by one or more human players that, in a casino environment, are each interacting with a respective networked gaming machine (including placing certain wagers, as described herein), as well as perhaps "played" by one or more computer-operated "players," such that each tournament would have the same number of participating Bingo cards, such as ten for example.

The present invention is not limited, however, to these embodiments. First, the underlying game in the elimination tournament need not be a Bingo game, or just a Bingo game (i.e., Bingo could be combined with another game to form a hybrid game). Other embodiments may involve any one or any combination of card games, poker games, any other games of chance, games of skill, combined games of chance and skill, and/or any other types of games.

As one example, players could serially be dealt various cards, perhaps forming one or more poker hands, and perhaps accumulate point values based on achieving certain hands according to a traditional poker hierarchy of hands. Players could then be eliminated based on having a low score after a certain amount of time or after a certain number of cards are dealt to each player (which may turn out to be the same thing in a computer-driven environment), as examples. Side bets could also be contemplated based on achieving particular hands such as a full house, etc. And numerous other examples are possible as well, without departing from the scope and spirit of the present invention.

Furthermore, one or more of the tournament players could participate from a remote location, perhaps via a networked computer over a data-communication network such as or including the Internet. As another variation, it is not critical that money be at stake—the present invention could be implemented just for the enjoyment of the experience. That is, there could be no bets, or there could be "bets" of valueless credits, i.e. just for fun. Furthermore, the present invention could be implemented as a live game, using paper/cardboard and/or computer-driven Bingo cards, actual balls drawn from an actual drum, a live person announcing, etc. In general, numerous embodiments of the present invention have been described above, and those skilled in the art will understand that changes and modifications may be made to those examples without departing from the scope and spirit of the present invention, as defined by the claims.

The invention claimed is:

1. A bingo tournament wagering casino game system, the game system comprising:

a plurality of video game machines, the machines being networked for simultaneous play of a bingo tournament game by players using the machines, each player having a differently-constituted bingo card at a start of the bingo tournament game;

a wagering input device associated with each machine;

a computer program operating the machines according to a methodology for playing the bingo tournament game, the methodology including matching numbers randomly selected from a set to the same numbers that may be present in a subset on a card, wherein play advances in a round until a contestant achieves a winning bingo combination of matched numbers;

the methodology further including, among the contestants that did not achieve a bingo in the round, elimination from continued play in the tournament of one or more contestants based on at least one elimination criterion;

repetition of the methodology with remaining contestants until an ending condition is met; and a payout calculation based upon at least one wager input.

2. The bingo game system of claim 1, wherein the ending condition is all but one contestant having been eliminated.

3. The bingo game system of claim 1, wherein at least one contestant is a computer-operated player.

4. The bingo game system of claim 1 further including:

a bingo-round side bet available to a contestant based upon that contestant achieving a bingo in a specified round, wherein the payout calculation includes a payout award according to a paytable for the bingo-round side bet.

5. The bingo game system of claim 1, further including:

a total-bingos side bet available to a contestant based upon that contestant achieving a specified total number of bingos in a tournament, wherein the payout calculation includes a payout award according to a paytable for the total-bingos side bet.

6. The bingo game system of claim 1, further including:

a last-ball side bet available to a contestant based upon that contestant matching a specified last number in a round, wherein the payout calculation includes a payout award according to a paytable for the last-ball side bet.

7. The bingo game system of claim 1, further including:

a tournament-win side bet available to a contestant based upon that contestant winning a tournament, wherein the payout calculation includes a payout award according to a paytable for the tournament-win side bet.

8. The bingo game system of claim 1, further including:

an envy-bonus side bet available to a contestant based upon at least one other contestant achieving a specified number of bingos in a tournament, wherein the payout calculation includes a payout award according to a paytable for the envy-bonus side bet.

9. The bingo game system of claim 1, wherein the methodology and the payout calculation provide for increasingly-valuable prizes as a tournament progresses to later rounds.

10. The bingo game system of claim 1, wherein the methodology and the payout calculation provide for increasingly-valuable prizes as the number of remaining contestants decreases.

11. The bingo game system of claim 1, wherein the methodology and the payout calculation apply a single wager made by a player to each round of a tournament in which the player participates.

12. The bingo game system of claim 11, wherein the methodology and the payout calculation provide for increasing payouts based on the single wager as the player progresses through successive rounds of the tournament.

13. The bingo game system of claim 1, wherein the methodology further includes tallying each card's matched numbers in a current round, wherein the at least one elimination criterion comprises having the lowest tally of matched numbers in the current round.

14. The bingo game system of claim 13, further including a display for each contestant indicating the current tally of matched numbers for that contestant for the current round, wherein the display for each contestant is updated with each number selected in the current round, wherein each display further indicates a number of matched numbers needed for that contestant to advance from the current round to a next round.

15. The bingo game system of claim 14, wherein the display for each contestant iteratively conveys, using at least one of color and relative position, the relative value of (a) the current tally of matched numbers for that contestant for the current round and (b) the number of matched numbers needed for that contestant to advance from the current round to a next round.

16. The bingo game system of claim 13, further comprising a common display showing all contestant cards, the common display highlighting the one or more contestant cards currently having the lowest tally of matched numbers, wherein the common display is updated with each number selected in a round.

* * * * *